US011238843B2

(12) United States Patent
Arik et al.

(10) Patent No.: US 11,238,843 B2
(45) Date of Patent: Feb. 1, 2022

(54) SYSTEMS AND METHODS FOR NEURAL VOICE CLONING WITH A FEW SAMPLES

(71) Applicant: Baidu USA, LLC, Sunnyvale, CA (US)

(72) Inventors: Sercan O. Arik, San Francisco, CA (US); Jitong Chen, Sunnyvale, CA (US); Kainan Peng, Sunnyvale, CA (US); Wei Ping, Sunnyvale, CA (US); Yanqi Zhou, San Jose, CA (US)

(73) Assignee: Baidu USA LLC, Sunnyvale, CA (US)

( * ) Notice: Subject to any disclaimer, the term of this patent is extended or adjusted under 35 U.S.C. 154(b) by 137 days.

(21) Appl. No.: 16/143,330

(22) Filed: Sep. 26, 2018

(65) Prior Publication Data

US 2019/0251952 A1 Aug. 15, 2019

Related U.S. Application Data

(60) Provisional application No. 62/628,736, filed on Feb. 9, 2018.

(51) Int. Cl.
*G10L 13/00* (2006.01)
*G10L 13/047* (2013.01)
(Continued)

(52) U.S. Cl.
CPC ..... *G10L 13/047* (2013.01); *G10L 13/027* (2013.01); *G10L 13/08* (2013.01)

(58) Field of Classification Search
CPC ..... G10L 13/027; G10L 13/033; G10L 25/30; G10L 13/00; G10L 13/02; G10L 15/02;
(Continued)

(56) References Cited

U.S. PATENT DOCUMENTS 5,970,453 A * 10/1999 Sharman ..... G10L 13/07 704/258
5,983,184 A * 11/1999 Noguchi ..... G09B 21/006 704/270

(Continued)

OTHER PUBLICATIONS

Li Wan, Quan Wang, Alan Papir, and Ignacio Lopez Moreno. Generalized end-to-end loss for speaker verification, 2018. (Year: 2018).*

(Continued)

*Primary Examiner* — Michael Ortiz-Sanchez
(74) *Attorney, Agent, or Firm* — North Weber & Baugh LLP

(57) ABSTRACT

Voice cloning is a highly desired capability for personalized speech interfaces. Neural network-based speech synthesis has been shown to generate high quality speech for a large number of speakers. Neural voice cloning systems that take a few audio samples as input are presented herein. Two approaches, speaker adaptation and speaker encoding, are disclosed. Speaker adaptation embodiments are based on fine-tuning a multi-speaker generative model with a few cloning samples. Speaker encoding embodiments are based on training a separate model to directly infer a new speaker embedding from cloning audios, which is used in or with a multi-speaker generative model. Both approaches achieve good performance in terms of naturalness of the speech and its similarity to original speaker—even with very few cloning audios.

20 Claims, 32 Drawing Sheets

(51) Int. Cl.
*G10L 13/027* (2013.01)
*G10L 13/08* (2013.01)

(58) Field of Classification Search
CPC ..... G10L 15/063; G10L 13/04; G10L 13/047; G10L 15/142; G10L 17/04; G10L 17/18; G10L 19/018; G10L 2021/0135; G10L 15/16; G10L 17/00; G10L 17/22; G10L 21/003; G10L 15/22; G10L 13/0335; G10L 13/086; G06K 9/6256; G06F 21/32
See application file for complete search history.

(56) References Cited

U.S. PATENT DOCUMENTS

| | | | | |
|---|---|---|---|---|
| 7,483,832 | B2 * | 1/2009 | Tischer | G10L 13/033 704/258 |
| 8,423,366 | B1 * | 4/2013 | Foster | G10L 13/06 704/258 |
| 10,140,973 | B1 * | 11/2018 | Dalmia | G06F 40/247 |
| 10,163,436 | B1 * | 12/2018 | Slifka | G06F 40/35 |
| 2002/0120450 | A1 * | 8/2002 | Junqua | G10L 13/04 704/258 |
| 2005/0182629 | A1 * | 8/2005 | Coorman | G10L 13/07 704/266 |
| 2006/0095265 | A1 * | 5/2006 | Chu | G10L 13/033 704/268 |
| 2009/0094031 | A1 * | 4/2009 | Tian | G10L 15/063 704/251 |
| 2009/0125309 | A1 * | 5/2009 | Tischer | G10L 13/033 704/260 |
| 2011/0137650 | A1 * | 6/2011 | Ljolje | G10L 15/144 704/236 |
| 2011/0165912 | A1 * | 7/2011 | Wang | G10L 13/033 455/563 |
| 2015/0228271 | A1 * | 8/2015 | Morita | G10L 13/033 704/258 |
| 2017/0076715 | A1 * | 3/2017 | Ohtani | G10L 13/04 |
| 2018/0075343 | A1 * | 3/2018 | van den Oord | G06N 3/0472 |
| 2018/0137875 | A1 * | 5/2018 | Liu | G10L 21/003 |
| 2018/0247636 | A1 * | 8/2018 | Arik | G10L 13/027 |
| 2018/0254034 | A1 * | 9/2018 | Li | G10L 13/02 |
| 2018/0268806 | A1 * | 9/2018 | Chun | G10L 13/047 |

OTHER PUBLICATIONS

Jemine, Corentin. "Master Thesis: Real-time Voice Cloning", Jun. 26, 2019 (Year: 2019).*
E. Nachmani, A. Polyak, Y. Taigman, and L. Wolf, "Fitting new speakers based on a short untranscribed sample," arXiv; 1802.06984, 2018. (Year: 2018).*
O. Abdel-Hamid and H. Jiang, "Fast speaker adaptation of hybrid NN/HMM model for speech recognition based on discriminative learning of speaker code," in Proc. ICASSP, 2013, pp. 7942-7946. (Year: 2013).*
Y. Fan, Y. Qian, F. K. Soong and L. He, "Multi-speaker modeling and speaker adaptation for DNN-based TTS synthesis," 2015 IEEE International Conference on Acoustics, Speech and Signal Processing (ICASSP), 2015, pp. 4475-4479, doi: 10.1109/ICASSP.2015.7178817. (Year: 2015).*
Jozefowicz et al., "Exploring the limits of language modeling," arXiv preprint arXiv:1602.02410, 2016.(11 pgs).
Karras et al., "Progressive growing of gans for improved quality, stability, and variation," CoRR, abs/1710.10196, 2018. (26pgs).
Lake et al., "One-shot learning by inverting a compositional causal process," In NIPS, 2013. (9pgs).
Lake et al., "One-shot learning of generative speech concepts," In CogSci, 2014. (6pgs).
Lake et al., "Human-level concept learning through probabilistic program induction," Science, 2015. (8 pgs).
Li & Wu, "Modeling speaker variability using long short-term memory networks for speech recognition," In INTERSPEECH, 2015. (5 pgs).
Mehri et al., "SampleRNN:An unconditional end-to-end neural audio generation model," arXiv preprint arXiv:1612.07837, 2017. (11 pgs).
Miao et al., "On speaker adaptation of long short-term memory recurrent neural networks," In 16th Annual Conference of the ISCA, 2015. (5pgs).
Miao et al., "Speaker adaptive training of deep neural network acoustic models using I-vectors," IEEE/ACM Transactions on Audio, Speech & Language Processing, 2015. (13pgs).
Oord et al., "WAVENET: A generative model for raw audio," arXiv preprint arXiv:1609.03499, 2016. (15 pgs).
Vaswani et al., "Attention is all you need," In NIPS. 2017. (11 pgs).
Veaux et al., "CSTR VCTK Corpus: English multi-speaker corpus for CSTR voice cloning toolkit," Retrieved from Internet <URL. <https://datashare.is.ed.ac.uk/handle/10283/2651>, 2017. (2pgs).
Wang et al., "TACOTRON: A Fullyend-to-Endtext-to-Speechsynthesismodel," CoRR, abs/1703.10135, 2017. (10pgs).
Wester et al., "Analysis of the voice conversion challenge 2016 evaluation results," In INTERSPEECH, pp. 1637-1641, 2016. (5pgs).
Wu et al., "Locally linear embedding for exemplar-based spectral conversion," In INTERSPEECH, 2016. (6pgs).
Wu et al., "A study of speaker adaptation for DNN-based speech synthesis," In INTERSPEECH, 2015. (5pgs).
Xue et al., "Fast adaptation of deep neural network based on discriminant codes for speech recognition," IEEE/ACM Transactions on Audio,Speech & Language Processing, 2014.(28pgs.
Yamagishi et al., "Analysis of speaker adaptation algorithms for hmm-based speech synthesis and a constrained smaplr adaptation algorithm," IEEE Transactions on Audio.
Speech, and Language Processing, 2009. (18 pgs).
Oord et al., "Conditional image generation with pixeICNN decoders," In Advances in Neural Information Processing Systems, 2016. (9pgs).
Panayotov et al., "LIBRISPEECH: An ASR corpus based on public domain audio books," In IEEE ICASSP, 2015. (5pgs).
Ping et al., "Deep Voice 3: Scaling text-to-speech with convolutional sequence learning," In ICLR, 2018. (16pgs).
Prince et al., "Probabilistic linear discriminant analysis for inferences about identity," In ICCV, 2007. (8pgs).
Reed et al., "Few-shot autoregressive density estimation: Towards learning to learn distributions," arXiv preprint arXiv:1710.10304, 2017. (11 pgs).
Rezende et al., "One-shot generalization in deep generative models," arXiv preprint arXiv:1603.05106, 2016. (10pgs).
Shen et al., "Natural TTS synthesis by conditioning wavenet on mel spectrogram predictions," arXiv preprint arXiv:1712.05884, 2017. (5pgs).
Snyder et al., "Deep neural network-based speaker embeddings for end-to-end speaker verification," In IEEE Spoken Language Technology Workshop (SLT), 2016. (6pgs).
Sotelo et al., "Char2wav:End-to-end speech synthesis," In ICLR 2017. (6pgs).
Taigman et al., "Voiceloop: Voice fitting and synthesis via a phonological loop," In ICLR, 2018. (14 pgs).
Yu et al., "KI-divergence regularized deep neural network adaptation for improved large vocabulary speech recognition," In IEEE ICASSP, 2013.(5pgs).
Abdel-Hamid et al., "Fast speaker adaptation of hybrid nn/hmm model for speech recognition based on discriminative learning of speaker code," In IEEE ICASSP, 2013.(5pgs).
Agiomyrgiannakis et al., "Voice morphing that improves tts quality using an optimal dynamic frequency warping-and-weighting transform," IEEE ICASSP, 2016. (5pgs).
Amodei et al., "Deep speech 2: End-to-end speech recognition in english and mandarin," In International Conference on Machine Learning, pp. 173-182, 2016. (10pgs).
Arik et al., "Deep Voice: Real-time neural text-to-speech," In ICML, 2017. (10pgs).
Arik et al., "Deep Voice 2: Multi-speaker neural text-to-speech," arXiv preprint arXiv:1705.08947, 2017. (15 pgs).

(56) References Cited

OTHER PUBLICATIONS

Azadi et al., "Multi-content GAN for few-shot font style transfer," arXiv preprint arXiv:1712.00516, 2017. (16pgs).
Chen et al., "Voice conversion using deep neural networks with layer-wise generative training," IEEE/ACM Transactions on Audio, Speech, and Language Processing, 2014. (2pgs).
Cui et al., "Embedding-based speaker adaptive training of deep neural networks," arXiv preprint arXiv:1710.06937, 2017. (5pgs).
Desai et al., "Spectral mapping using artificial neural networks for voice conversion," IEEE Transactions on Audio, Speech, and Language Processing, 2010. (12pgs).
Hwang et al., "A probabilistic interpretation for artificial neural network-based voice conversion," 10.1109/APSIPA.2015.7415330, 2015. (8pgs).

* cited by examiner

2800

2900

3000

SYSTEMS AND METHODS FOR NEURAL VOICE CLONING WITH A FEW SAMPLES

CROSS-REFERENCE TO RELATED APPLICATION

This application claims the priority benefit under 35 USC § 119(e) to U.S. Provisional Patent Application No. 62/628,736, filed on 9 Feb. 2018, entitled "NEURAL VOICE CLONING WITH A FEW SAMPLES," and listing Sercan Ö. Arik, Jitong Chen, Kainan Peng, and Wei Ping as inventors. The aforementioned patent document is incorporated by reference herein in its entirety.

BACKGROUND

A. Technical Field

The present disclosure relates generally to systems and methods for computer learning that can provide improved computer performance, features, and uses. More particularly, the present disclosure relates to systems and methods for text-to-speech through deep neutral networks.

B. Background

Artificial speech synthesis systems, commonly known as text-to-speech (TTS) systems, convert written language into human speech. TTS systems are used in a variety of applications, such as human-technology interfaces, accessibility for the visually-impaired, media, and entertainment. Fundamentally, it allows human-technology interaction without requiring visual interfaces. Traditional TTS systems are based on complex multi-stage hand-engineered pipelines. Typically, these systems first transform text into a compact audio representation, and then convert this representation into audio using an audio waveform synthesis method called a vocoder.

One goal of TTS systems is to be able to make a text input generate a corresponding audio that sounds like a speaker with certain audio/speaker characteristics. For example, making personalized speech interfaces that sound like a particular individual from low amounts of data corresponding to that individual (sometime referred to as "voice cloning") is a highly desired capability. Some systems do have such capability; but, of the systems that attempt to perform voice cloning, they typically require large numbers of samples to create a natural sounding speech with the desired speech characteristics.

Accordingly, what is needed are systems and methods for creating, developing, and/or deploying speaker text-to-speech systems that can provide voice cloning with a very limited number of samples.

BRIEF DESCRIPTION OF THE DRAWINGS

References will be made to embodiments of the disclosure, examples of which may be illustrated in the accompanying figures. These figures are intended to be illustrative, not limiting. Although the disclosure is generally described in the context of these embodiments, it should be understood that it is not intended to limit the scope of the disclosure to these particular embodiments. Items in the figures may not be to scale.

DETAILED DESCRIPTION OF EMBODIMENTS

Figure 1:
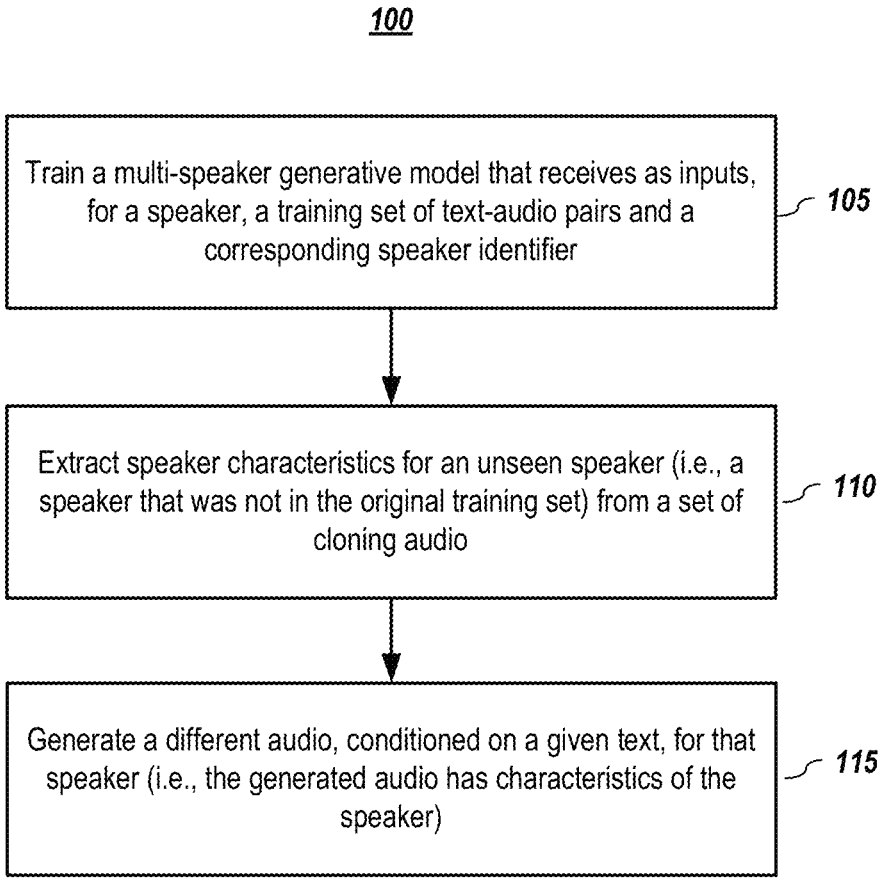
FIG. 1 depicts an example methodology for generating audio with speaker characteristics from a limited set of audio, according to embodiments of the present disclosure.

In the following description, for purposes of explanation, specific details are set forth in order to provide an understanding of the disclosure. It will be apparent, however, to one skilled in the art that the disclosure can be practiced without these details. Furthermore, one skilled in the art will recognize that embodiments of the present disclosure, described below, may be implemented in a variety of ways, such as a process, an apparatus, a system, a device, or a method on a tangible computer-readable medium.

Components, or modules, shown in diagrams are illustrative of exemplary embodiments of the disclosure and are meant to avoid obscuring the disclosure. It shall also be understood that throughout this discussion that components may be described as separate functional units, which may comprise sub-units, but those skilled in the art will recognize that various components, or portions thereof, may be divided into separate components or may be integrated together, including integrated within a single system or component. It should be noted that functions or operations discussed herein may be implemented as components. Components may be implemented in software, hardware, or a combination thereof.

Furthermore, connections between components or systems within the figures are not intended to be limited to direct connections. Rather, data between these components may be modified, re-formatted, or otherwise changed by intermediary components. Also, additional or fewer connections may be used. It shall also be noted that the terms "coupled," "connected," or "communicatively coupled" shall be understood to include direct connections, indirect connections through one or more intermediary devices, and wireless connections.

Reference in the specification to "one embodiment," "preferred embodiment," "an embodiment," or "embodiments" means that a particular feature, structure, characteristic, or function described in connection with the embodiment is included in at least one embodiment of the disclosure and may be in more than one embodiment. Also, the appearances of the above-noted phrases in various places in the specification are not necessarily all referring to the same embodiment or embodiments.

The use of certain terms in various places in the specification is for illustration and should not be construed as limiting. A service, function, or resource is not limited to a single service, function, or resource; usage of these terms may refer to a grouping of related services, functions, or resources, which may be distributed or aggregated. A set may comprise one or more elements. "Audio" as used herein may be represented in a number of ways including, but not limited, to a file (encoded or raw audio file), a signal (encoded or raw audio), or auditory soundwaves; thus, for example, references to generating an audio or generating a synthesized audio means generating content that can produce a final auditory sound with the aid of one or more devices or is a final auditory sound and therefore shall be understood to mean any one or more of the above.

The terms "include," "including," "comprise," and "comprising" shall be understood to be open terms and any lists the follow are examples and not meant to be limited to the listed items. Any headings used herein are for organizational purposes only and shall not be used to limit the scope of the description or the claims. Each reference mentioned in this patent document is incorporate by reference herein in its entirety.

Furthermore, one skilled in the art shall recognize that: (1) certain steps may optionally be performed; (2) steps may not be limited to the specific order set forth herein; (3) certain steps may be performed in different orders; and (4) certain steps may be done concurrently.

A. Introduction

1. Few-Shot Generative Models

Humans can learn most new generative tasks from only a few examples, and it has motivated research on few-shot generative models. Early studies on few-shot generative modeling mostly focus on Bayesian models. Hierarchical Bayesian models have been used to exploit compositionality and causality for few-shot generation of characters. A similar idea has been modified to acoustic modeling task, with the goal of generating new words in a different language.

Recently, deep learning approaches have adapted to few-shot generative modeling, particularly for image generation applications. Few-shot distribution estimation has been considered using an attention mechanism and meta-learning procedure, for conditional image generation. Few-shot learning has been applied to font style transfer, by modeling the glyph style from a few observed letters, and synthesizing the whole alphabet conditioned on the estimated style. The technique was based on multi-content generative adversarial networks, penalizing the unrealistic synthesized letters compared to the ground truth. Sequential generative modeling has been applied for one-shot generalization in image generation, using a spatial attentional mechanism.

2. Speaker Embeddings in Speech Processing

Speaker embedding is an approach to encode discriminative information in speakers. It has been used in many speech processing tasks such as speaker recognition/verification, speaker diarization, automatic speech recognition, and speech synthesis. In some of these, the model explicitly learned to output embeddings with a discriminative task such as speaker classification. In others, embeddings were randomly initialized and implicitly learned from an objective function that is not directly related to speaker discrimination. For example, in commonly-assigned U.S. patent application Ser. No. 15/974,397, filed on 8 May 2018, entitled "SYSTEMS AND METHODS FOR MULTI-SPEAKER NEURAL TEXT-TO-SPEECH"; and commonly-assigned U.S. Prov. Pat. App. No. 62/508,579, filed on 19 May 2017, entitled "SYSTEMS AND METHODS FOR MULTI-SPEAKER NEURAL TEXT-TO-SPEECH" (each of the aforementioned patent documents is incorporated by reference herein in its entirety and for all purposes), embodiments of multi-speaker generative models were trained to generate audio from text, where speaker embeddings were implicitly learned from a generative loss function.

3. Voice Conversion

A goal of voice conversion is to modify an utterance from source speaker to make it sound like the target speaker, while keeping the linguistic contents unchanged. One common approach is dynamic frequency warping, to align spectra of different speakers. Some have proposed a dynamic programming algorithm that allegedly simultaneously estimates the optimal frequency warping and weighting transform while matching source and target speakers using a matching-minimization algorithm. Others use a spectral conversion approach integrated with the locally linear embeddings for manifold learning. There are also approaches to model spectral conversion using neural networks. Those models are typically trained with a large amount of audio pairs of target and source speakers.

4. Voice Cloning with Limited Samples General Introduction

Generative models based on deep learning have been successfully applied to many domains such as image synthesis, audio synthesis, and language modeling. Deep neural networks are capable of modeling complex data distributions and they scale well with large training data. They can be further conditioned on external inputs to control high-level behaviors, such as dictating the content and style of generated sample.

For speech synthesis, generative models can be conditioned on text and speaker identity. While text carries linguistic information and controls the content of the generated speech, speaker representation captures speaker characteristics such as pitch range, speech rate, and accent. One approach for multi-speaker speech synthesis is to jointly train a generative model and speaker embeddings on triplets of (text, audio, speaker identity). Embeddings for all speakers may be randomly initialized and trained with a generative loss. In one or more embodiments, one idea is to encode the speaker-dependent information with low-dimensional embeddings, while sharing the majority of the model parameters for all speakers. One limitation of such a model is that it can only generate speech for speakers observed during training. A more interesting task is to learn the voice of an unseen speaker from a few speech samples, or voice cloning. Voice cloning can be used in many speech-enabled applications such as to provide personalized user experience.

In this patent document, embodiments address voice cloning with limited speech samples from an unseen speaker (i.e., a new speaker/speaker not present during training), which may also be considered in the context of one-shot or few-shot generative modeling of speech. With a large number of samples, a generative model may be trained from scratch for any target speaker. However, few-shot generative modeling is challenging besides being appealing. The generative model should learn the speaker characteristics from limited information provided by a set of one or more audio samples and generalize to unseen texts. Different voice cloning embodiments with end-to-end neural speech synthesis approaches, which apply sequence-to-sequence modeling with attention mechanism, are presented herein. In neural speech synthesis, an encoder converts text to hidden representations, and a decoder estimates the time-frequency representation of speech in an autoregressive way. Compared to traditional unit-selection speech synthesis and statistical parametric speech synthesis, neural speech synthesis tends to have a simpler pipeline and to produce more natural speech.

An end-to-end multi-speaker speech synthesis model may be parameterized by the weights of generative model and a speaker embedding look-up table, where the latter carries the speaker characteristics. In this patent document, two issues are addressed: (1) how well can speaker embeddings capture the differences among speakers?; and (2) how well can speaker embeddings be learned for an unseen speaker with only a few samples? Embodiments of two general voice cloning approaches are disclosed: (i) speaker adaptation and (ii) speaker encoding, in terms of speech naturalness, speaker similarity, cloning/inference time and model footprint.

B. Voice Cloning

FIG. 1 depicts an example methodology for generating audio with speaker characteristics from a limited set of audio according to embodiments of the present disclosure. In one or more embodiments, a multi-speaker generative model, which receives as inputs, for a speaker, a training set of text-audio pairs and a corresponding speaker identifier is trained (105). Consider, by way of illustration, the following a multi-speaker generative model:

$$f(t_{i,j}, s_i; W, e_{s_i})$$

which takes a text $t_{i,j}$ and a speaker identity $s_i$. The trainable parameters in the model are parameterized by W, and $e_{s_i}$ denotes the trainable speaker embedding corresponding to $s_i$. Both W and $e_{s_i}$ may be optimized by minimizing a loss function L that penalizes the difference between generated and ground truth audios (e.g., a regression loss for spectrogram):

$$\min_{W,e} \mathbb{E}_{\substack{s_i \sim S, \\ (t_{i,j}, a_{i,j}) \sim T_{s_i}}} \{L(f(t_{i,j}, s_i; W, e_{s_i}), a_{i,j})\} \quad (1)$$

where $\mathcal{S}$ is a set of speakers, $\mathcal{T}_i$ is a training set of text-audio pairs for speaker $s_i$, and $a_{i,j}$ is the ground-truth audio for $t_{i,j}$ of speaker $s_i$. The expectation is estimated over text-audio pairs of all training speakers. In one or more embodiments, $\mathbb{E}$ operator for the loss function is approximated by minibatch. In one or more embodiments, $\hat{W}$ and $\hat{e}$ are used to denote the trained parameters and embeddings, respectively.

Speaker embeddings have been shown to effectively capture speaker differences for multi-speaker speech synthesis. They are low-dimension continuous representations of speaker characteristics. For example, commonly-assigned U.S. patent application Ser. No. 15/974,397, filed on 8 May 2018, entitled "SYSTEMS AND METHODS FOR MULTI-SPEAKER NEURAL TEXT-TO-SPEECH"; commonly-assigned U.S. Prov. Pat. App. No. 62/508,579, filed on 19 May 2017, entitled "SYSTEMS AND METHODS FOR MULTI-SPEAKER NEURAL TEXT-TO-SPEECH"; commonly-assigned U.S. patent application Ser. No. 16/058,265, filed on 8 Aug. 2018, entitled "SYSTEMS AND METHODS FOR NEURAL TEXT-TO-SPEECH USING CONVOLUTIONAL SEQUENCE LEARNING"; and commonly-assigned U.S. Prov. Pat. App. No. 62/574,382, filed on 19 Oct. 2017, entitled "SYSTEMS AND METHODS FOR NEURAL TEXT-TO-SPEECH USING CONVOLUTIONAL SEQUENCE LEARNING" (each of the aforementioned patent documents is incorporated by reference herein in its entirety and for all purposes) disclose embodiments of multi-speaker generative models, which embodiments may be employed herein by way of illustration, although other multi-speaker generative models may be used. Despite being trained with a purely generative loss, discriminative properties (e.g., gender or accent) can indeed be observed in embedding space. See Section F, below, for example embodiments of multi-speaker generative models, although other multi-speaker generative models may be used.

Voice cloning aims to extract (110) the speaker characteristics for an unseen speaker $s_k$ (that is not in $\mathcal{S}$) from a set of cloning audios $\mathcal{A}_{s_k}$ to generate (115) a different audio conditioned on a given text for that speaker. The two performance metrics for the generated audio that may be considered are: (i) how natural it is, and (ii) whether it sounds like it is pronounced by the same speaker. Various embodiments of two general approaches for neural voice cloning (i.e., speaker adaptation and speaker encoding) are explained in the following sections.

1. Speaker Adaptation

In one or more embodiments, speaker adaptation involves fine-tuning a trained multi-speaker model for an unseen speaker using a set of one or more audio samples and corresponding texts by applying gradient descent. Finetuning may be applied to either the speaker embedding or the whole model.

a) Speaker Embedding Only Fine-Tuning

Figure 2:
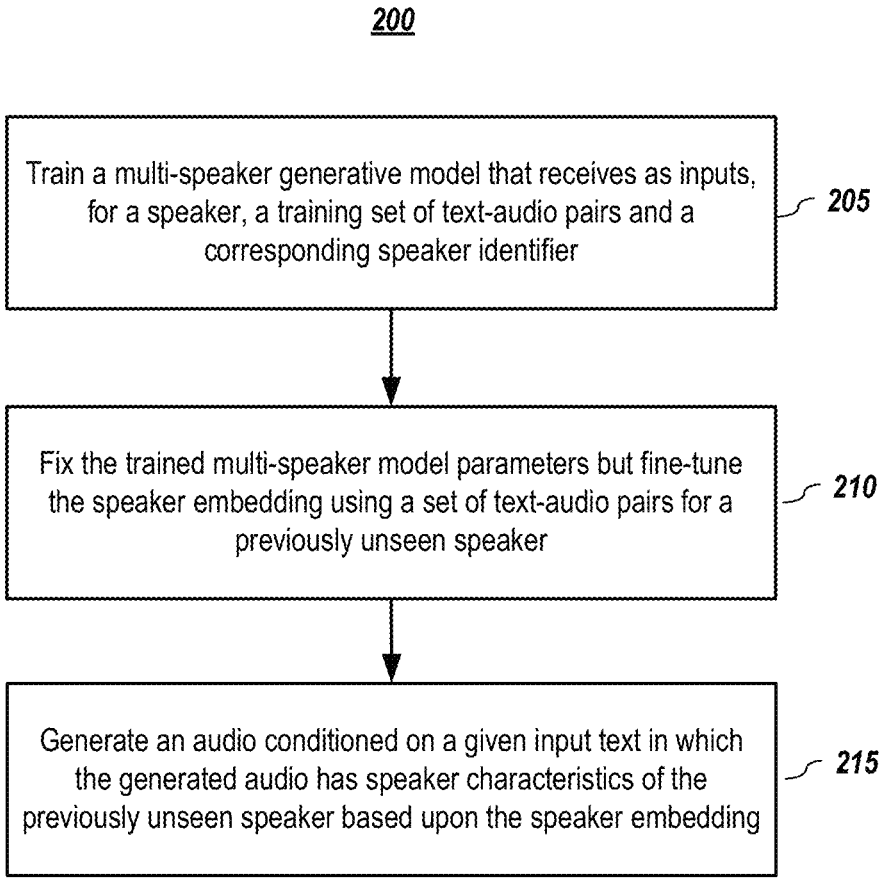
FIG. 2 depicts a speaker adaptation methodology for generating audio with speaker characteristics from a limited set of audio samples, according to embodiments of the present disclosure.
Figure 3:
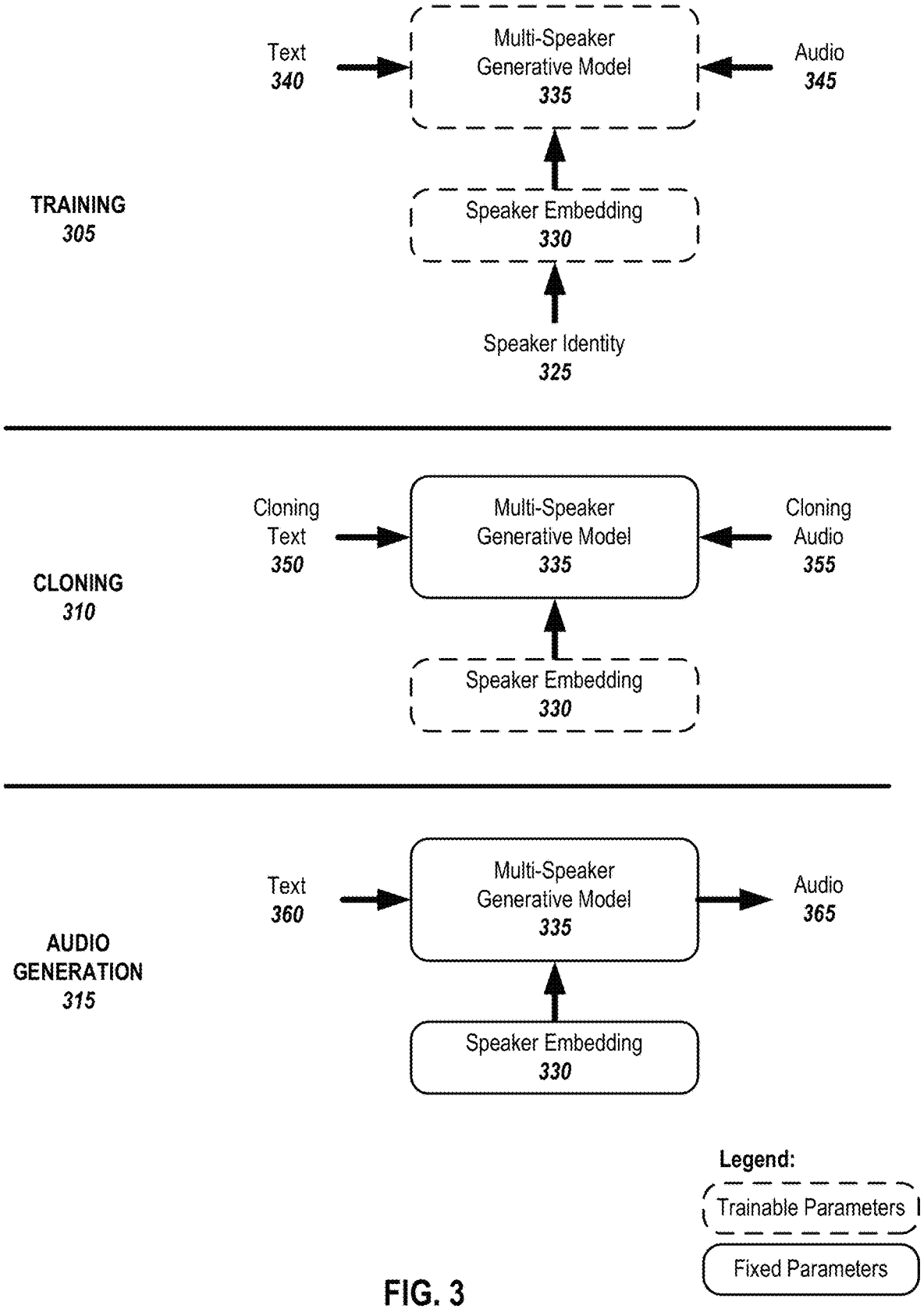
FIG. 3 graphically depicts a speaker adaptation encoding methodology for training, cloning, and audio generation, according to embodiments of the present disclosure.

FIG. 2 depicts a speaker adaptation methodology for generating audio with speaker characteristics from a limited set of audio samples, according to embodiments of the present disclosure. FIG. 3 graphically depicts a speaker adaptation encoding methodology for training, cloning, and audio generation, according to embodiments of the present disclosure.

In one or more embodiments, a multi-speaker generative model 335, which receives as inputs, for a speaker, a training set of text-audio pairs 340 and 345 and a corresponding speaker identifier 325, is trained (205/305). In one or more embodiments, the multi-speaker generative model may be a model as discussed in Section B, above, may be used. In one or more embodiments, the speaker embeddings are low dimension representations for speaker characteristics, which may be trained. In one or more embodiments, a speaker identity 325 to speaker embeddings 330 conversion may be done by a look-up table.

In one or more embodiments, the trained multi-speaker model parameters are fixed but the speaker encoding portion may be fine-tuned (210/310) using a set of text-audio pairs for a previously unseen (i.e., new) speaker. By fine-tuning the speaker embedding, an improved speaker embedding for this new speaker can be generated.

In one or more embodiments, for embedding-only adaptation, the following objective may be used:

$$\min_{e_{s_k}} \mathbb{E}_{(t_{k,j},a_{k,j})\sim\mathcal{T}_{s_k}} \{L(f(t_{k,j},s_k;\hat{W},e_{s_k}),a_{k,j})\} \tag{2}$$

where $\mathcal{T}_k$ is a set of text-audio pairs for the target speaker $s_k$.

Having fine-tuned the speaker embedding parameters to produce a speaker embedding 330 for the new speaker, a new audio 365 can be generated (215/315) for an input text 360, in which the generated audio has speaker characteristics of the previously unseen speaker based upon the speaker embedding.

b) Whole Model Fine-Tuning

Figure 4:
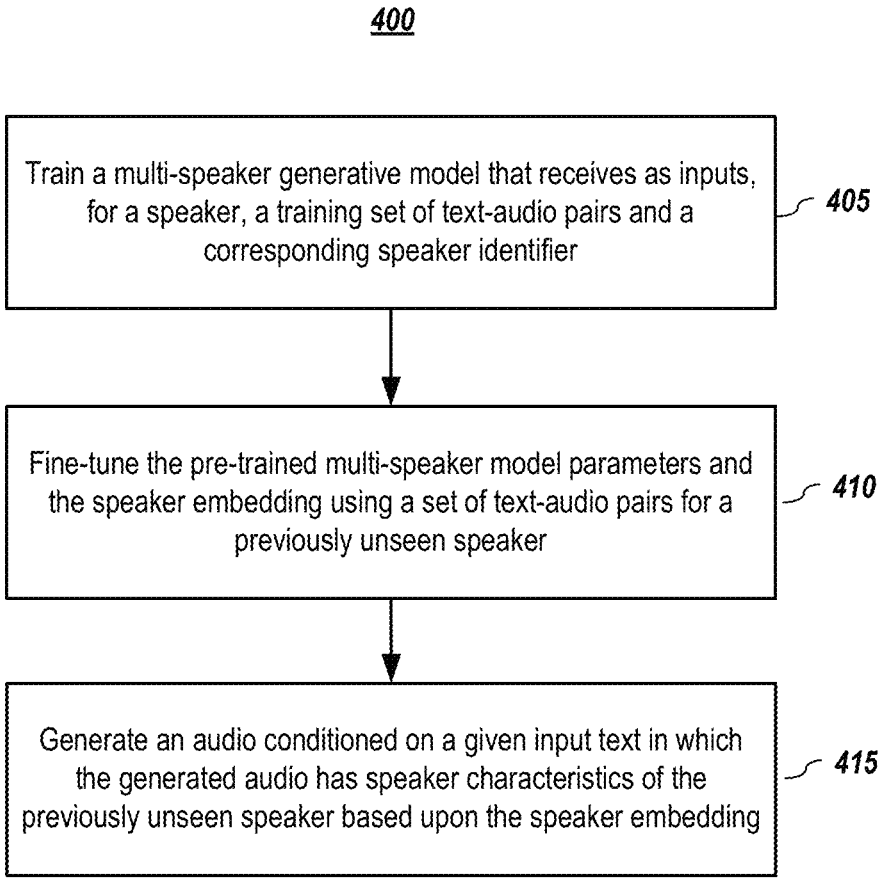
FIG. 4 depicts a speaker adaptation of the speaker embedding methodology for generating audio with speaker characteristics from a limited set of audio samples, according to embodiments of the present disclosure.
Figure 5:
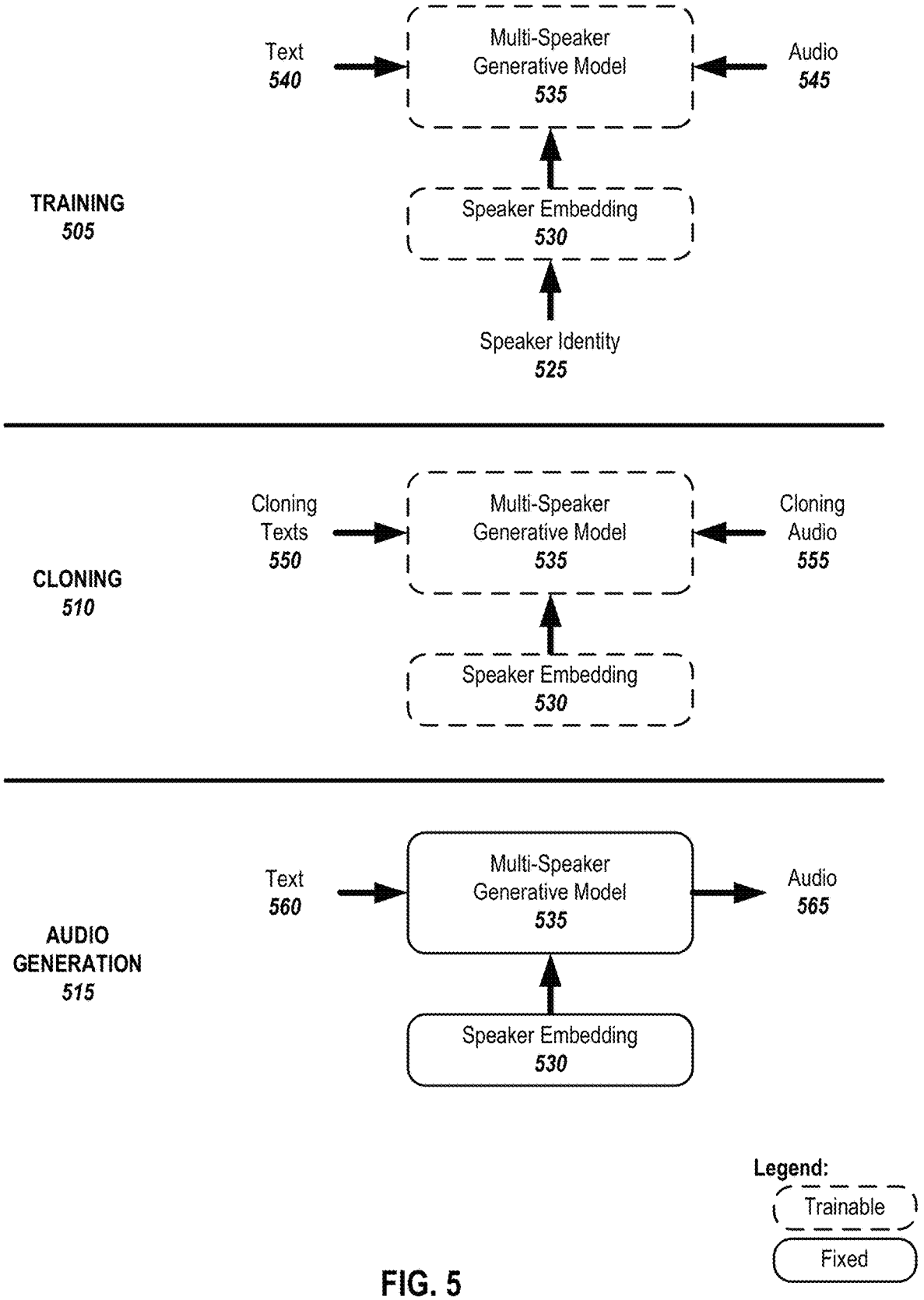
FIG. 5 graphically depicts a speaker adaptation of an entire model methodology for training, cloning, and audio generation, according to embodiments of the present disclosure.

FIG. 4 depicts a speaker adaptation methodology for generating audio with speaker characteristics from a limited set of audio samples, according to embodiments of the present disclosure. FIG. 5 graphically depicts a corresponding speaker adaptation encoding methodology for training, cloning, and audio generation, according to embodiments of the present disclosure.

In one or more embodiments, a multi-speaker generative model 535, which receives as inputs, for a speaker, a training set of text-audio pairs 540 and 545 and a corresponding speaker identifier 525 is trained (405/505).

Following this pre-training, in one or more embodiments, the pre-trained multi-speaker model parameters, including the speaker embedding parameters, may be fine-tuned (410/510) using a set of text-audio pairs 550 & 555 for a previously unseen speaker. Fine-tuning the entire multi-speaker generative model (including the speaker embedding parameters) allows for more degrees of freedom for speaker adaptation. For whole model adaptation, the following objective may be used:

$$\min_{W,e_{s_k}} \mathbb{E}_{(t_{k,j},a_{k,j})\sim\mathcal{T}_{s_k}} \{L(f(t_{k,j},s_k;W,e_{s_k}),a_{k,j})\} \tag{3}$$

In one or more embodiments, although the entire model provides more degrees of freedom for speaker adaptation, its optimization may be challenging, especially for a small number of cloning samples. While running the optimization, the number of iterations can be important for avoiding underfitting or overfitting.

Having fine-tuned the multi-speaker generative model 535 and produced a speaker embedding 530 for the new speaker based upon the set of one or more samples, a new audio 565 may be generated (415/515) for an input text 560, in which the generated audio has speaker characteristics of the previously unseen speaker based upon the speaker embedding.

2. Speaker Encoding

Presented herein are speaker encoding embodiment methods to directly estimate the speaker embedding from audio samples of an unseen speaker. As noted above, in one or more embodiments, the speaker embeddings may be low-dimension representations of speaker characteristics and may correspond or correlate to speaker identity representations. The training of the multi-speaker generative model and the speaker encoder model may be done in a number of ways, including jointly, separately, or separately with joint fine-tuning. Example embodiments of these training approaches are described in more detail below. In embodiments, such models do not require any fine-tuning during voice cloning. Thus, the same model may be used for all unseen speakers.

a) Joint Training

In one or more embodiments, the speaker encoding function, $g(\mathcal{A}_{s_k}; \Theta)$, takes a set of cloning audio samples $\mathcal{A}_{s_k}$ and estimates $e_{s_k}$. The function may be parametrized by $\Theta$. In one or more embodiments, the speaker encoder may be jointly trained with multi-speaker generative model from scratch, with a loss function defined for generated audio quality:

$$\min_{W,\Theta} \mathbb{E}_{\substack{s_i \sim S, \\ (t_{i,j}, a_{i,j}) \sim \mathcal{T}_{s_i}}} \{L(f(t_{i,j}, s_i; W, g(A_{s_i}; \Theta)), a_{i,j})\} \tag{4}$$

In one or more embodiments, the speaker encoder is trained with the speakers for the multi-speaker generative model. During training, a set of cloning audio samples $\mathcal{A}_{s_i}$ are randomly sampled for training speaker $s_i$. During inference, $\mathcal{A}_{s_k}$, audio samples from the target speaker $s_k$, is used to compute $g(\mathcal{A}_{s_k}; \Theta)$.

Figure 6:
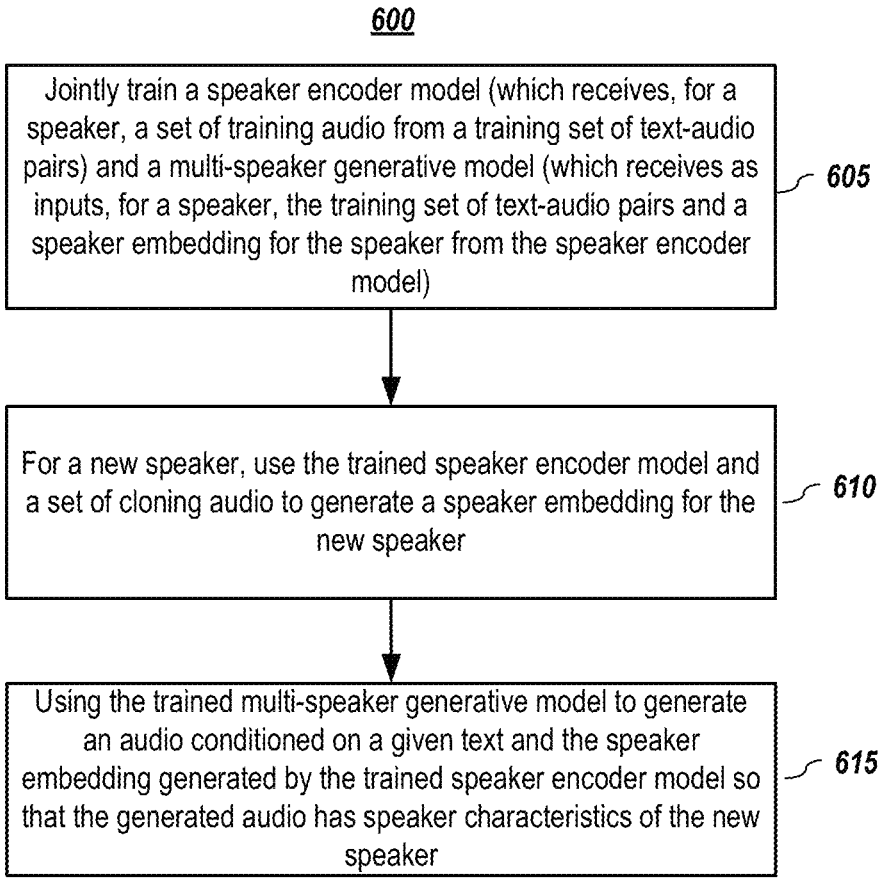
FIG. 6 depicts a speaker embedding methodology for jointly training a multi-speaker generative model and speaker encoding model and then generating audio with speaker characteristics for a speaker from a limited set of audio samples, according to embodiments of the present disclosure.
Figure 7:
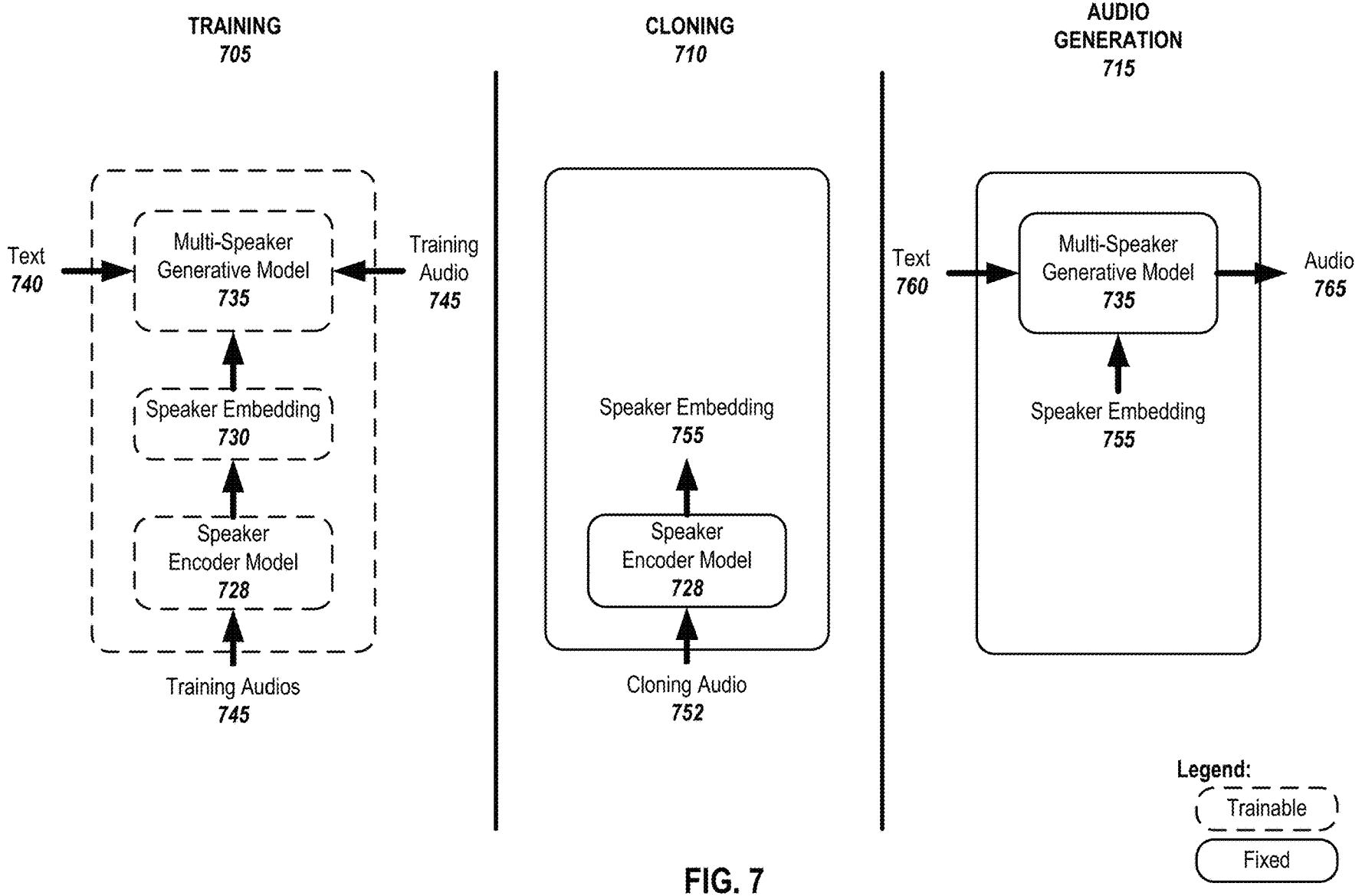
FIG. 7 graphically depicts a speaker embedding methodology for jointly training, cloning, and audio generation, according to embodiments of the present disclosure.

FIG. 6 depicts a speaker embedding methodology for jointly training a multi-speaker generative model and speaker encoding model and then generating audio with speaker characteristics for a speaker from a limited set of audio samples, according to embodiments of the present disclosure. FIG. 7 graphically depicts a corresponding speaker embedding methodology for jointly training, cloning, and audio generation, according to embodiments of the present disclosure.

As depicted in the embodiments illustrated in FIGS. 6 and 7, a speaker encoder model 728, which receives, for a speaker, a set of training audio 745 from a training set of text-audio pairs 740 & 745, and a multi-speaker generative model 735, which receives as inputs, for a speaker, the training set of text-audio pairs 740 & 745 and a speaker embedding 730 for the speaker from the speaker encoder model 728, are jointly trained (605/705). For a new speaker, the trained speaker encoder model 728 and a set of cloning audio 750 are used to generate (610/710) a speaker embedding 755 for the new speaker. Finally, as illustrated, the trained multi-speaker generative model 735 may be used to generate (615/715) a new audio 765 conditioned on a given text 760 and the speaker embedding 755 generated by the trained speaker encoder model 728 so that the generated audio 765 has speaker characteristics of the new speaker.

It should be noted, that in one or more embodiments, optimization challenges were observed when training in Eq. 4 was started from scratch. A major problem is fitting an average voice to minimize the overall generative loss, commonly referred as mode collapse in generative modeling literature. One idea to address mode collapse is to introduce discriminative loss functions for intermediate embeddings (e.g., using classification loss by mapping the embeddings to speaker class labels via a softmax layer), or generated audios (e.g., integrating a pre-trained speaker classifier to promote speaker difference of generated audios). In one or more embodiments, however, such approaches only slightly improved speaker differences. Another approach is to use a separate training procedure, examples of which are disclosed in the following sections.

b) Separately Train of Multi-Speaker Model and a Speaker Encoding Model

In one or more embodiments, a separate training procedure for a speaker encoder may be employed. In one or more embodiments, speaker embeddings $\hat{e}_{s_i}$ are extracted from a trained multi-speaker generative model $f(t_{i,j}, s_i; W, e_{s_i})$. Then, the speaker encoder model $g(\mathcal{A}_{s_k}; \Theta)$, may be trained to predict the embeddings from sampled cloning audios. There can be several objective functions for the corresponding regression problem. In embodiments, good results were obtained by simply using an L1 loss between the estimated and target embeddings:

$$\min_{\Theta} \mathbb{E}_{s_i \sim s}\{|g(A_{s_i}; \Theta) - \hat{e}_{s_i})|\} \tag{5}$$

Figure 8:
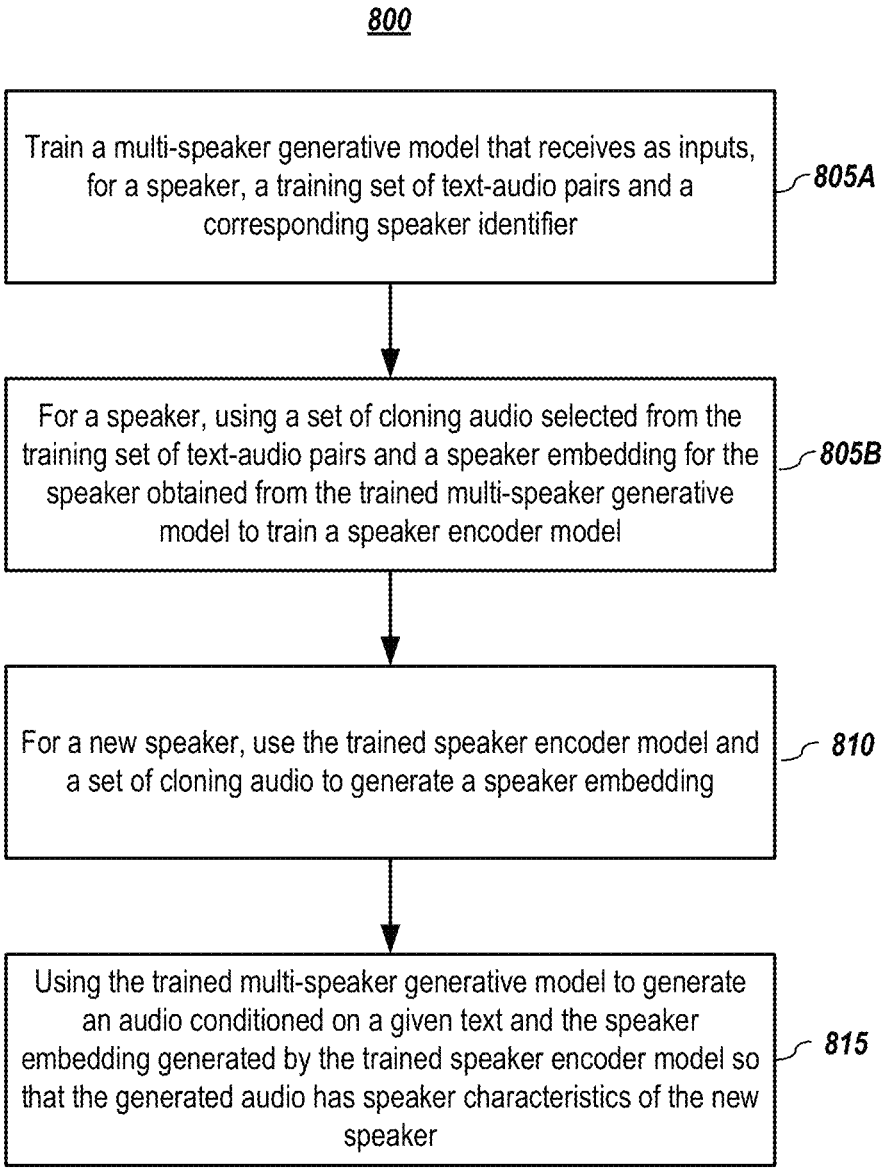
FIG. 8 depicts a speaker embedding methodology for separately training a multi-speaker generative model and a speaker encoder model and then generating audio with speaker characteristics for a speaker from a limited set of audio samples using the trained models, according to embodiments of the present disclosure.
Figure 9:
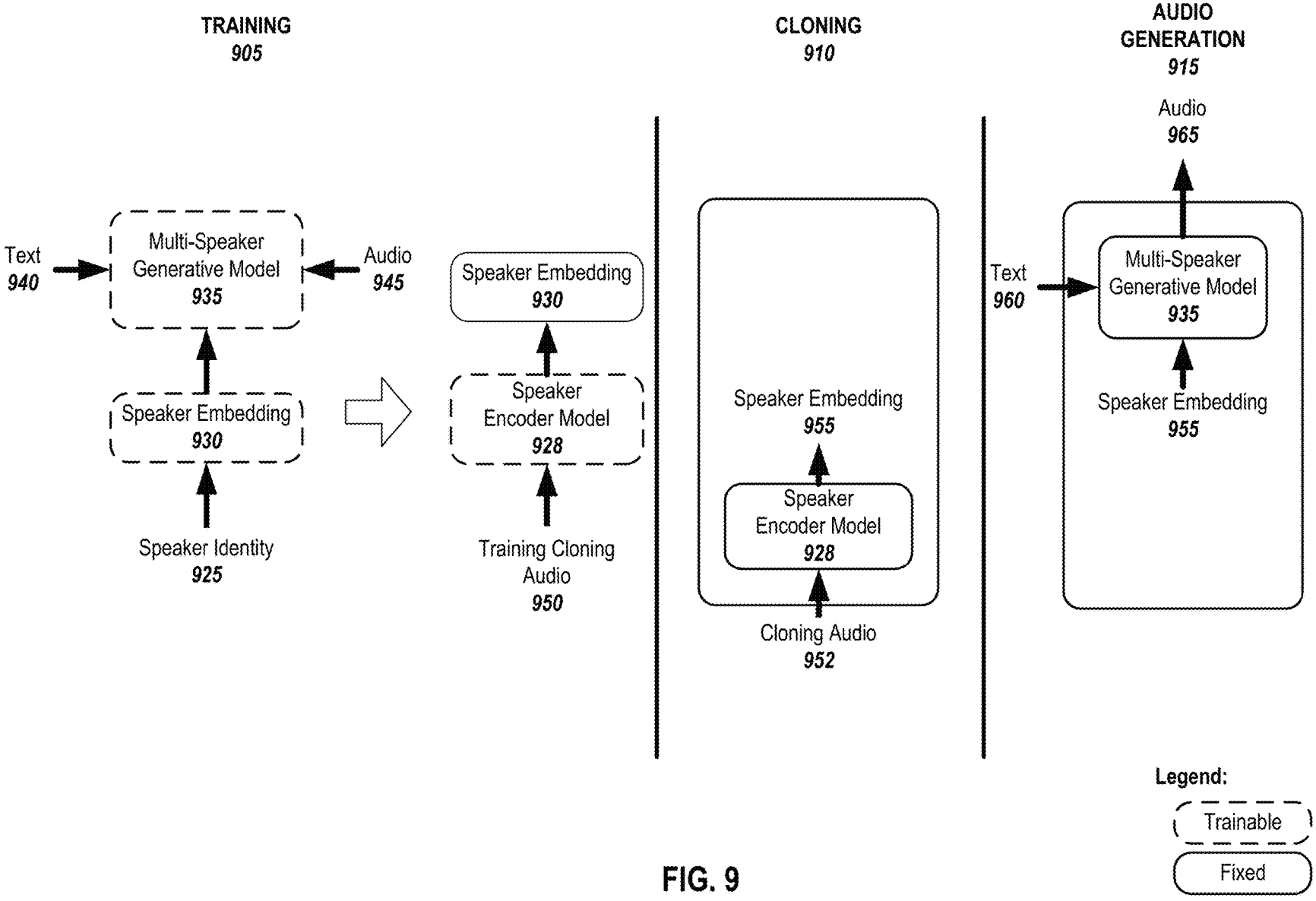
FIG. 9 graphically depicts a corresponding speaker embedding methodology for training, cloning, and audio generation, according to embodiments of the present disclosure.

FIG. 8 depicts a speaker embedding methodology for separately training a multi-speaker generative model and a speaker encoder model and then generating audio with speaker characteristics for a speaker from a limited set of audio samples using the trained models, according to embodiments of the present disclosure. FIG. 9 graphically depicts a corresponding speaker embedding methodology for training, cloning, and audio generation, according to embodiments of the present disclosure. As depicted in the embodiments illustrated in FIGS. 8 and 9, a multi-speaker generative model 935 that receives as inputs, for a speaker, a training set of text-audio pairs 940 & 945 and a corresponding speaker identifier 925 is trained (805A/905). The speaker embeddings 930 may be trained as part of the training of model 935.

A set of speaker cloning audios 950 and corresponding speaker embeddings obtained from the trained multi-speaker generative model 935 may be used to train (805B/905) a speaker encoder model 928. For example, returning to FIG. 8, for a speaker, a set of one or more cloning audios 950, which may be selected from the training set of text-audio pairs 940 & 945, and the corresponding speaker embedding(s) 930, which may be obtained from the trained multi-speaker generative model 935, may be used in training (805B/905) a speaker encoder model 928.

Figure 10:
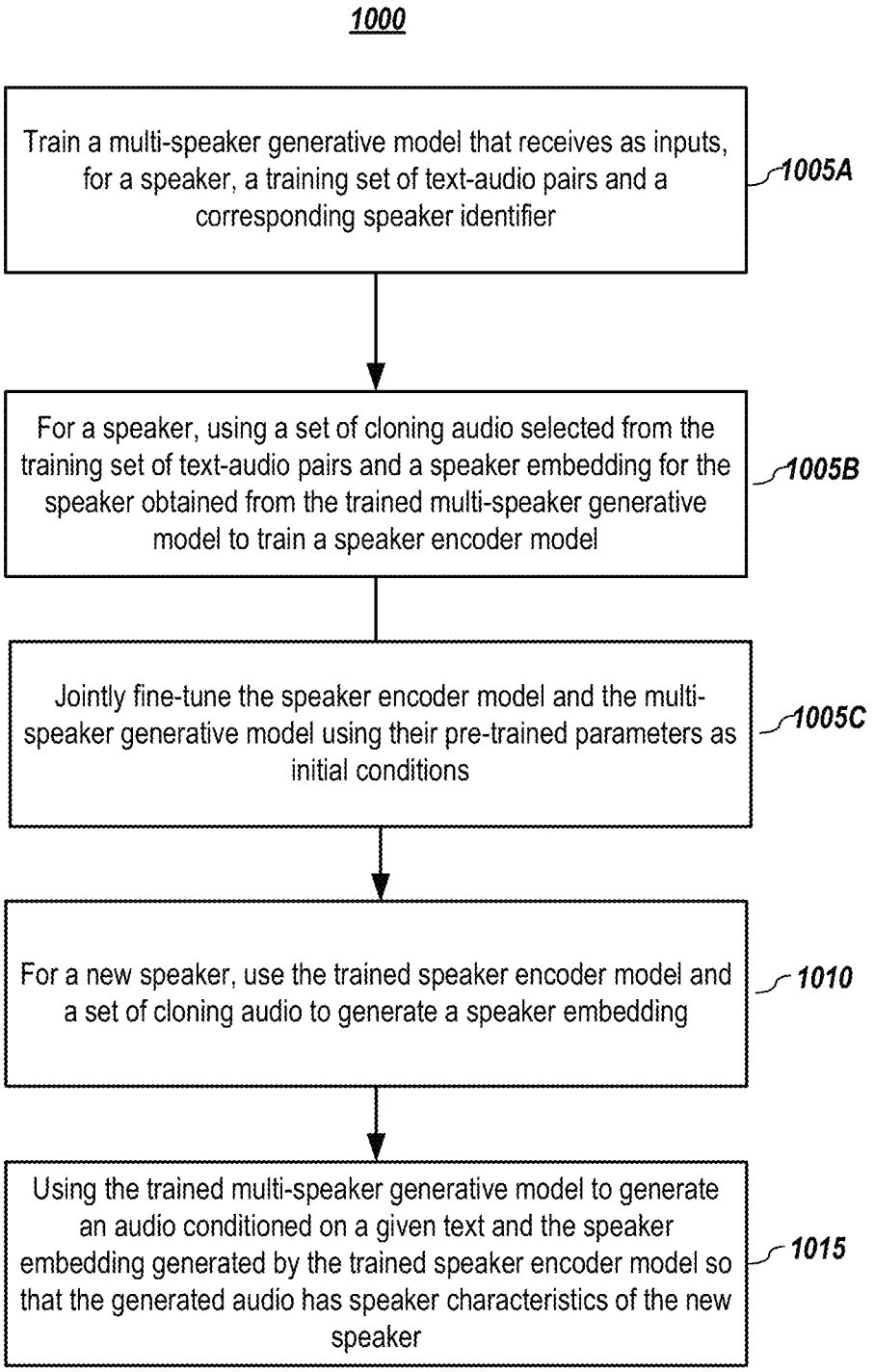
FIG. 10 depicts a speaker embedding methodology for separately training a multi-speaker generative model and a speaker encoder model but jointly fine-tuning the models and then generating audio with speaker characteristics for a speaker from a limited set of one or more audio samples using the trained models, according to embodiments of the present disclosure.
Figure 11A:
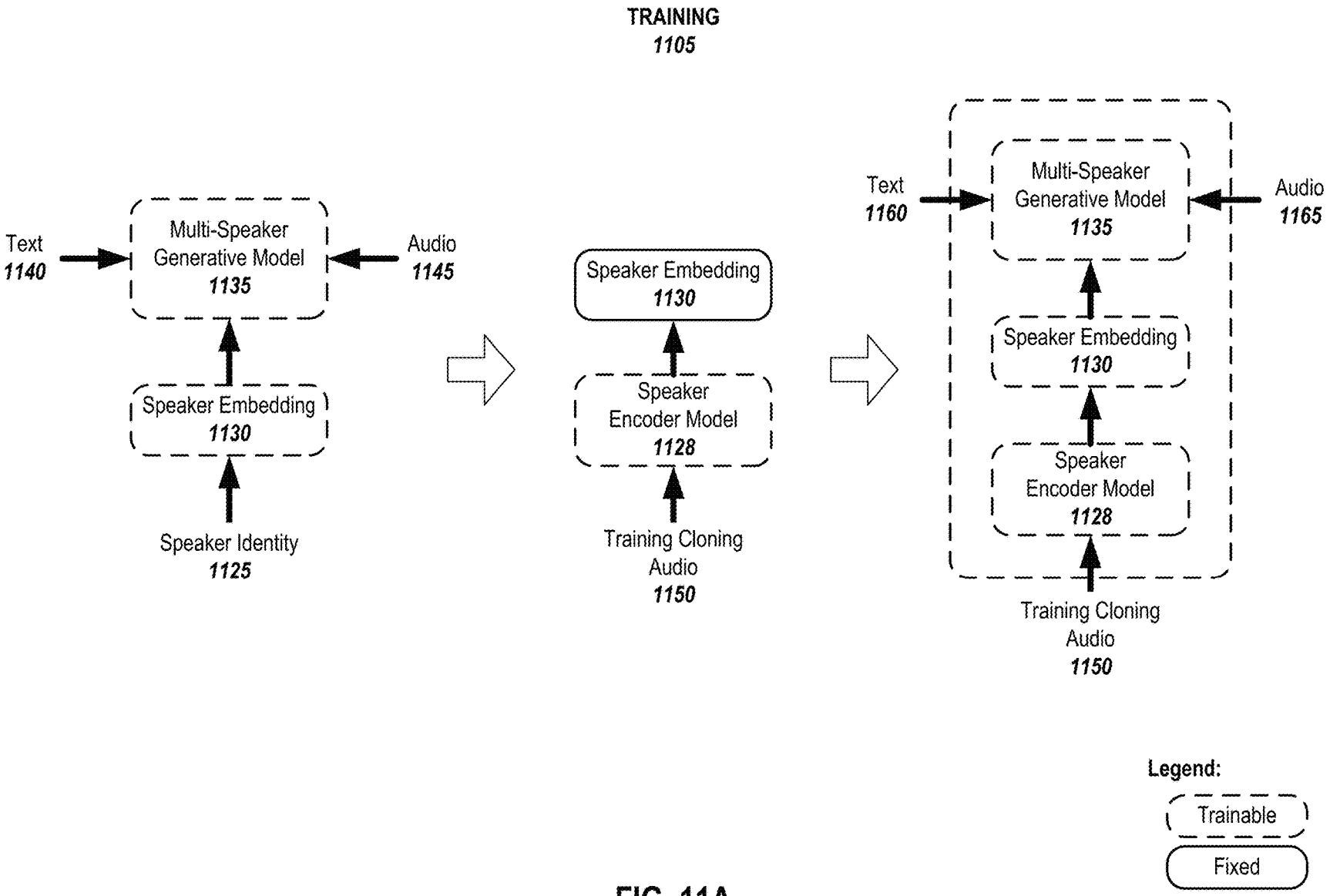
FIGS. 11A and 11B graphically depict a speaker embedding methodology for training, cloning, and audio generation, according to embodiments of the present disclosure.
Figure 11A:
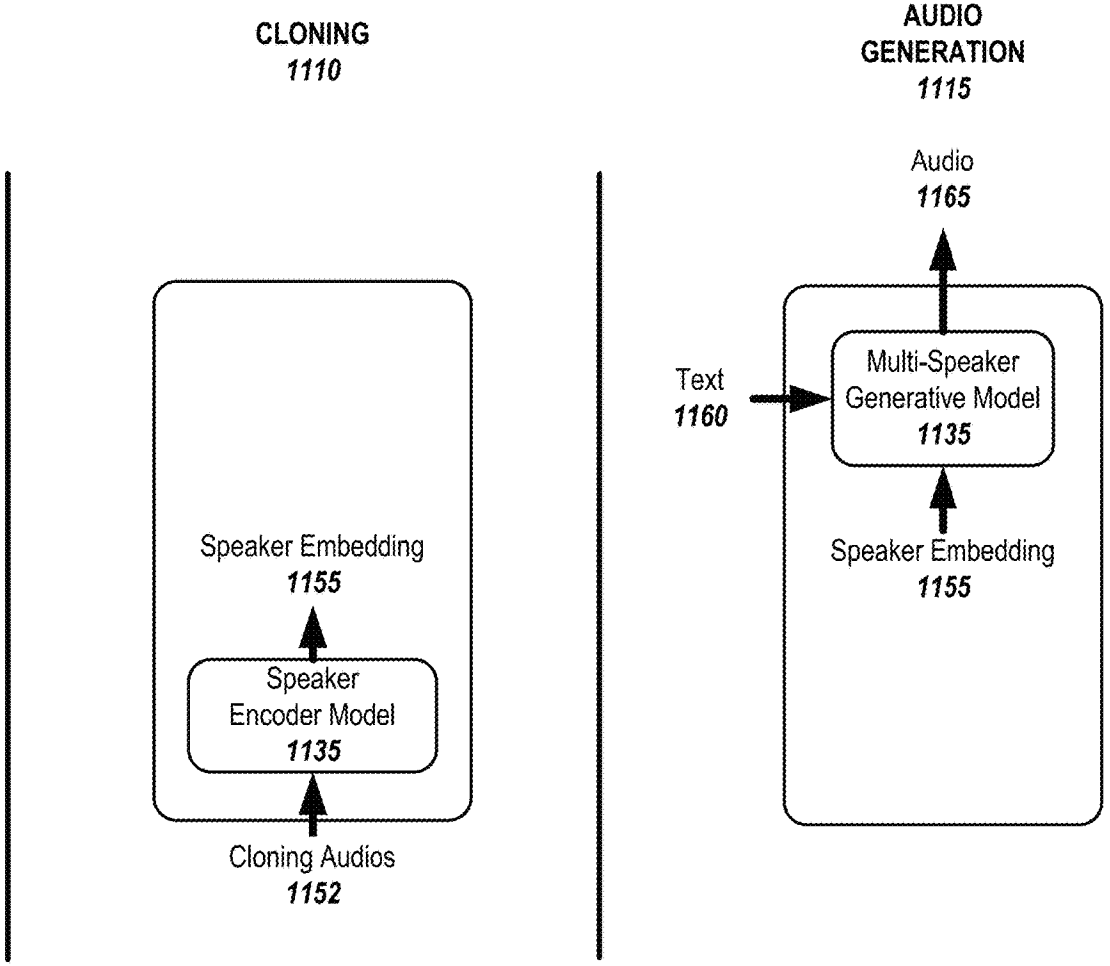
Figure 11B:
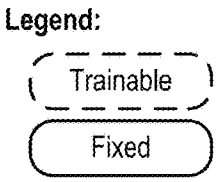

Having trained the speaker encoder model 928, for a new speaker, the trained speaker encoder model 928 and a set of one or more cloning audios may be used to generate a speaker embedding 955 for the new speaker that was not seen during the training phase (805/905). In one or more embodiments, the trained multi-speaker generative model 935 uses the speaker embedding 955 generated by the trained speaker encoder model 928 to generate an audio 965 conditioned on a given input text 960 so that the generated audio has speaker characteristics of the new speaker.

c) Separate Training of Multi-Speaker Model and a Speaker Encoding Model with Joint Fine-Tuning In one or more embodiments, the training concepts for the prior approaches may be combined. For example, FIG. 10 depicts a speaker embedding methodology for separately training a multi-speaker generative model and a speaker encoder model but jointly fine-tuning the models and then generating audio with speaker characteristics for a speaker from a limited set of one or more audio samples using the trained models, according to embodiments of the present disclosure. FIGS. 11A and 11B graphically depict a corresponding speaker embedding methodology for training, cloning, and audio generation, according to embodiments of the present disclosure.

As depicted in the embodiment illustrated in FIGS. 10, 11A, and 11B, a multi-speaker generative model 1135 that receives as inputs, for a speaker, a training set of text-audio pairs 1140 & 1145 and a corresponding speaker identifier 1125 is trained (1005A/1105). In one or more embodiments, the speaker embeddings 1130 may be trained as part of the training of the model 1135.

A set of speakers cloning audios 1150 and corresponding speaker embeddings obtained from the trained multi-speaker generative model 1135 may be used to train (1005B/1105) a speaker encoder model 1128. For example, returning to FIG. 10, for a speaker, a set of one or more cloning audios 1150, which may be selected from the training set of text-audio pairs 1140 & 1145, and the corresponding speaker embedding(s) 1130, which may be obtained from the trained multi-speaker generative model 1135, may be used in training (1005B/1105) a speaker encoder model 1128.

Then, in one or more embodiments, the speaker encoder model 1128 and the multi-speaker generative model 1135 may be jointly fine-tuned (1005C/1105) using their pre-trained parameters as initial conditions. In one or more embodiments, the entire model (i.e., the speaker encoder model 1128 and the multi-speaker generative model 1135) may be jointly fine-tuned based on the objective function Eq. 4, using pre-trained $\hat{W}$ and pretrained $\hat{\Theta}$ as the initial point. Fine-tuning enables the generative model to learn how to compensate the errors of embedding estimation and yields less attention problems. However, generative loss may still dominate learning, and speaker differences in generated audios may be slightly reduced (see Section C.3 for details).

In one or more embodiments, having trained and fine-tuned the multi-speaker generative model 1135 and the speaker encoder model 1128, the trained speaker encoder model 1128 and a set of one or more cloning audios for a new speaker may be used to generate a speaker embedding 1155 for the new speaker that was not seen during the training phase (1005/1105). In one or more embodiments, the trained multi-speaker generative model 1135 uses the speaker embedding 1155 generated by the trained speaker encoder model 1128 to generate a synthesized audio 1165 conditioned on a given input text 1160 so that the generated audio 1165 has speaker characteristics of the new speaker.

d) Speaker Encoder Embodiments

Figure 12:
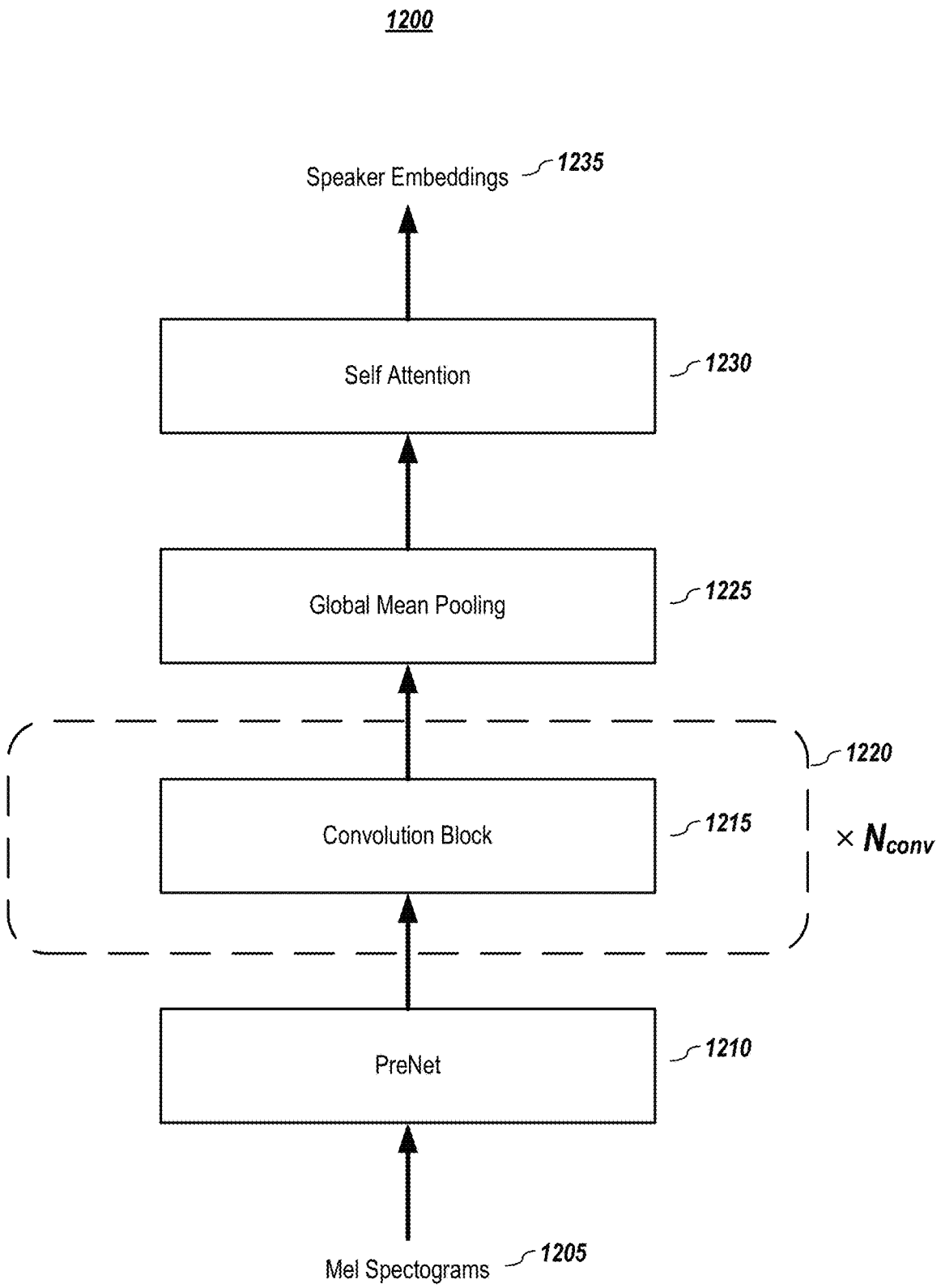
FIG. 12 graphically illustrates a speaker encoder architecture, according to embodiments of the present disclosure.

In one or more embodiments, for speaker encoder $g(\mathcal{A}_{s_k}; \Theta)$, a neural network architecture comprising three parts (e.g., an embodiment is shown in FIG. 12):

(i) Spectral processing: In one or more embodiments, mel-spectrograms 1205 for cloning audio samples are computed and passed to a PreNet 1210, which contains fully-connected (FC) layers with exponential linear unit (ELU) for feature transformation.

(ii) Temporal processing: In one or more embodiments, temporal contexts are incorporated using several convolutional layers 1220 with gated linear unit and residual connections. Then, average pooling may be applied to summarize the whole utterance.

(iii) Cloning sample attention: Considering that different cloning audios contain different amount of speaker information, in one or more embodiments, a multi-head self-attention mechanism 1230 may be used to compute the weights for different audios and get aggregated embeddings.

Figure 13:
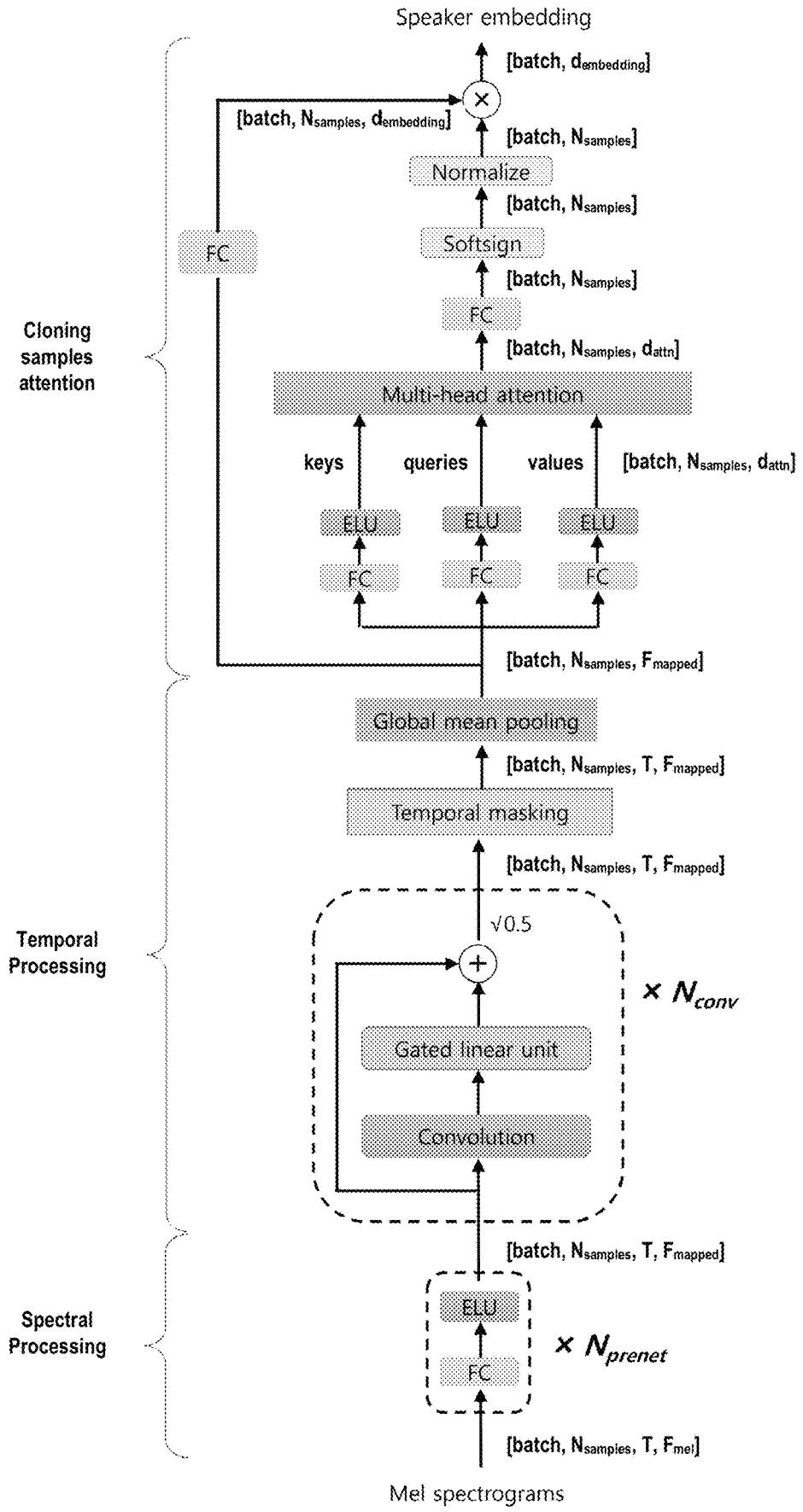
FIG. 13 graphically illustrates a more detailed embodiment of a speaker encoder architecture with intermediate state dimensions, according to embodiments of the present disclosure.

FIG. 13 depicts a more detail view of a speaker encoder architecture with intermediate state dimensions (batch: batch size, $N_{samples}$: number of cloning audio samples $|\mathcal{A}_{s_k}|$, T: number of mel spectrograms timeframes, $F_{mel}$: number of mel frequency channels, $F_{mapped}$: number of frequency channels after prenet, $d_{embedding}$: speaker embedding dimension), according to embodiments of the present disclosure. In the depicted embodiment, multiplication operation at the last layer represents inner product along the dimension of cloning samples.

3. Discriminative Model Embodiments for Evaluation

Voice cloning performance metrics can be based on human evaluations through crowdsourcing platforms, but they tend to be slow and expensive during model development. Instead, two evaluation methods using discriminative models, presented herein, were used.

a) Speaker Classification

Speaker classifier determines which speaker an audio sample belongs to. For voice cloning evaluation, a speaker classifier can be trained on the set of target speakers used for cloning. High-quality voice cloning would result in high speaker classification accuracy. A speaker classifier with similar spectral and temporal processing layers shown in FIG. 13 and an additional embedding layer before the softmax function may be used.

b) Speaker Verification

Speaker verification is the task of authenticating the claimed identity of a speaker, based on a test audio and enrolled audios from the speaker. In particular, it performs binary classification to identify whether the test audio and enrolled audios are from the same speaker. In one or more embodiments, an end-to-end text-independent speaker verification model may be used. The speaker verification model may be trained on a multi-speaker dataset, then may directly test whether the cloned audio and the ground truth audio are from the same speaker. Unlike the speaker classification approach, a speaker verification model embodiment does not require training with the audios from the target speaker for cloning, hence it can be used for unseen speakers with a few samples. As the quantitative performance metric, the equal error-rate (EER) may be used to measure how close the cloned audios are to the ground truth audios. It should be noted that, in one or more embodiments, the decision threshold may be changed to trade-off between false acceptance rate and false rejection rate. The equal error-rate refers to the point when the two rates are equal.

Speaker Verification Model Embodiments.

Given a set of (e.g., 1~5) enrollment audios (enrollment audios are from the same speaker) and a test audio, a speaker verification model performs a binary classification and tells whether the enrollment and test audios are from the same speaker. Although using other speaker verification models would suffice, speaker verification model embodiments may be created using convolutional-recurrent architecture, such as that described in commonly-assigned: U.S. Prov. Pat. App. Ser. No. 62/260,206, filed on 25 Nov. 2015, entitled "DEEP SPEECH 2: END-TO-END SPEECH RECOGNITION IN ENGLISH AND MANDARIN"; U.S. patent application Ser. No. 15/358,120, filed on 21 Nov. 2016, entitled "END-TO-END SPEECH RECOGNITION"; and U.S. patent application Ser. No. 15/358,083, filed on 21 Nov. 2016, entitled "DEPLOYED END-TO-END SPEECH RECOGNITION", each of the aforementioned patent documents is incorporated by reference herein in its entirety and for all purposes. It should be noted that the equal-error-rate results on test set of unseen speakers are on par with the state-of-the-art speaker verification models.

Figure 14:
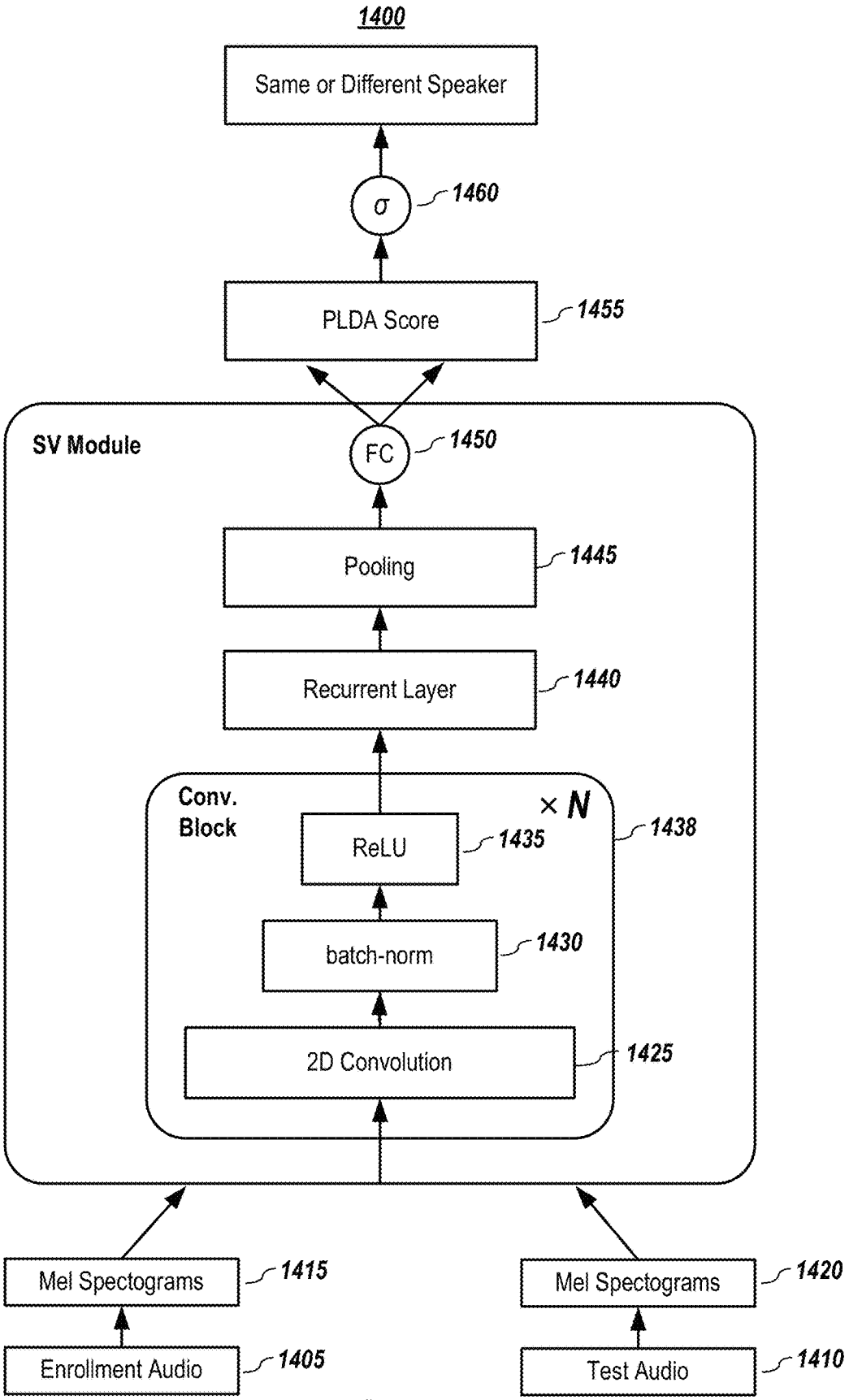
FIG. 14 graphically depicts a speaker verification model architecture, according to embodiments of the present disclosure.

FIG. 14 graphically depicts a model architecture, according to embodiments of the present disclosure. In one or more embodiments, mel-scaled spectrograms 1415, 1420 of enrollment audio 1405 and test audio 1410 are computed after resampling the input to a constant sampling frequency. Then, a two-dimensional convolutional layers 1425 convolving over both time and frequency bands are applied, with batch normalization 1430 and rectified linear unit (ReLU) non-linearity 1435 after each convolution layer. The output of last convolution block 1438 is feed into a recurrent layer (e.g., gated recurrent unit (GRU)) 1440. Mean-pool 1445 is performed over time (and enrollment audios if there are many), then a fully connected layer 1450 is applied to obtain the speaker encodings for both enrollment audios and test audio. A probabilistic linear discriminant analysis (PLDA) 1455 may be used for scoring the similarity between the two encodings. The PLDA score may be defined as:

$$s(x,y)=w\cdot x^{\tau}y-x^{\tau}Sx-y^{\tau}Sy+b \quad (6)$$

where x and y are speaker encodings of enrollment and test audios (respectively) after fully-connected layer, w and b are scalar parameters, and S is a symmetric matrix. Then, s(x, y) may be fed into a sigmoid unit 1460 to obtain the probability that they are from the same speaker. The model may be trained using cross-entropy loss. Table 1 lists hyper-parameters of speaker verification model for LibriSpeech dataset, according to embodiments of the present disclosure.

TABLE 1

Hyperparameters of speaker verification model for LibriSpeech dataset.

| Parameter | |
|---|---|
| Audio resampling freq. | 16 KHz |
| Bands of Mel-spectrogram | 80 |
| Hop length | 400 |
| Convolution layers, channels, filter, strides | 1, 64, 20 × 5, 8, × 2 |
| Recurrent layer size | 128 |
| Fully connected size | 128 |
| Dropout probability | 0.9 |
| Learning Rate | $10^{-3}$ |
| Max gradient norm | 100 |
| Gradient clipping max. value | 5 |

Figure 15:
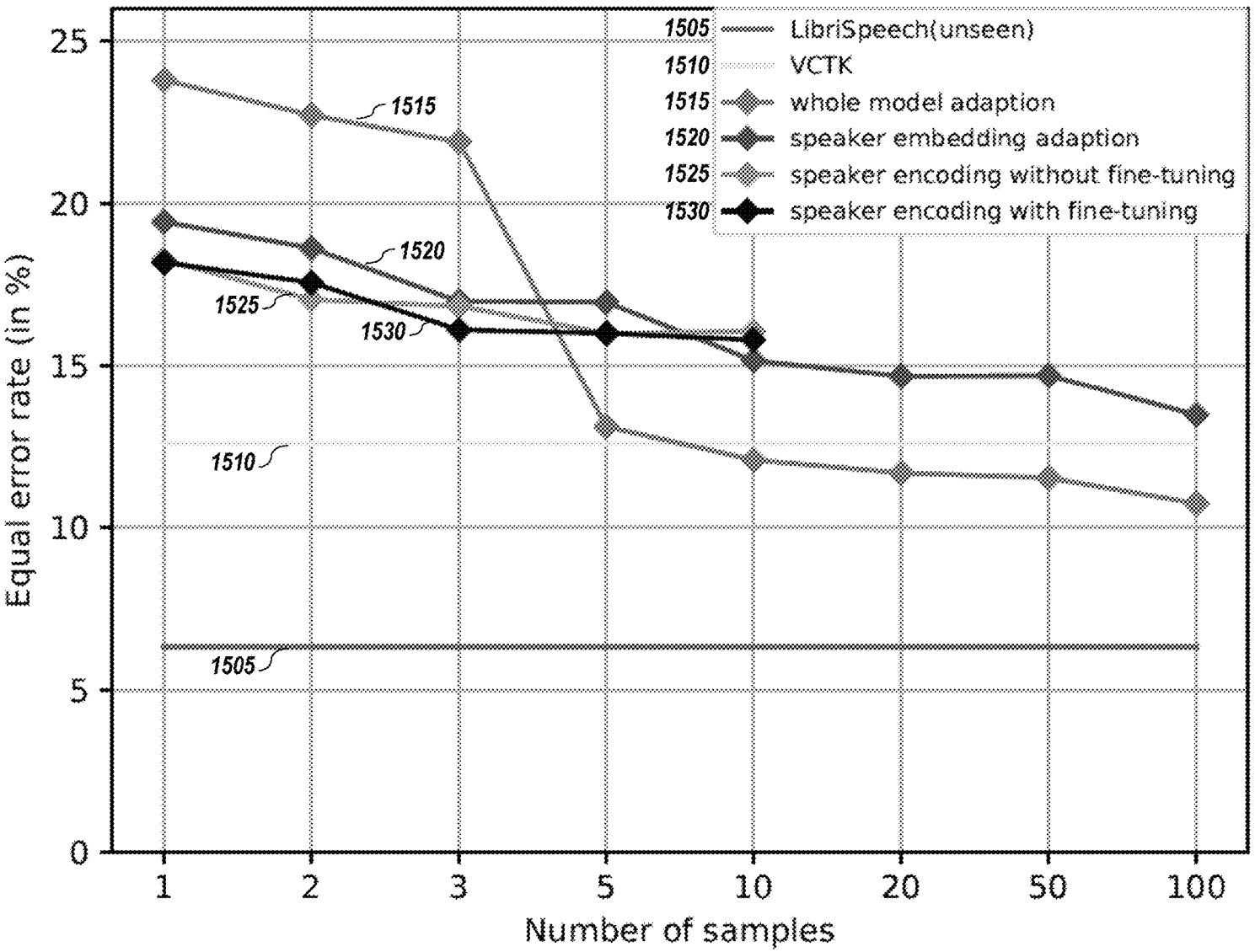
FIG. 15 depicts speaker verification equal error rate (EER) (using 1 enrollment audio) vs. number of cloning audio samples, according to embodiments of the present disclosure. The multi-speaker generative model and the speaker verification model were trained using the LibriSpeech dataset. Voice cloning was performed using the VCTK dataset.

In addition to speaker verification test results presented herein (see FIG. 21), also included are the result using 1 enrollment audio when the multi-speaker generative model was trained on LibriSpeech. FIG. 15 depicts speaker verification equal error rate (EER) (using 1 enrollment audio) vs. number of cloning audio samples, according to embodiments of the present disclosure. The multi-speaker generative model and the speaker verification model were trained using the LibriSpeech dataset.

Voice cloning was performed using the VCTK dataset. When multi-speaker generative model was trained on VCTK, the results are in FIGS. 16A and 16B. It should be noted that, the EER on cloned audios could be potentially better than on ground truth VCTK, because the speaker verification model is trained on LibriSpeech dataset.

Figure 16A:
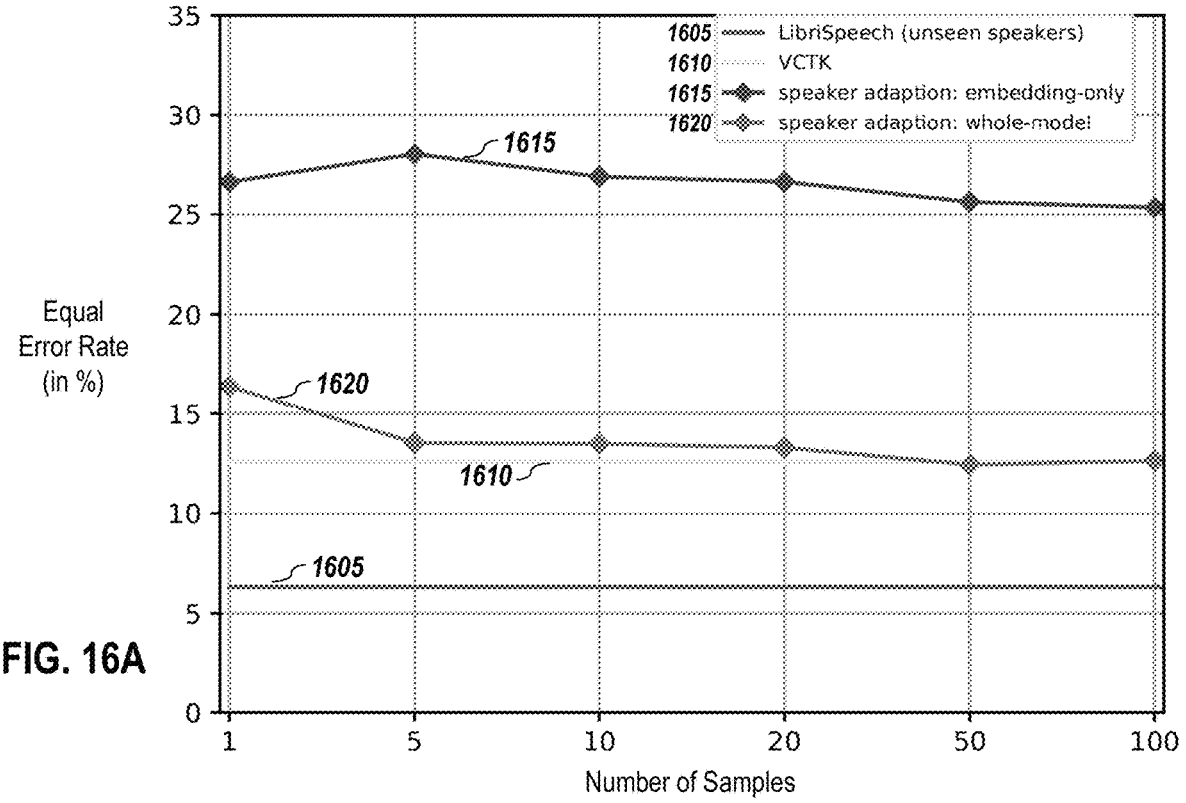
FIG. 16A depicts speaker verification equal error rate (EER) using 1 enrollment audio vs. number of cloning audio samples, according to embodiments of the present disclosure.
Figure 16B:
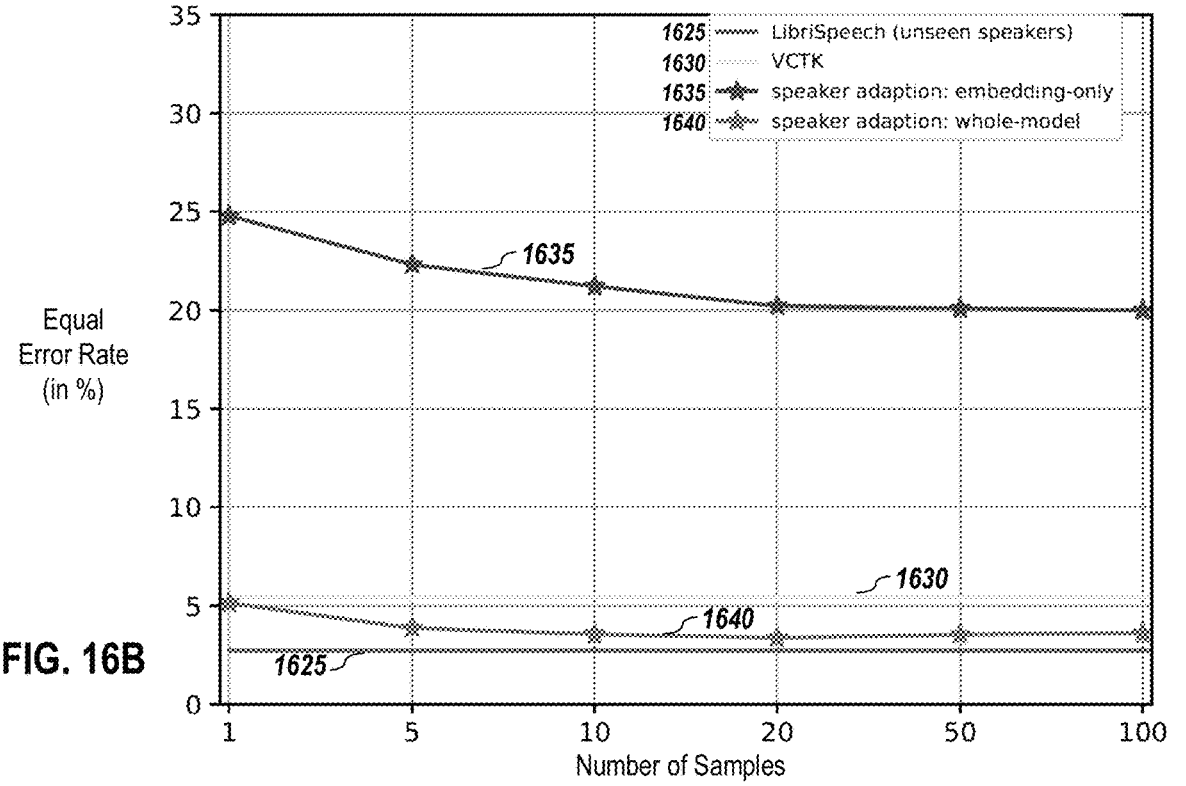
FIG. 16B depicts speaker verification equal error rate (EER) using 5 enrollment audios vs. number of cloning audio samples, according to embodiments of the present disclosure.

FIG. 16A depicts speaker verification equal error rate (EER) using 1 enrollment audio vs. number of cloning audio samples, according to embodiments of the present disclosure. FIG. 16B depicts speaker verification equal error rate (EER) using 5 enrollment audios vs. number of cloning audio samples, according to embodiments of the present disclosure. The multi-speaker generative model was trained on a subset of VCTK dataset including 84 speakers, and voice cloning was performed on other 16 speakers. The speaker verification model was trained using the LibriSpeech dataset.

C. Experiments

It shall be noted that these experiments and results are provided by way of illustration and were performed under specific conditions using a specific embodiment or embodiments; accordingly, neither these experiments nor their results shall be used to limit the scope of the disclosure of the current patent document.

Embodiments of two approaches for voice cloning were compared. For speaker adaptation approach, a multi-speaker generative model was trained and adapted to a target speaker by fine-tuning the embedding or the whole model. For speaker encoding approach, a speaker encoder was trained, and it was evaluated with and without joint fine-tuning.

1. Datasets

In the first set of experiments (Sections C.3 and C.4), a multispeaker generative model embodiment and a speaker encoder model embodiment were trained using the LibriSpeech dataset, which contains audio for 2484 speakers sampled at 16 KHz, totaling 820 hours. LibriSpeech is a dataset for automatic speech recognition, and its audio quality is lower compared to speech synthesis datasets. In embodiments, a segmentation and denoising pipeline, as described in commonly-assigned U.S. Prov. Pat. App. No. 62/574,382 and U.S. patent application Ser. No. 16/058,265 (which have been incorporated by reference herein in their entireties and for all purposes), was designed and employed to process LibriSpeech. Voice cloning was performed using the VCTK dataset. VCTK consists of audios for 108 native speakers of English with various accents sampled at 48 KHz. To be consistent with LibriSpeech dataset, VCTK audio samples were downsampled to 16 KHz. For a chosen speaker, a few cloning audios were sampled randomly for each experiment. The test sentences presented in the next paragraph were used to generate audios for evaluation.

Test Sentences (The sentences, below, were used to generate test samples for the voice cloning model embodiments. The white space characters, /, and % indicate the duration of pauses inserted by the speaker between words. Four different word separators were used, indicating: (i) slurred-together words, (ii) standard pronunciation and space characters, (iii) a short pause between words, and (iv) a long pause between words. For example, the sentence "Either way, you should shoot very slowly," with a long pause after "way" and a short pause after "shoot", would be written as "Either way % you should shoot/very slowly %." with % representing a long pause and/representing a short pause for encoding convenience.):

Prosecutors have opened a massive investigation/into allegations of/fixing games/and illegal betting %.

Different telescope designs/perform differently % and have different strengths/and weaknesses %.

We can continue to strengthen the education of good lawyers %.

Feedback must be timely/and accurate/throughout the project %.

Humans also judge distance/by using the relative sizes of objects %.

Churches should not encourage it % or make it look harmless %.

Learn about/setting up/wireless network configuration %.

You can eat them fresh cooked % or fermented %.

If this is true % then those/who tend to think creatively % really are somehow different %.

She will likely jump for joy % and want to skip straight to the honeymoon %.

The sugar syrup/should create very fine strands of sugar % that drape over the handles %.

But really in the grand scheme of things % this information is insignificant %.

I let the positive/overrule the negative %.

He wiped his brow/with his forearm %.

Instead of fixing it % they give it a nickname %.

About half the people % who are infected % also lose weight %.

The second half of the book % focuses on argument/and essay writing %.

We have the means/to help ourselves %.

The large items/are put into containers/for disposal %.

He loves to/watch me/drink this stuff %.

Still % it is an odd fashion choice %.

Funding is always an issue/after the fact %.

Let us/encourage each other %.

In a second set of experiments (Section C.5), the impact of the training dataset was investigated. The VCTK dataset was used—84 speakers were used for training of the multi-speaker generative model, 8 speakers for validation, and 16 speakers for cloning.

2. Model Embodiments Specifications a) Multi-Speaker Generative Model Embodiments The tested multi-speaker generative model embodiment was based on the convolutional sequence-to-sequence architecture disclosed in commonly-assigned U.S. Prov. Pat. App. No. 62/574,382 and U.S. patent application Ser. No. 16/058,265 (which have been incorporated by reference herein in their entireties and for all purposes), with the same or similar hyperparameters and Griffin-Lim vocoder. To get better performance, the time-resolution was increased by reducing the hop length and window size parameters to 300 and 1200, and a quadratic loss term was added to penalize larger amplitude components superlinearly. For speaker adaptation experiments, the embedding dimensionality was reduced to 128, as it yields less overfitting problems. Overall, the baseline multi-speaker generative model embodiment had around 25M trainable parameters when trained for the LibriSpeech dataset. For the second set of experiments, hyperparameters of the VCTK model in commonly-assigned U.S. Prov. Pat. App. No. 62/574,382 and U.S. patent application Ser. No. 16/058,265 (referenced above and incorporated by reference herein) were used to train a multi-speaker model for the 84 speakers of VTCK, with Griffin-Lim vocoder.

b) Speaker Adaptation

For speaker adaptation approach, either the entire multi-speaker generative model parameters or only its speaker embeddings were fine-tuned. For both cases, optimization was separately applied for each of the speakers.

c) Speaker Encoder Model

Figure 17:
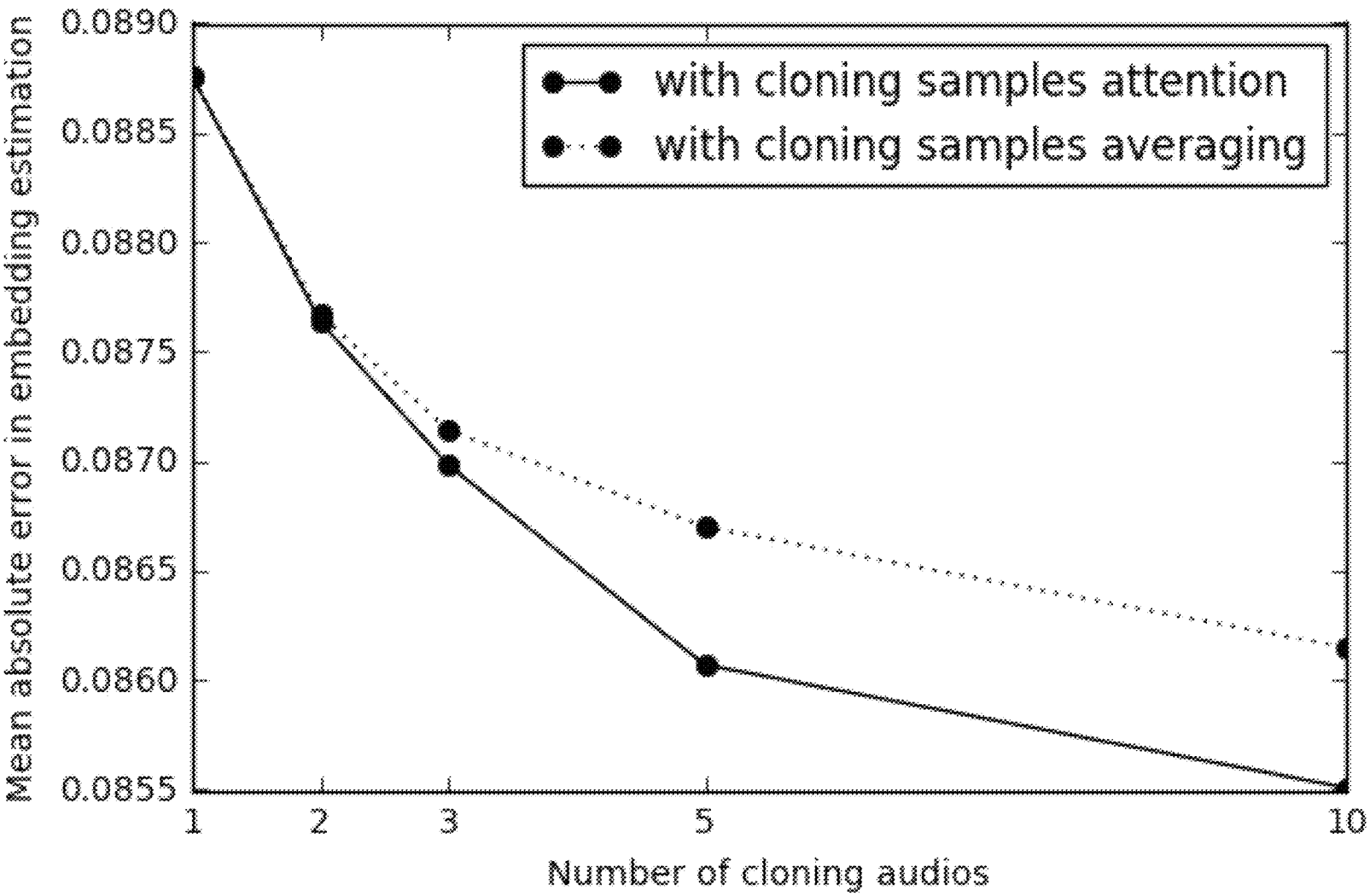
FIG. 17 depicts the mean absolute error in embedding estimation vs. the number of cloning audios for a validation set of 25 speakers, shown with the attention mechanism and without attention mechanism (by simply averaging), according to embodiments of the present disclosure.

In one or more embodiments, speaker encoders were trained for different number of cloning audios separately, to obtain the minimum validation loss. Initially, cloning audios were converted to log-mel spectrograms with 80 frequency bands, with a hop length of 400, a window size of 1600. Log-mel spectrograms were fed to spectral processing layers, which comprised 2-layer prenet of size 128. Then, temporal processing was applied with two 1-dimensional convolutional layers with a filter width of 12. Finally, multi-head attention was applied with 2 heads and a unit size of 128 for keys, queries, and values. The final embedding size was 512. To construct a validation set, 25 speakers were held out from the training set. A batch size of 64 was used while training, with an initial learning rate of 0.0006 with annealing rate of 0.6 applied every 8000 iterations. Mean absolute error for the validation set is shown in FIG. 17. FIG. 17 depicts the mean absolute error in embedding estimation vs. the number of cloning audios for a validation set of 25 speakers, shown with the attention mechanism and without attention mechanism (by simply averaging), according to embodiments of the present disclosure. More cloning audios tend to lead to more accurate speaker embedding estimation, especially with the attention mechanism.

Some Implications of Attention.

Figure 18:
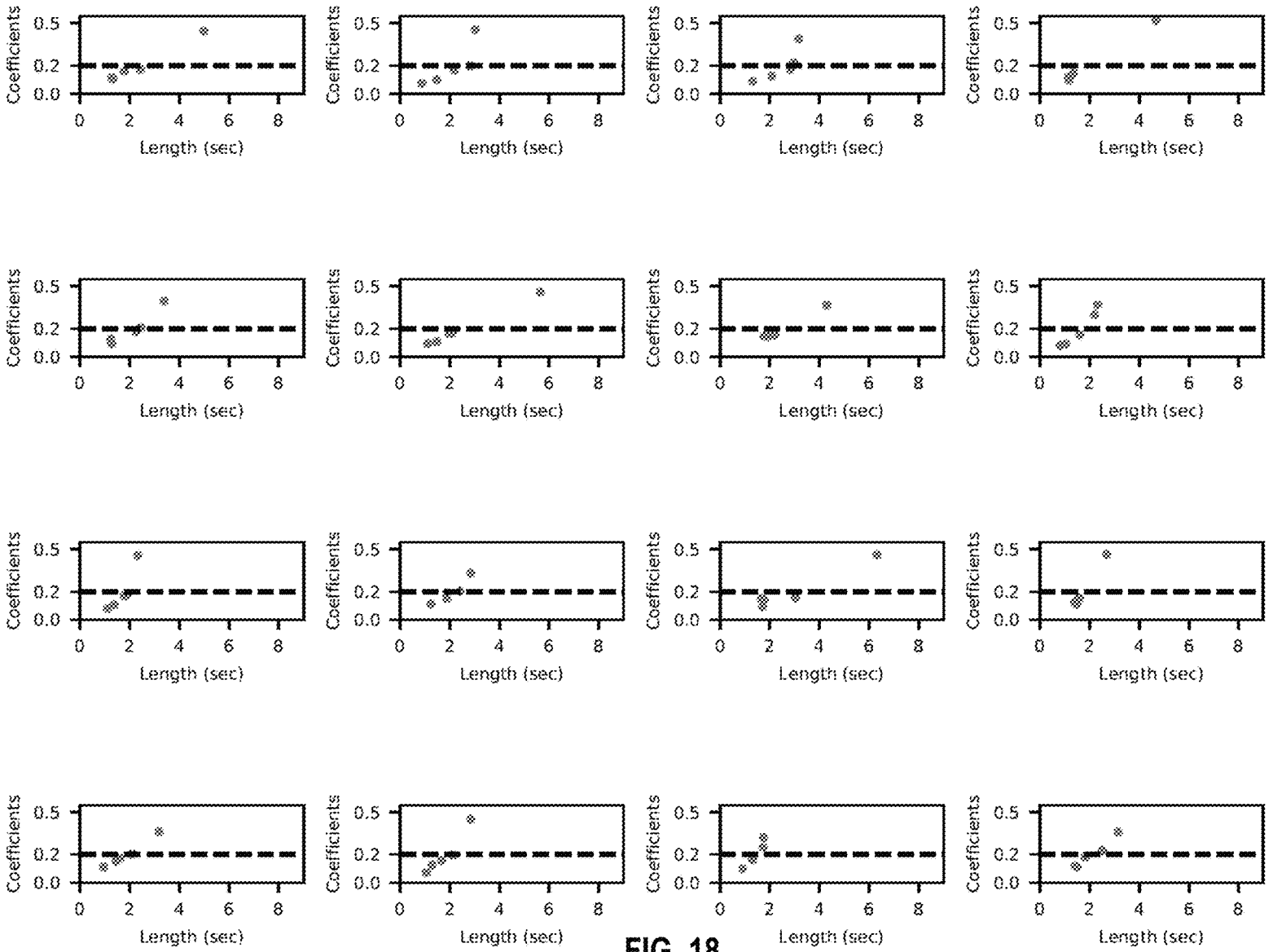
FIG. 18 depicts inferred attention coefficients for the speaker encoder model with $N_{samples}$=5 vs. lengths of the cloning audio samples, according to embodiments of the present invention.

For a trained speaker encoder model, FIG. 18 exemplifies attention distributions for different audio lengths. FIG. 18 depicts inferred attention coefficients for the speaker encoder model with $N_{sample}=5$ vs. lengths of the cloning audio samples, according to embodiments of the present invention. The dashed line corresponds to the case of averaging all cloning audio samples. The attention mechanism can yield highly non-uniformly distributed coefficients while combining the information in different cloning samples, and especially assigns higher coefficients to longer audios, as intuitively expected due to the potential more information content in them.

d) Speaker Classification Model

A speaker classifier embodiment was trained on VCTK dataset to classify which of the 108 speakers an audio sample belongs to. The speaker classifier embodiment had a fully-connected layer of size 256, 6 convolutional layers with 256 filters of width 4, and a final embedding layer of size 32. The model achieved 100% accuracy for the validation set of size 512.

e) Speaker Verification Model

A speaker verification model embodiment was trained on the LibriSpeech dataset to measure the quality of cloned audios compared to ground truth audios from unseen speakers. Fifty (50) speakers were held out from Librispeech as a validation set for unseen speakers. The equal-error-rates (EERs) were estimated by randomly pairing up utterances from the same or different speakers (50% for each case) in test set. 40,960 trials were performed for each test set. The details of speaker verification model embodiment were described above in Section B.3.b. (Speaker Verification).

3. Voice Cloning Performance

For a speaker adaptation approach embodiment, an optimal number of iterations was selected using speaker classification accuracy. For a whole model adaptation embodiment, the number of iterations was selected as 100 for 1, 2 and 3 cloning audio samples, 1000 for 5 and 10 cloning audio samples. For a speaker embedding adaptation embodiment, the number of iterations was fixed as 100K for all cases.

For speaker encoding, voice cloning was considered with and without joint fine-tuning of the speaker encoder and multi-speaker generative model embodiments. The learning rate and annealing parameters were optimized for joint fine-tuning. Table 2 summarizes the approaches and lists the requirements for training, data, cloning time and footprint size.

TABLE 2

Comparison of requirements for speaker adaptation and speaker encoding. Cloning time interval assumes 1-10 cloning audios. Inference time was for an average sentence. All assume implementation on a TitanX GPU by Nvidia Corporation based in Santa Clara, California.

| | Speaker adaptation | | Speaker encoding | |
|---|---|---|---|---|
| Approaches | Embedding-only | Whole-model | Without fine-tuning | With fine-tuning |
| Pre-training | Multi-speaker generative model | | | |
| Data | Text and Audio | | Audio | |
| Cloning time | ~8 hours | ~0.5-5 mins | ~1.5-3:5 secs | ~1.5-3.5 secs |
| Inference time | ~0.4-0.6 secs | | | |
| Parameters per speaker | 128 | ~25 million | 512 | 512 |

a) Evaluations by Discriminative Models

Figure 19:
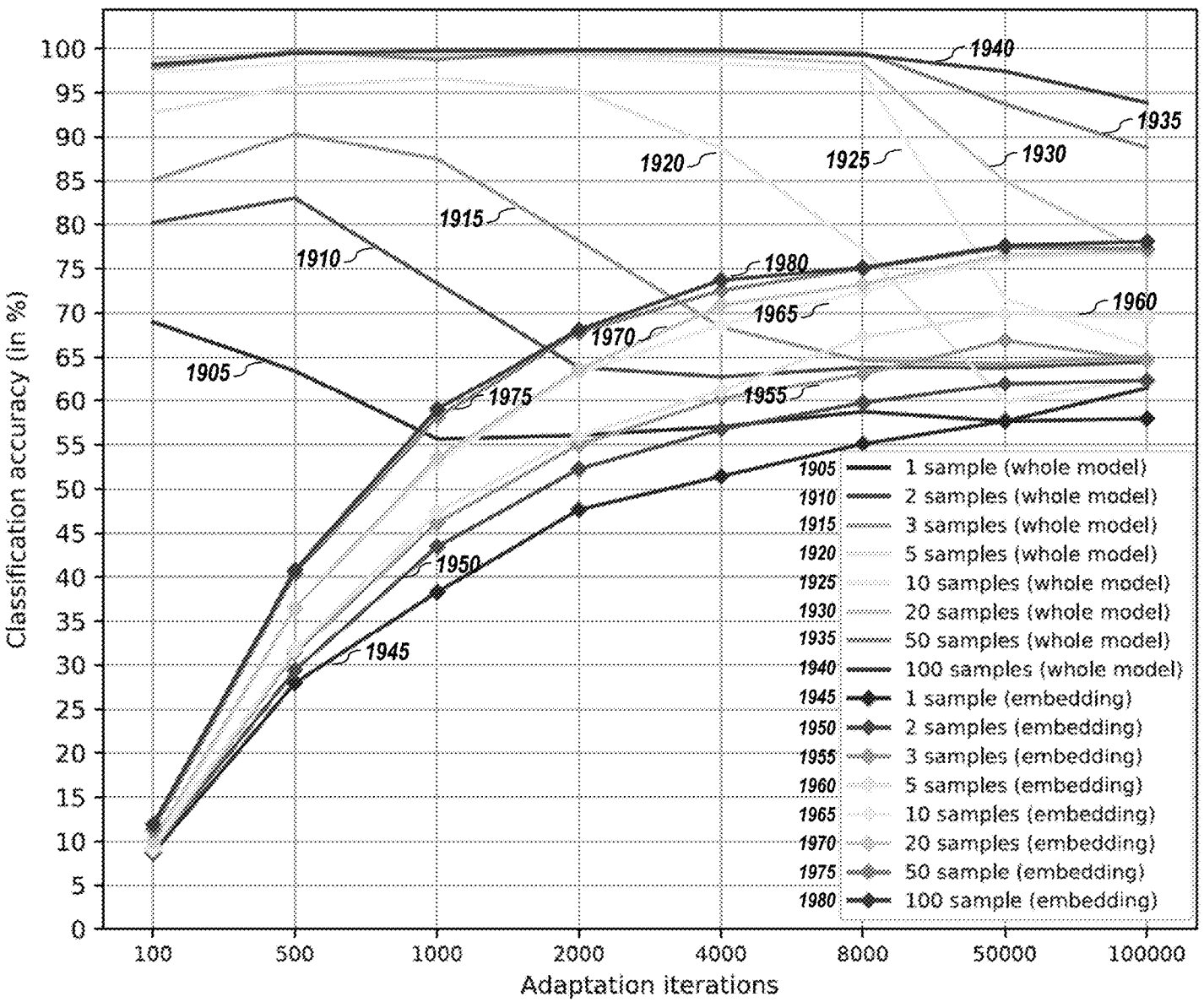
FIG. 19 shows, for speaker adaptation approaches, the speaker classification accuracy vs. the number of iterations, according to embodiments of the present disclosure.

FIG. 19 depicts the performance of whole model adaptation and speaker embedding adaptation embodiments for voice cloning in terms of speaker classification accuracy for 108 VCTK speakers, according to embodiments of the present disclosure. Different numbers of cloning samples and fine-tuning iterations were evaluated. For speaker adaptation approaches, FIG. 19 shows the speaker classification accuracy vs. the number of iterations. For both adaptation approaches, the classification accuracy significantly increased with more samples, up to ten samples. In the low sample count regime, adapting the speaker embedding is less likely to overfit the samples than adapting the whole model. The two methods also required different numbers of iterations to converge. Compared to whole model adaptation, which converges around 1000 iterations for even 100 cloning audio samples, embedding adaptation takes significantly more iterations to converge.

Figure 20:
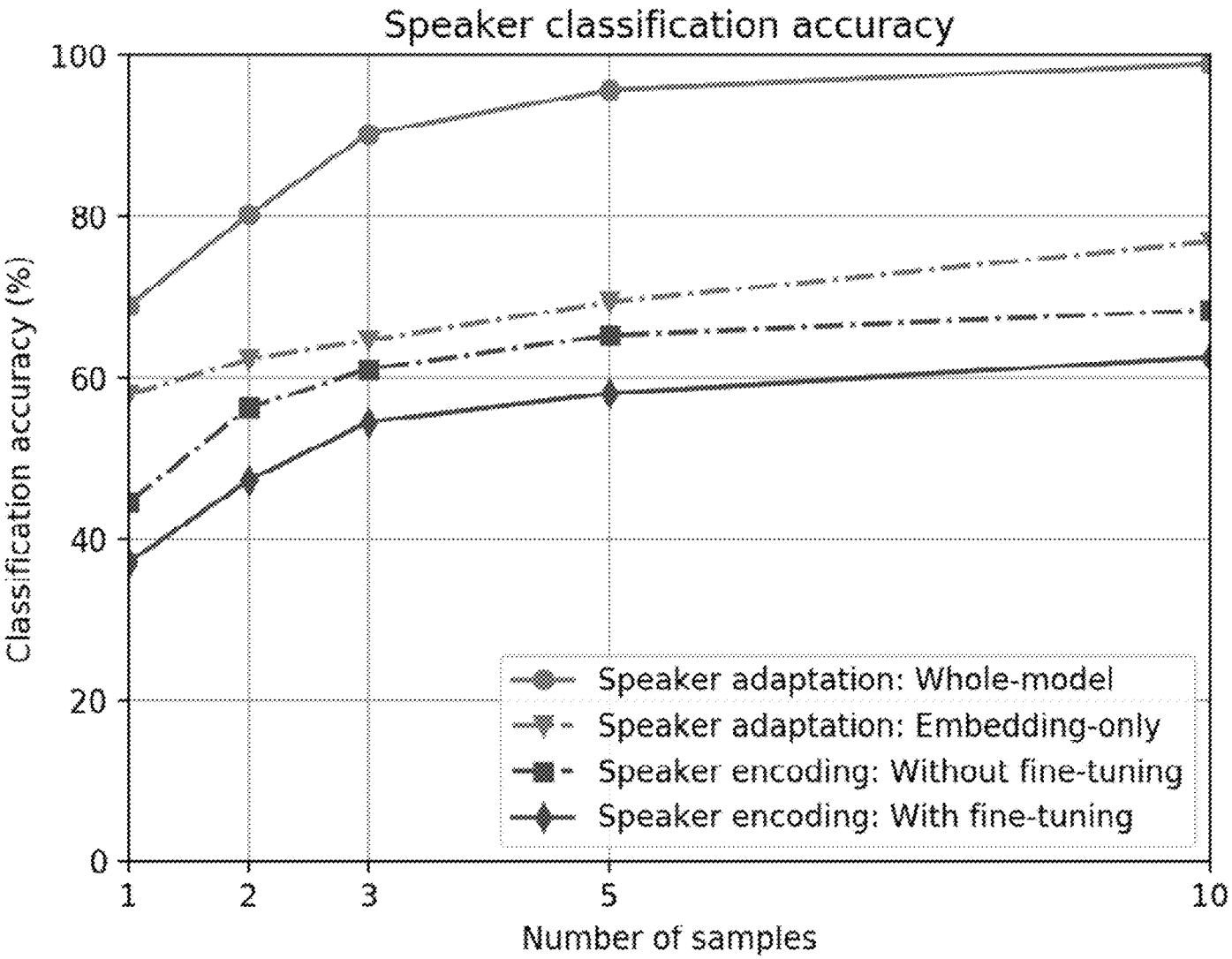
FIG. 20 depicts a comparison of speaker adaptation and speaker encoding approaches in term of speaker classification accuracy with different numbers of cloning samples, according to embodiments of the present disclosure.
Figure 21:
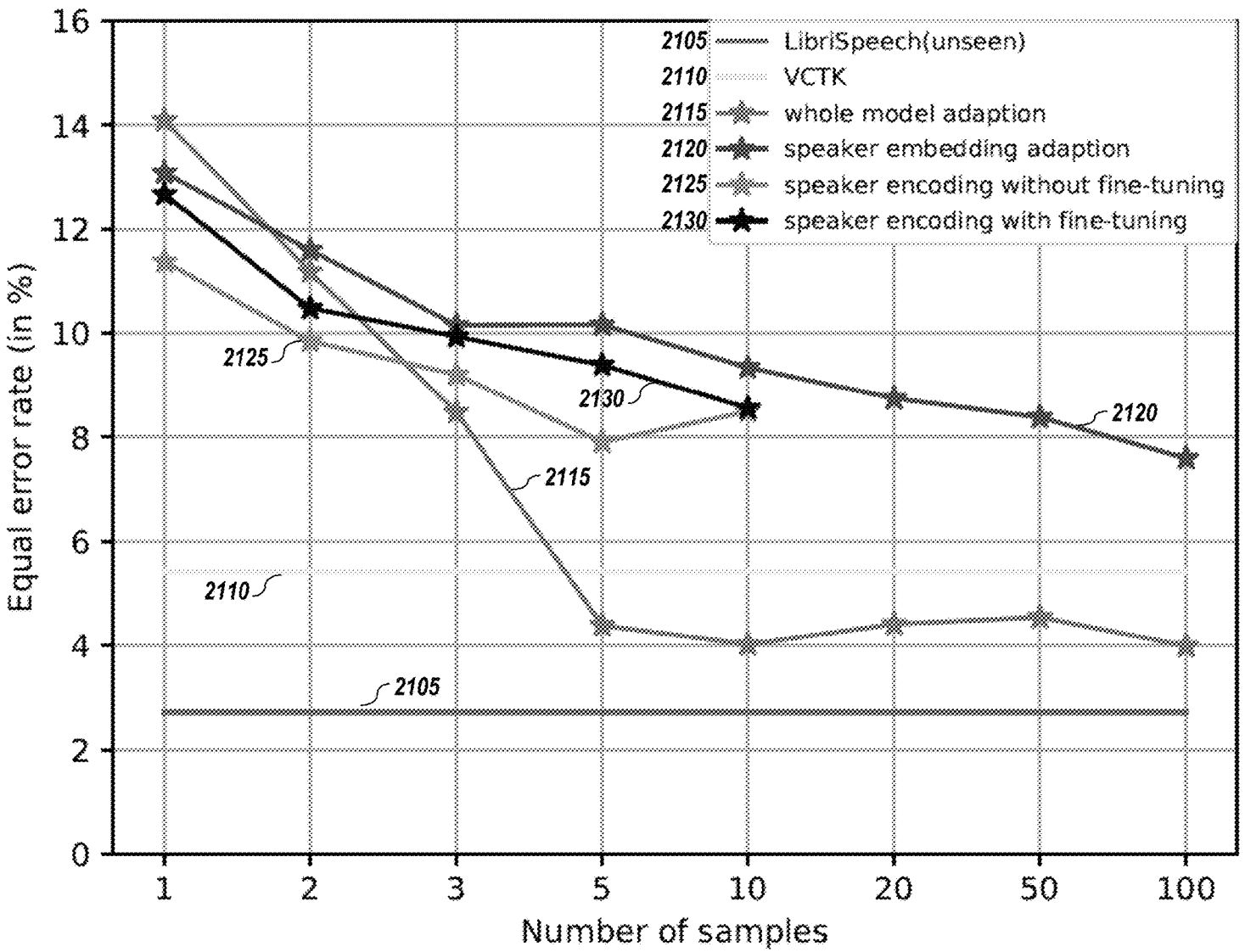
FIG. 21 depicts speaker verification (SV) equal error rate (EER) (using 5 enrollment audio) for different numbers of cloning samples, according to embodiments of the present disclosure.

FIGS. 20 and 21 show the classification accuracy and EER, obtained by speaker classification and speaker verification models. FIG. 20 depicts a comparison of speaker adaptation and speaker encoding approaches in term of speaker classification accuracy with different numbers of cloning samples, according to embodiments of the present disclosure. FIG. 21 depicts speaker verification (SV) EER (using 5 enrollment audio) for different numbers of cloning samples, according to embodiments of the present disclosure. Evaluation setup can be found in Section C.2.e. LibriSpeech (unseen speakers) and VCTK represent EERs estimated from random pairing of utterances from ground-truth datasets, respectively. Both speaker adaptation and speaker encoding embodiments benefit from more cloning audios. When the number of cloning audio samples exceed five, the whole model adaptation outperformed the other techniques in both metrics. Speaker encoding approaches yielded a lower classification accuracy compared to embedding adaptation, but they achieved a similar speaker verification performance.

b) Human Evaluations

Besides evaluations by discriminative models, subject tests were also conducted on Amazon Mechanical Turk framework. For assessment of the naturalness of the generated audios, a 5-scale mean opinion score (MOS) was used. For assessment of how similar the generated audios are to the ground truth audios from target speakers, a 4-scale similarity score with the same question and categories in Mirjam Wester et al., "Analysis of the voice conversion challenge 2016 evaluation," in *Interspeech*, pp. 1637-1641, 09 2016 (hereinafter, "Wester et al., 2016") (which is incorporated by reference herein in its entirety) was used. Each evaluation was conducted independently, so the cloned audios of two different models are not directly compared during rating. Multiple votes on the same sample were aggregated by a majority voting rule.

Tables 3 and 4 show the results of human evaluations. In general, higher number of cloning audios improved both metrics. The improvement was more significant for whole model adaptation as expected, due to the more degrees of freedom provided for an unseen speaker. There was a very slight difference in naturalness for speaker encoding approaches with more cloning audios. Most importantly, speaker encoding did not degrade the naturalness of the baseline multi-speaker generative model. Fine-tuning improved the naturalness of speaker encoding as expected, since it allowed the generative model to learn how to compensate the errors of the speaker encoder while training. Similarity scores slightly improved with higher sample counts for speaker encoding, and matched the scores for speaker embedding adaptation. The gap of similarity with ground truth was also partially attributed to the limited naturalness of the outputs (as they were trained with LibriSpeech dataset).

TABLE 3

Mean Opinion Score (MOS) evaluations for naturalness with 95% confidence intervals (when training was done with LibriSpeech dataset and cloning was done with the 108 speakers of the VCTK dataset).

| | Sample count | | | | |
|---|---|---|---|---|---|
| Approach | 1 | 2 | 3 | 5 | 10 |
| Ground-truth (at 16 KHz) | | | 4.66 ± 0.06 | | |
| Multi-speaker generative model | | | 2.61 ± 0.10 | | |
| Speaker adaptation: embedding-only | 2.27 ± 0.10 | 2.38 ± 0.10 | 2.43 ± 0.10 | 2.46 ± 0.09 | 2.67 ± 0.10 |
| Speaker adaptation: whole-model | 2.32 ± 0.10 | 2.87 ± 0.09 | 2.98 ± 0.11 | 2.67 ± 0.11 | 3.16 ± 0.09 |

TABLE 3-continued

Mean Opinion Score (MOS) evaluations for naturalness with 95% confidence intervals (when training was done with LibriSpeech dataset and cloning was done with the 108 speakers of the VCTK dataset).

| | Sample count | | | | |
|---|---|---|---|---|---|
| Approach | 1 | 2 | 3 | 5 | 10 |
| Speaker encoding: without fine-tuning | 2.76 ± 0.10 | 2.76 ± 0.09 | 2.78 ± 0.10 | 2.75 ± 0.10 | 2.79 ± 0.10 |
| Speaker encoding: with fine-tuning | 2.93 ± 0.10 | 3.02 ± 0.11 | 2.97 ± 0.1 | 2.93 ± 0.10 | 2.99 ± 0.12 |

TABLE 4

Similarity score evaluations with 95% confidence intervals (when training was done with LibriSpeech dataset and cloning was done with the 108 speakers of the VCTK dataset).

| | Sample count | | | | |
|---|---|---|---|---|---|
| Approach | 1 | 2 | 3 | 5 | 10 |
| Ground-truth: same speaker | | | 3.91 ± 0.03 | | |
| Ground-truth: different speakers | | | 1.52 ± 0.09 | | |
| Speaker adaptation: embedding-only | 2.66 ± 0.09 | 2.64 ± 0.09 | 2.71 ± 0.09 | 2.78 ± 0.10 | 2.67 ± 0.09 |
| Speaker adaptation: whole-model | 2.59 ± 0.09 | 2.95 ± 0.09 | 3.01 ± 0.10 | 3.07 ± 0.08 | 3.16 ± 0.08 |
| Speaker encoding: without fine-tuning | 2.48 ± 0.10 | 2.73 ± 0.10 | 2.70 ± 0.11 | 2.81 ± 0.10 | 2.85 ± 0.10 |
| Speaker encoding: with fine-tuning | 2.59 ± 0.12 | 2.67 ± 0.12 | 2.73 ± 0.13 | 2.77 ± 0.12 | 2.77 ± 0.11 |

Figure 22:
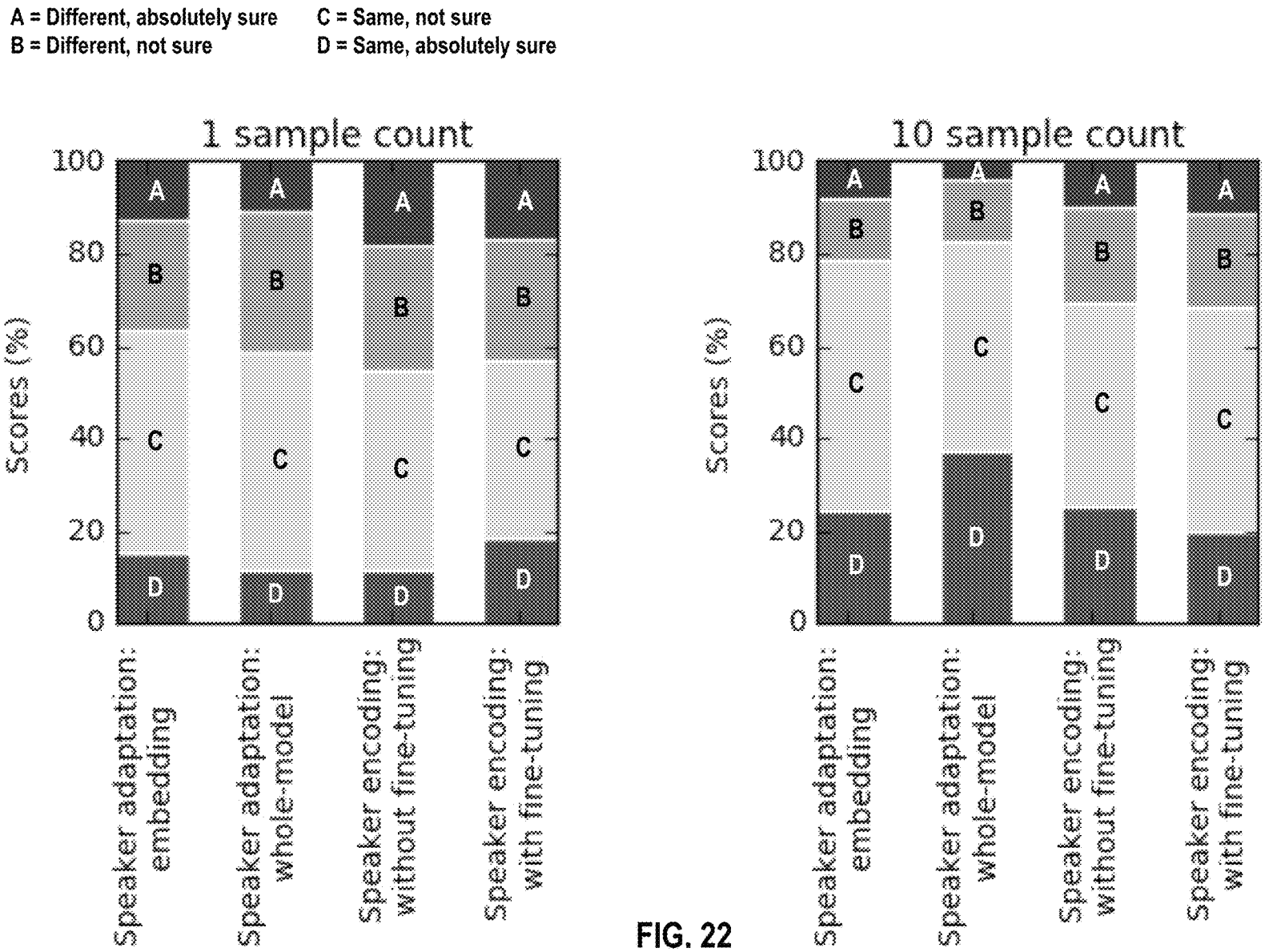
FIG. 22 depicts distribution of similarity scores for 1 and 10 sample counts, according to embodiments of the present disclosure.

Similarity scores. For the result in Table 4, FIG. 22 shows the distribution of the scores given by MTurk users as in Wester et al., 2016 (referenced above). For 10 sample count, the ratio of evaluations with the 'same speaker' rating exceeds 70% for all models.

4. Speaker Embedding Space and Manipulation

Figure 23:
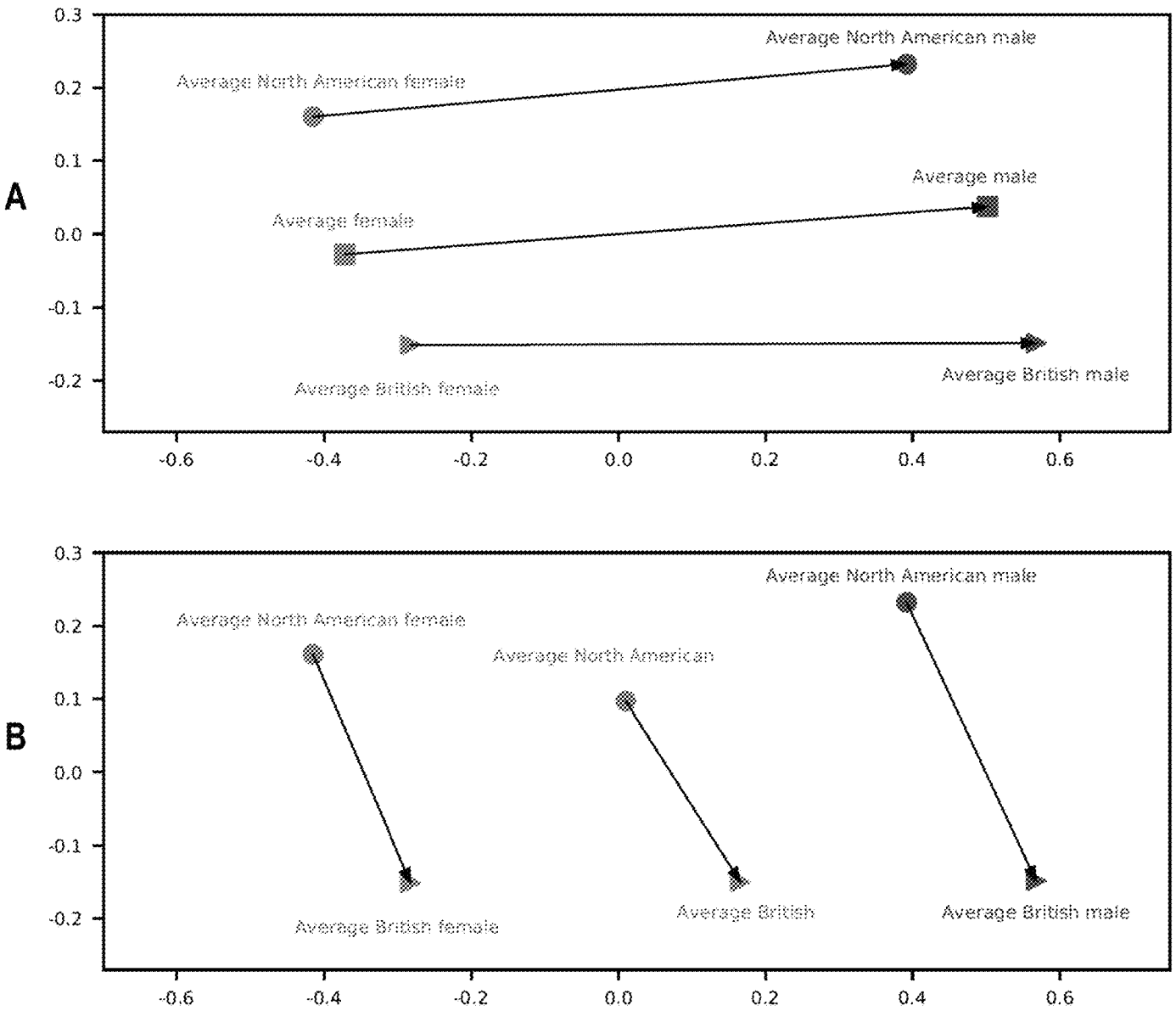
FIG. 23 depicts visualization of estimated speaker embeddings by speaker encoder, according to embodiments of the present disclosure.

Speaker embedding of the current disclosure are capable of speaker embedding space representations and capable of manipulation to alter speech characteristics, which manipulation may also be known as voice morphing. As shown in FIG. 23 and elsewhere in this section, speaker encoder models map speakers into a meaningful latent space. FIG. 23 depicts visualization of estimated speaker embeddings by speaker encoder, according to embodiments of the present disclosure. The first two principal components of the average speaker embeddings for the speaker encoder with 5 sample count are depicted. Only British and North American regional accents are shown as they constitute the majority of the labeled speakers in the VCTK dataset.

Inspired by word embedding manipulation (e.g., to demonstrate the existence of simple algebraic operations as king−queen=male−female), algebraic operations were applied to the inferred embeddings to transform their speech characteristics.

To transform gender, the averaged speaker embeddings for female and male were obtained and their difference was added to a particular speaker. For example:

$$\text{BritishMale}+\text{AveragedFemale}-\text{AveragedMale}$$

can yield a British female speaker. Similarly, a region of accent can be transformation by, for example:

$$\text{BritishMale}+\text{AveragedAmerican}-\text{AveragedBritish}$$

to obtain an American male speaker. These results demonstrate high quality audios with specific gender and accent characteristics obtained in this way.

Speaker Embedding Space Learned by the Encoder.

Figure 24:
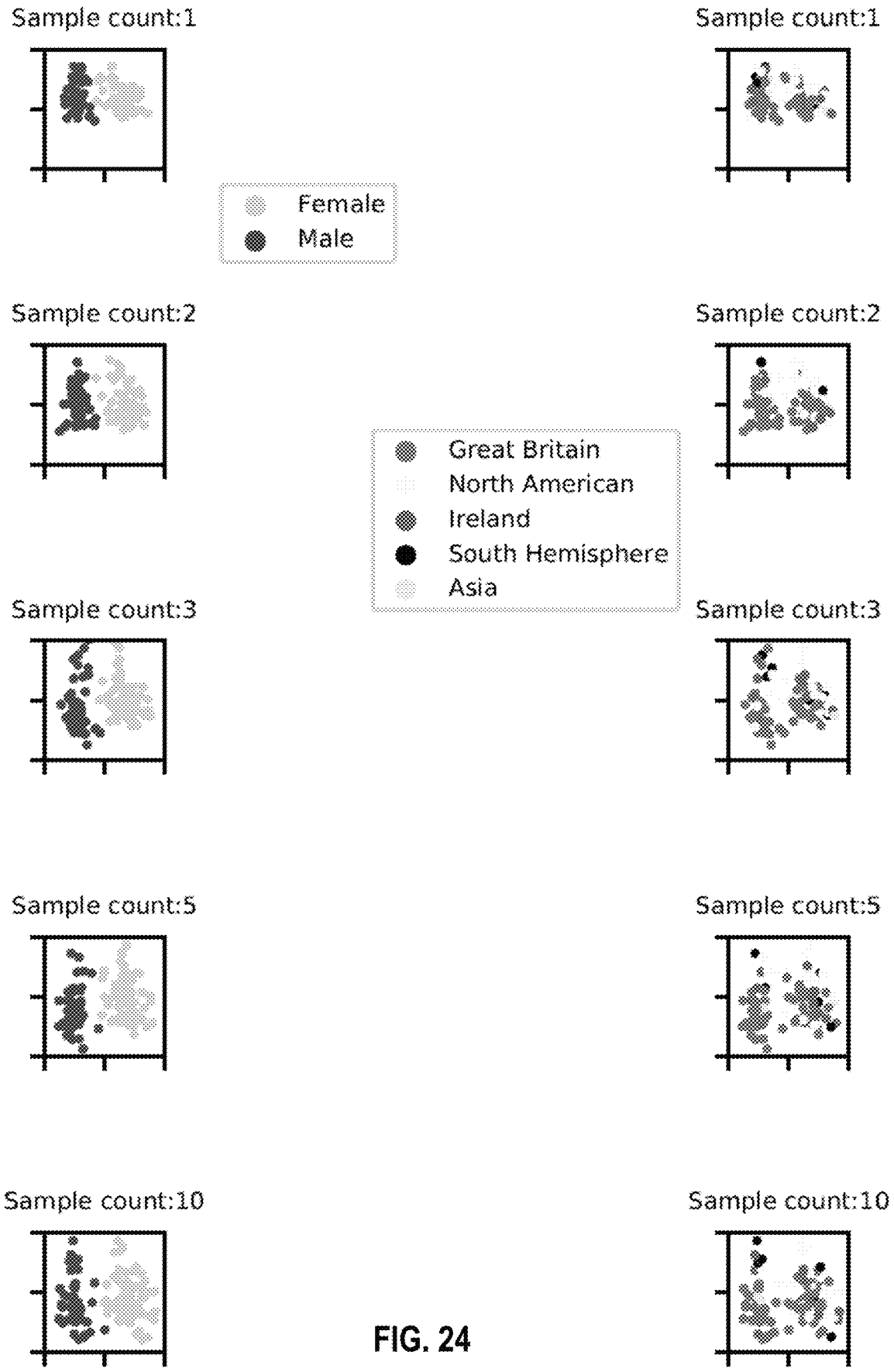
FIG. 24 depicts the first two principal components of inferred embeddings, with the ground truth labels for gender and region of accent for the VCTK speakers, according to embodiments of the present disclosure.

To analyze the speaker embedding space learned by the trained speaker encoders, a principal component analysis was applied to the space of inferred embeddings, and their ground truth labels were considered for gender and region of accent from the VCTK dataset. FIG. 24 shows visualization of the first two principal components, according to embodiments of the present disclosure. It was observed that the speaker encoder maps the cloning audios to a latent space with highly meaningful discriminative patterns. In particular for gender, a one-dimensional linear transformation from the learned speaker embeddings can achieve a very high discriminative accuracy—although the models never see the ground truth gender label while training.

5. Impact of Training Dataset

To evaluate the impact of the training dataset, the voice cloning setting was also considered when the training was based on a subset of the VCTK containing 84 speakers, where another 8 speakers were used for validation and 16 for testing. The tested speaker encoder model embodiments generalize poorly for unseen speakers due to limited training speakers. Table 5 and Table 6 present the human evaluation results for the speaker adaptation approach. Speaker verification results are shown in FIGS. 16A and 16B. The significant performance difference between embedding-only and whole-model adaptation embodiments underlines an importance of the diversity of training speakers while incorporating speaker-discriminative information into embeddings.

TABLE 5

Mean Opinion Score (MOS) evaluations for naturalness with 95% confidence intervals (when training was done with 84 speakers of the VCTK dataset and cloning was done with 16 speakers of the VCTK dataset).

| | Sample count | | | | |
|---|---|---|---|---|---|
| Approach | 1 | 5 | 10 | 20 | 100 |
| Speaker adaptation: embedding-only | 3.01 ± 0.11 | — | 3.13 ± 0.11 | — | 3.13 ± 0.11 |
| Speaker adaptation: whole-model | 2.34 ± 0.13 | 2.99 ± 0.10 | 3.07 ± 0.09 | 3.40 ± 0.10 | 3.38 ± 0.09 |

TABLE 6

Similarity score evaluations with 95% confidence intervals (when training was done with 84 speakers of the VCTK dataset and cloning was done with 16 speakers of the VCTK dataset).

| | Sample count | | | | |
|---|---|---|---|---|---|
| Approach | 1 | 5 | 10 | 20 | 100 |
| Speaker adaptation: embedding-only | 2.42 ± 0.13 | — | 2.37 ± 0.13 | — | 2.37 ± 0.12 |
| Speaker adaptation: whole-model | 2.55 ± 0.11 | 2.93 ± 0.11 | 2.95 ± 0.10 | 3.01 ± 0.10 | 3.14 ± 0.10 |

D. Some Conclusions

Presented herein are two general approaches for neural voice cloning: speaker adaptation and speaker encoding. It was demonstrated that embodiments of both approaches achieve good cloning quality even with only a few cloning audios. For naturalness, it was shown herein that both speaker adaptation embodiments and speaker encoding embodiments achieve a MOS for naturalness similar to a baseline multi-speaker generative model. Thus, improved results may be obtained with other multi-speaker models.

For similarity, it was demonstrated that embodiments of both approaches benefit from a larger number of cloning audios. The performance gap between whole-model and embedding-only adaptation embodiments indicate that some discriminative speaker information still exists in the generative model besides speaker embeddings. One benefit of compact representation via embeddings is fast cloning and small footprint size per user. Especially for the applications with resource constraints, these practical considerations should clearly favor the use of speaker encoding approach.

It was observed the drawbacks of training a multi-speaker generative model embodiment using a speech recognition dataset with low-quality audios and limited diversity in representation of universal set of speakers. Improvements in the quality of dataset result in higher naturalness and similarity of generated samples. Also, increasing the amount and diversity of speakers tends to enable a more meaningful speaker embedding space, which can improve the similarity obtained by embodiments of both approaches. Embodiments of both techniques may benefit from a large-scale and high-quality multi-speaker speech dataset.

E. Computing System Embodiments

In embodiments, aspects of the present patent document may be directed to, may include, or may be implemented on one or more information handling systems/computing systems. A computing system may include any instrumentality or aggregate of instrumentalities operable to compute, calculate, determine, classify, process, transmit, receive, retrieve, originate, route, switch, store, display, communicate, manifest, detect, record, reproduce, handle, or utilize any form of information, intelligence, or data. For example, a computing system may be or may include a personal computer (e.g., laptop), tablet computer, phablet, personal digital assistant (PDA), smart phone, smart watch, smart package, server (e.g., blade server or rack server), a network storage device, camera, or any other suitable device and may vary in size, shape, performance, functionality, and price. The computing system may include random access memory (RAM), one or more processing resources such as a central processing unit (CPU) or hardware or software control logic, ROM, and/or other types of memory. Additional components of the computing system may include one or more disk drives, one or more network ports for communicating with external devices as well as various input and output (I/O) devices, such as a keyboard, a mouse, touchscreen and/or a video display. The computing system may also include one or more buses operable to transmit communications between the various hardware components.

Figure 25:
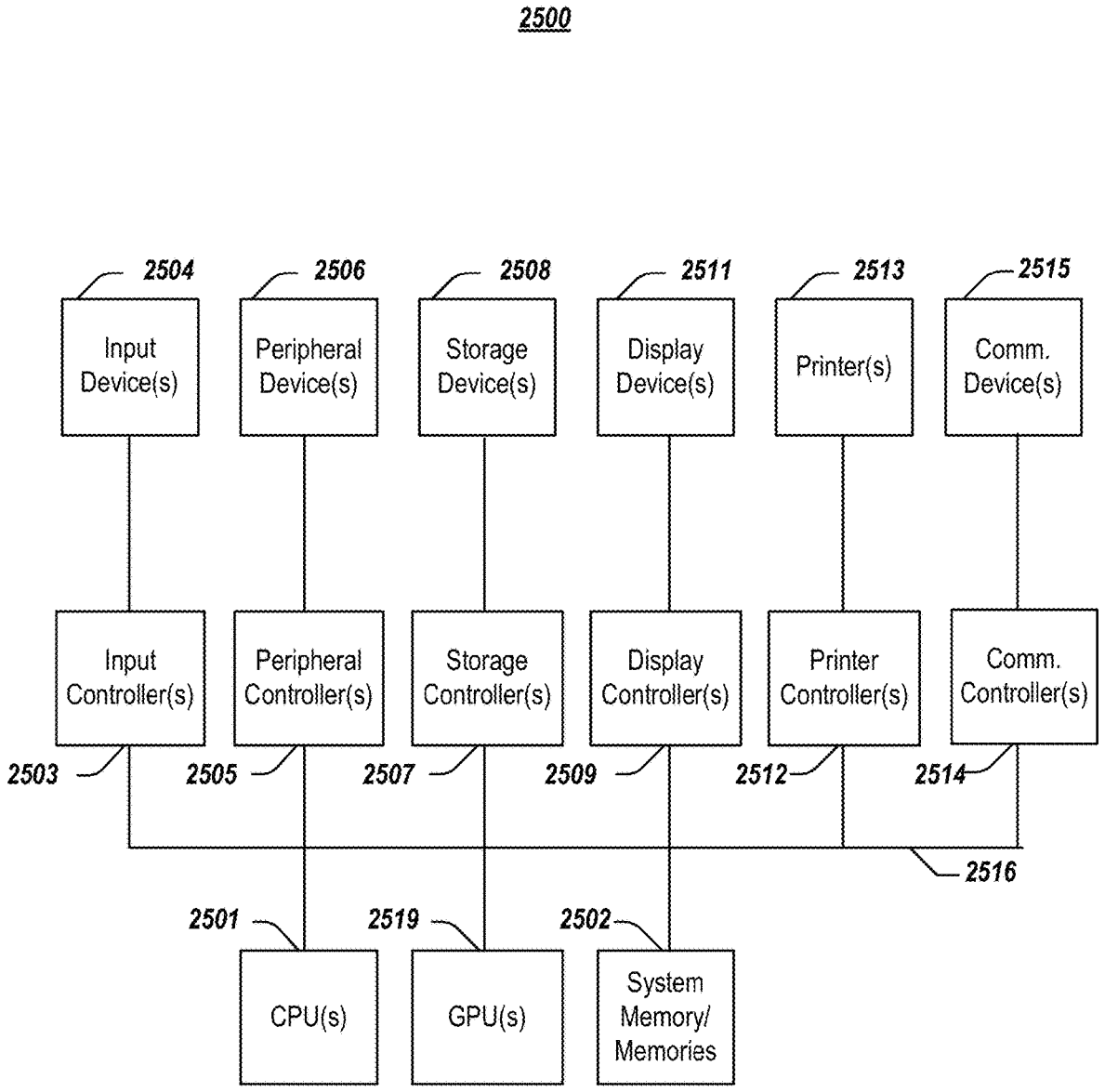
FIG. 25 depicts a simplified block diagram of a computing device/information handling system, in accordance with embodiments of the present document.

FIG. 25 depicts a simplified block diagram of a computing device/information handling system (or computing system) according to embodiments of the present disclosure. It will be understood that the functionalities shown for system 2500 may operate to support various embodiments of a computing system—although it shall be understood that a computing system may be differently configured and include different components, including having fewer or more components as depicted in FIG. 25.

As illustrated in FIG. 25, the computing system 2500 includes one or more central processing units (CPU) 2501 that provides computing resources and controls the computer. CPU 2501 may be implemented with a microprocessor or the like, and may also include one or more graphics processing units (GPU) 2519 and/or a floating-point coprocessor for mathematical computations. System 2500 may also include a system memory 2502, which may be in the form of random-access memory (RAM), read-only memory (ROM), or both.

A number of controllers and peripheral devices may also be provided, as shown in FIG. 25. An input controller 2503 represents an interface to various input device(s) 2504, such as a keyboard, mouse, touchscreen, and/or stylus. The computing system 2500 may also include a storage controller 2507 for interfacing with one or more storage devices 2508 each of which includes a storage medium such as magnetic tape or disk, or an optical medium that might be used to record programs of instructions for operating systems, utilities, and applications, which may include embodiments of programs that implement various aspects of the present disclosure. Storage device(s) 2508 may also be used to store processed data or data to be processed in accordance with the disclosure. The system 2500 may also include a display controller 2509 for providing an interface to a display device 2511, which may be a cathode ray tube (CRT), a thin film transistor (TFT) display, organic light-emitting diode, electroluminescent panel, plasma panel, or other type of display. The computing system 2500 may also include one or more peripheral controllers or interfaces 2505 for one or more peripherals 2506. Examples of peripherals may include one or more printers, scanners, input devices, output devices, sensors, and the like. A communications controller 2514 may interface with one or more communication devices 2515, which enables the system 2500 to connect to remote devices through any of a variety of networks including the Internet, a cloud resource (e.g., an Ethernet cloud, a Fiber Channel over Ethernet (FCoE)/Data Center Bridging (DCB) cloud, etc.), a local area network (LAN), a wide area network (WAN), a storage area network (SAN) or through any suitable electromagnetic carrier signals including infrared signals.

In the illustrated system, all major system components may connect to a bus 2516, which may represent more than one physical bus. However, various system components may or may not be in physical proximity to one another. For example, input data and/or output data may be remotely transmitted from one physical location to another. In addition, programs that implement various aspects of the disclosure may be accessed from a remote location (e.g., a server) over a network. Such data and/or programs may be conveyed through any of a variety of machine-readable medium including, but are not limited to: magnetic media such as hard disks, floppy disks, and magnetic tape; optical media such as CD-ROMs and holographic devices; magneto-optical media; and hardware devices that are specially configured to store or to store and execute program code, such as application specific integrated circuits (ASICs), programmable logic devices (PLDs), flash memory devices, and ROM and RAM devices.

F. Multi-Speaker Generative Model Embodiments

Presented herein are novel fully-convolutional architecture embodiments for speech synthesis. Embodiments were scaled to very large audio data sets, and several real-world issues that arise when attempting to deploy an attention-based text-to-speech (TTS) system were addressed. Fully-convolutional character-to-spectrogram architecture embodiments, which enable fully paralleled computation and are trained an order of magnitude faster than analogous architectures using recurrent cells, are disclosed. Architecture embodiments may be generally referred to herein, for convenience, as Deep Voice 3 or DV3.

1. Model Architecture Embodiments

In this section, embodiments of a fully-convolutional sequence-to-sequence architecture for TTS are presented. Architecture embodiments are capable of converting a variety of textual features (e.g., characters, phonemes, stresses) into a variety of vocoder parameters, e.g., mel-band spectrograms, linear-scale log magnitude spectrograms, fundamental frequency, spectral envelope, and aperiodicity parameters. These vocoder parameters may be used as inputs for audio waveform synthesis models.

In one or more embodiments, a Deep Voice 3 architecture comprises three components:

- Encoder: A fully-convolutional encoder, which converts textual features to an internal learned representation.
- Decoder: A fully-convolutional causal decoder, which decodes the learned representation with a multi-hop convolutional attention mechanism into a low-dimensional audio representation (mel-band spectrograms) in an auto-regressive manner.
- Converter: A fully-convolutional post-processing network, which predicts final vocoder parameters (depending on the vocoder choice) from the decoder hidden states. Unlike the decoder, the converter is non-causal and can thus depend on future context information.

Figure 26:
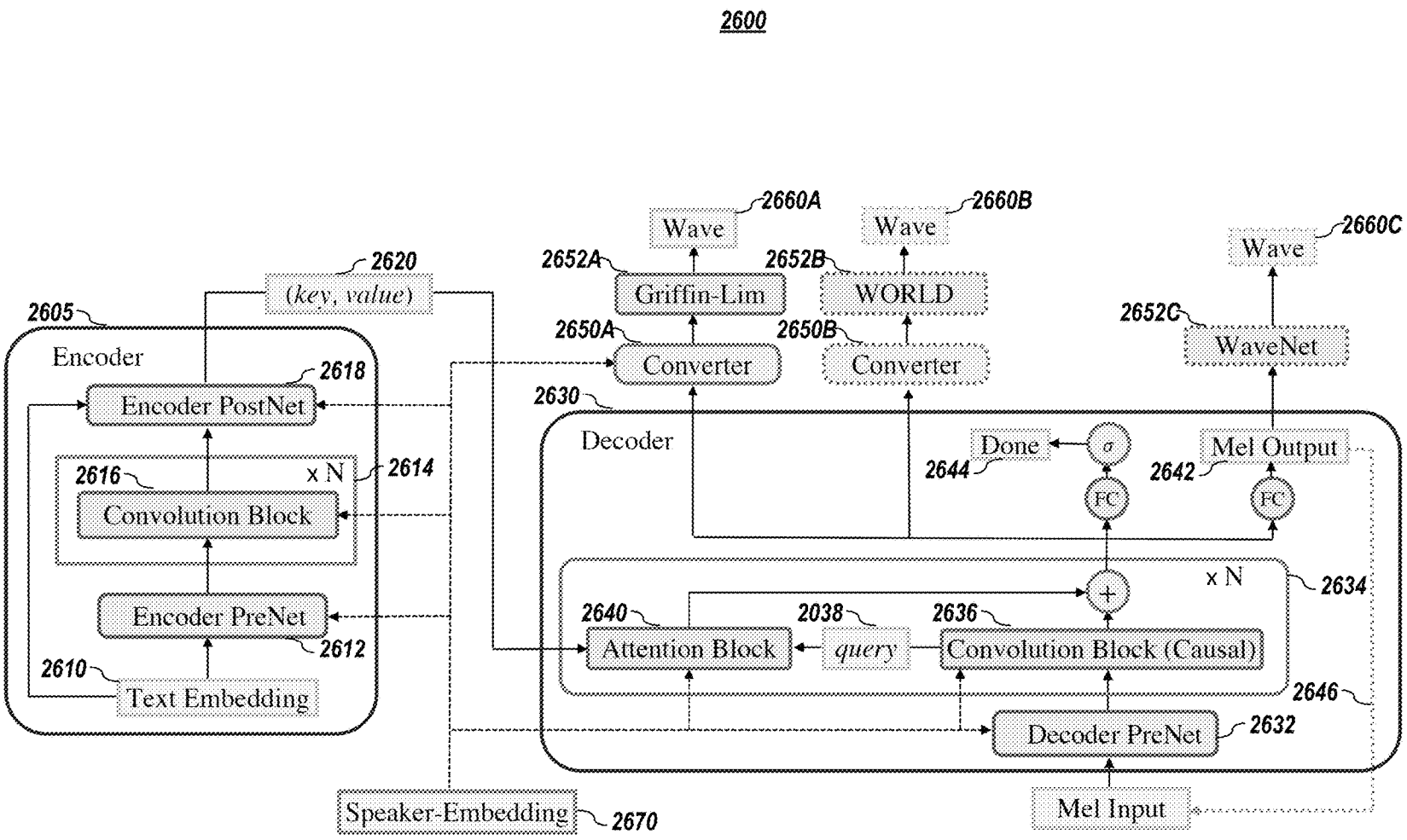
FIG. 26 graphical depicts an example Deep Voice 3 architecture 2600, according to embodiments of the present disclosure.

FIG. 26 graphical depicts an example Deep Voice 3 architecture 2600, according to embodiments of the present disclosure. In embodiment, a Deep Voice 3 architecture 2600 uses residual convolutional layers in an encoder 2605 to encode text into per-timestep key and value vectors 2620 for an attention-based decoder 2630. In one or more embodiments, the decoder 2630 uses these to predict the mel-scale log magnitude spectrograms 2642 that correspond to the output audio. In FIG. 26, the dotted arrow 2646 depicts the autoregressive synthesis process during inference (during training, mel-spectrogram frames from the ground truth audio corresponding to the input text are used). In one or more embodiments, the hidden states of the decoder 2630 are then fed to a converter network 2650 to predict the vocoder parameters for waveform synthesis to produce an output wave 2660. Section F.2., which includes FIG. 31 that graphically depicts an example detailed model architecture, according to embodiments of the present disclosure, provides additional details.

In one or more embodiments, the overall objective function to be optimized may be a linear combination of the losses from the decoder (Section F.1.e) and the converter (Section F.1.f). In one or more embodiments, the decoder 2610 and converter 2615 are separated and multi-task training is applied, because it makes attention learning easier in practice. To be specific, in one or more embodiments, the loss for mel-spectrogram prediction guides training of the attention mechanism, because the attention is trained with the gradients from mel-spectrogram prediction (e.g., using an L1 loss for the mel-spectrograms) besides vocoder parameter prediction.

In a multi-speaker scenario, trainable speaker embeddings 2670 are used across encoder 2605, decoder 2630, and converter 2650.

Figure 27:
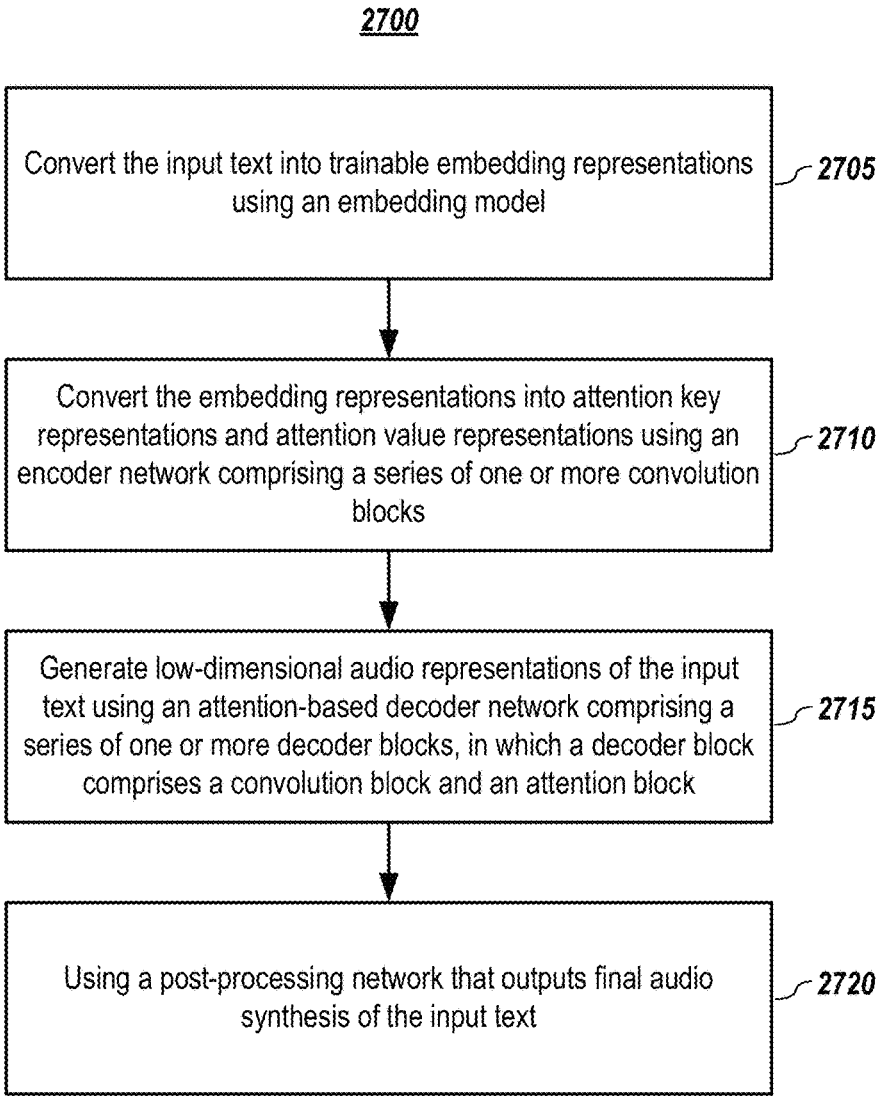
FIG. 27 depicts a general overview methodology for using a text-to-speech architecture, such as depicted in FIG. 26 or FIG. 31, according to embodiments of the present disclosure.
Figure 31:
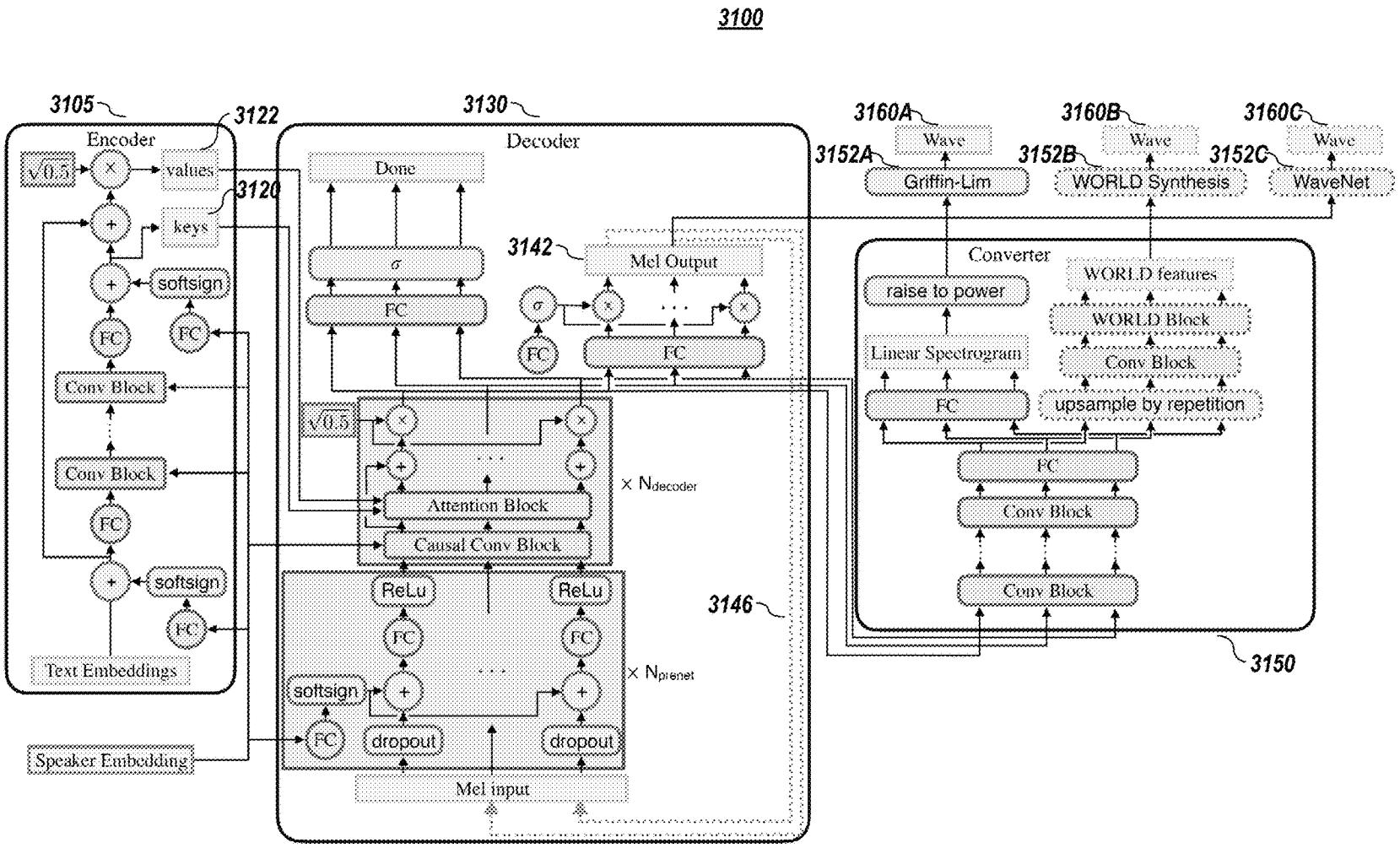
FIG. 31 graphically depicts an example detailed Deep Voice 3 model architecture, according to embodiments of the present disclosure.

FIG. 27 depicts a general overview methodology for using a text-to-speech architecture, such as depicted in FIG. 26 or FIG. 31, according to embodiments of the present disclosure. In one or more embodiments, an input text in converted (2705) into trainable embedding representations using an embedding model, such as text embedding model 2610. The embedding representations are converted (2710) into attention key representations 2620 and attention value representations 2620 using an encoder network 2605, which comprises a series 2614 of one or more convolution blocks 2616. These attention key representations 2620 and attention value representations 2620 are used by an attention-based decoder network, which comprises a series 2634 of one or more decoder blocks 2634, in which a decoder block 2634 comprises a convolution block 2636 that generates a query 2638 and an attention block 2640, to generate (2715) low-dimensional audio representations (e.g., 2642) of the input text. In one or more embodiments, the low-dimensional audio representations of the input text may undergo additional processing by a post-processing network (e.g., 2650A/2652A, 2650B/2652B, or 2652C) that predicts (2720) final audio synthesis of the input text. As noted above, speaker embeddings 2670 may be used in the process to cause the synthesized audio 2660 to exhibit one or more audio characteristics (e.g., a male voice, a female voice, a particular accent, etc.) associated with a speaker identifier or speaker embedding.

Next, each of these components and the data processing are described in more detail. Example model hyperparameters are available in Table 7 (below).

a) Text Preprocessing

Text preprocessing can be important for good performance. Feeding raw text (characters with spacing and punctuation) yields acceptable performance on many utterances. However, some utterances may have mispronunciations of rare words, or may yield skipped words and repeated words. In one or more embodiments, these issues may be alleviated by normalizing the input text as follows:

1. Uppercase all characters in the input text.
2. Remove all intermediate punctuation marks.
3. End every utterance with a period or question mark.
4. Replace spaces between words with special separator characters which indicate the duration of pauses inserted by the speaker between words. In one or more embodiments, four different word separators may be used, as discussed above. In one or more embodiments, the pause durations may be obtained through either manual labeling or estimated by a text-audio aligner.

b) Joint Representation of Characters and Phonemes

Deployed TTS systems should, in one or more embodiments, preferably include a way to modify pronunciations to correct common mistakes (which typically involve, for example, proper nouns, foreign words, and domain-specific jargon). A conventional way to do this is to maintain a dictionary to map words to their phonetic representations.

In one or more embodiments, the model can directly convert characters (including punctuation and spacing) to acoustic features, and hence learns an implicit grapheme-to-phoneme model. This implicit conversion can be difficult to correct when the model makes mistakes. Thus, in addition to character models, in one or more embodiments, phoneme-only models and/or mixed character-and-phoneme models may be trained by allowing phoneme input option explicitly. In one or more embodiments, these models may be identical to character-only models, except that the input layer of the encoder sometimes receives phoneme and phoneme stress embeddings instead of character embeddings.

In one or more embodiments, a phoneme-only model requires a preprocessing step to convert words to their phoneme representations (e.g., by using an external phoneme dictionary or a separately trained grapheme-to-phoneme model). For embodiments, Carnegie Mellon University Pronouncing Dictionary, CMUDict 0.6b, was used. In one or more embodiments, a mixed character-and-phoneme model requires a similar preprocessing step, except for words not in the phoneme dictionary. These out-of-vocabulary/out-of-dictionary words may be input as characters, allowing the model to use its implicitly learned grapheme-to-phoneme model. While training a mixed character-and-phoneme model, every word is replaced with its phoneme representation with some fixed probability at each training iteration. It was found that this improves pronunciation accuracy and minimizes attention errors, especially when generalizing to utterances longer than those seen during training. More importantly, models that support phoneme representation allow correcting mispronunciations using a phoneme dictionary, a desirable feature of deployed systems.

In one or more embodiments, the text embedding model 2610 may comprise a phoneme-only model and/or a mixed character-and-phoneme model.

c) Convolution Blocks for Sequential Processing

By providing a sufficiently large receptive field, stacked convolutional layers can utilize long-term context information in sequences without introducing any sequential dependency in computation. In one or more embodiments, a convolution block is used as a main sequential processing unit to encode hidden representations of text and audio.

Figure 28:
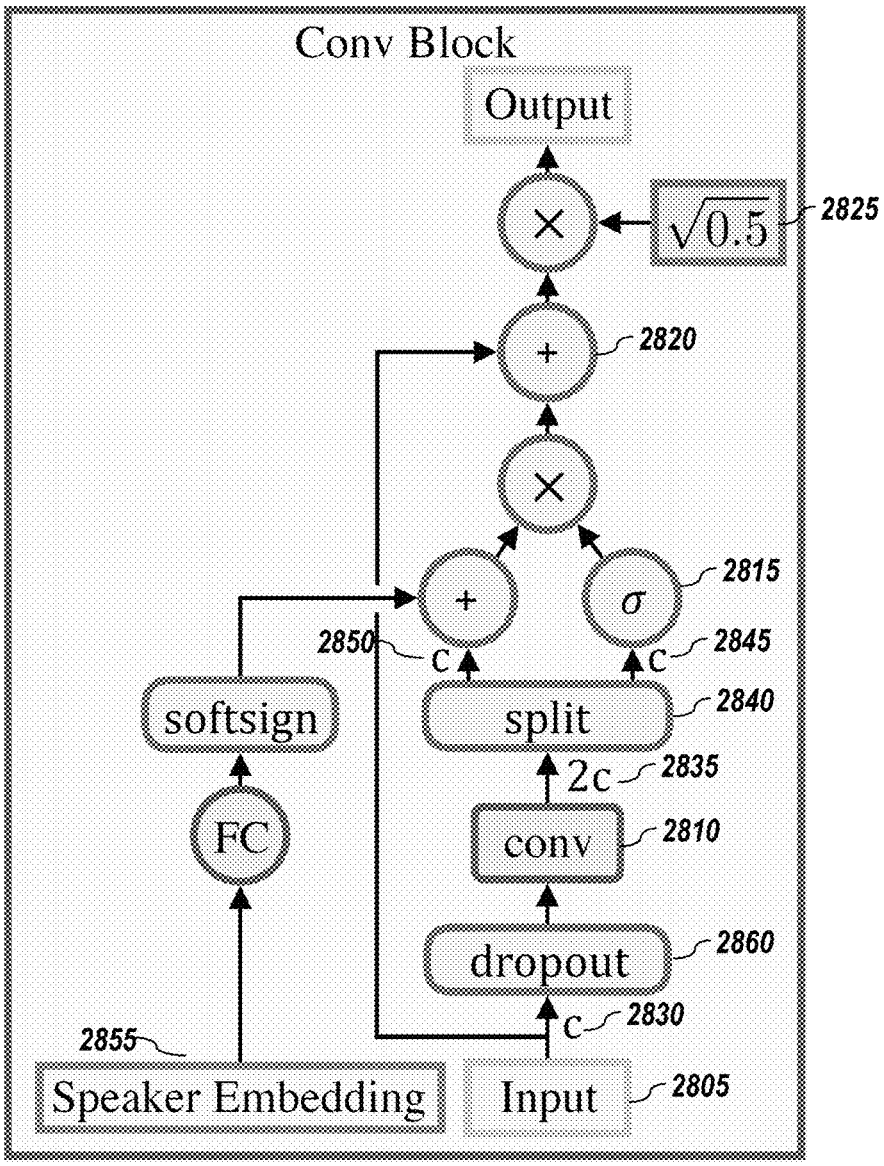
FIG. 28 graphically depicts a convolution block comprising a one-dimensional (1D) convolution with gated linear unit, and residual connection, according to embodiments of the present disclosure.

FIG. 28 graphically depicts a convolution block comprising a one-dimensional (1D) convolution with gated linear unit, and residual connection, according to embodiments of the present disclosure. In one or more embodiments, the convolution block 2800 comprises a one-dimensional (1D) convolution filter 2810, a gated-linear unit 2815 as a learnable nonlinearity, a residual connection 2820 to the input 2805, and a scaling factor 2825. In the depicted embodiment, the scaling factor is $\sqrt{0.5}$, although different values may be used. The scaling factor helps ensures that the input variance is preserved early in training. In the depicted embodiment in FIG. 28, c (2830) denotes the dimensionality of the input 2805, and the convolution output of size 2·c (2835) may be split 2840 into equal-sized portions: the gate vector 2845 and the input vector 2850. The gated linear unit provides a linear path for the gradient flow, which alleviates the vanishing gradient issue for stacked convolution blocks while retaining non-linearity. In one or more embodiments, to introduce speaker-dependent control, a speaker-dependent embedding 2855 may be added as a bias to the convolution filter output, after a softsign function. In one or more embodiments, a softsign nonlinearity is used because it limits the range of the output while also avoiding the saturation problem that exponential-based nonlinearities sometimes exhibit. In one or more embodiments, the convolution filter weights are initialized with zero-mean and unit-variance activations throughout the entire network.

The convolutions in the architecture may be either non-causal (e.g., in encoder 2605/3105 and converter 2650/3150) or causal (e.g., in decoder 2630/3130). In one or more embodiments, to preserve the sequence length, inputs are padded with k−1 timesteps of zeros on the left for causal convolutions and (k−1)/2 timesteps of zeros on the left and on the right for non-causal convolutions, where k is an odd convolution filter width (in embodiments, odd convolution widths were used to simplify the convolution arithmetic, although even convolutions widths and even k values may be used). In one or more embodiments, dropout 2860 is applied to the inputs prior to the convolution for regularization.

d) Encoder

In one or more embodiments, the encoder network (e.g., encoder 2605/3105) begins with an embedding layer, which converts characters or phonemes into trainable vector representations, $h_e$. In one or more embodiments, these embeddings $h_e$ are first projected via a fully-connected layer from the embedding dimension to a target dimensionality. Then, in one or more embodiments, they are processed through a series of convolution blocks (such as the embodiments described in Section F.1.c) to extract time-dependent text information. Lastly, in one or more embodiments, they are projected back to the embedding dimension to create the attention key vectors $h_k$. The attention value vectors may be computed from attention key vectors and text embeddings, $h_v$, $\sqrt{0.5}(h_k+h_e)$, to jointly consider the local information in $h_e$ and the long-term context information in $h_k$. The key vectors $h_k$ are used by each attention block to compute attention weights, whereas the final context vector is computed as a weighted average over the value vectors $h_v$ (see Section F.1.f).

e) Decoder

In one or more embodiments, the decoder network (e.g., decoder 2630/3130) generates audio in an autoregressive manner by predicting a group of r future audio frames conditioned on the past audio frames. Since the decoder is autoregressive, in embodiments, it uses causal convolution blocks. In one or more embodiments, a mel-band log-magnitude spectrogram was chosen as the compact low-dimensional audio frame representation, although other representations may be used. It was empirically observed that decoding multiple frames together (i.e., having r>1) yields better audio quality.

In one or more embodiments, the decoder network starts with a plurality of fully-connected layers with rectified linear unit (ReLU) nonlinearities to preprocess input mel-spectrograms (denoted as "PreNet" in FIG. 26). Then, in one or more embodiments, it is followed by a series of decoder blocks, in which a decoder block comprises a causal convolution block and an attention block. These convolution blocks generate the queries used to attend over the encoder's hidden states (see Section F.1.f). Lastly, in one or more embodiments, a fully-connected layer outputs the next group of r audio frames and also a binary "final frame" prediction (indicating whether the last frame of the utterance has been synthesized). In one or more embodiments, dropout is applied before each fully-connected layer prior to the attention blocks, except for the first one.

An L1 loss may be computed using the output mel-spectrograms, and a binary cross-entropy loss may be computed using the final-frame prediction. L1 loss was selected since it yielded the best result empirically. Other losses, such as L2, may suffer from outlier spectral features, which may correspond to non-speech noise.

f) Attention Block

Figure 29:
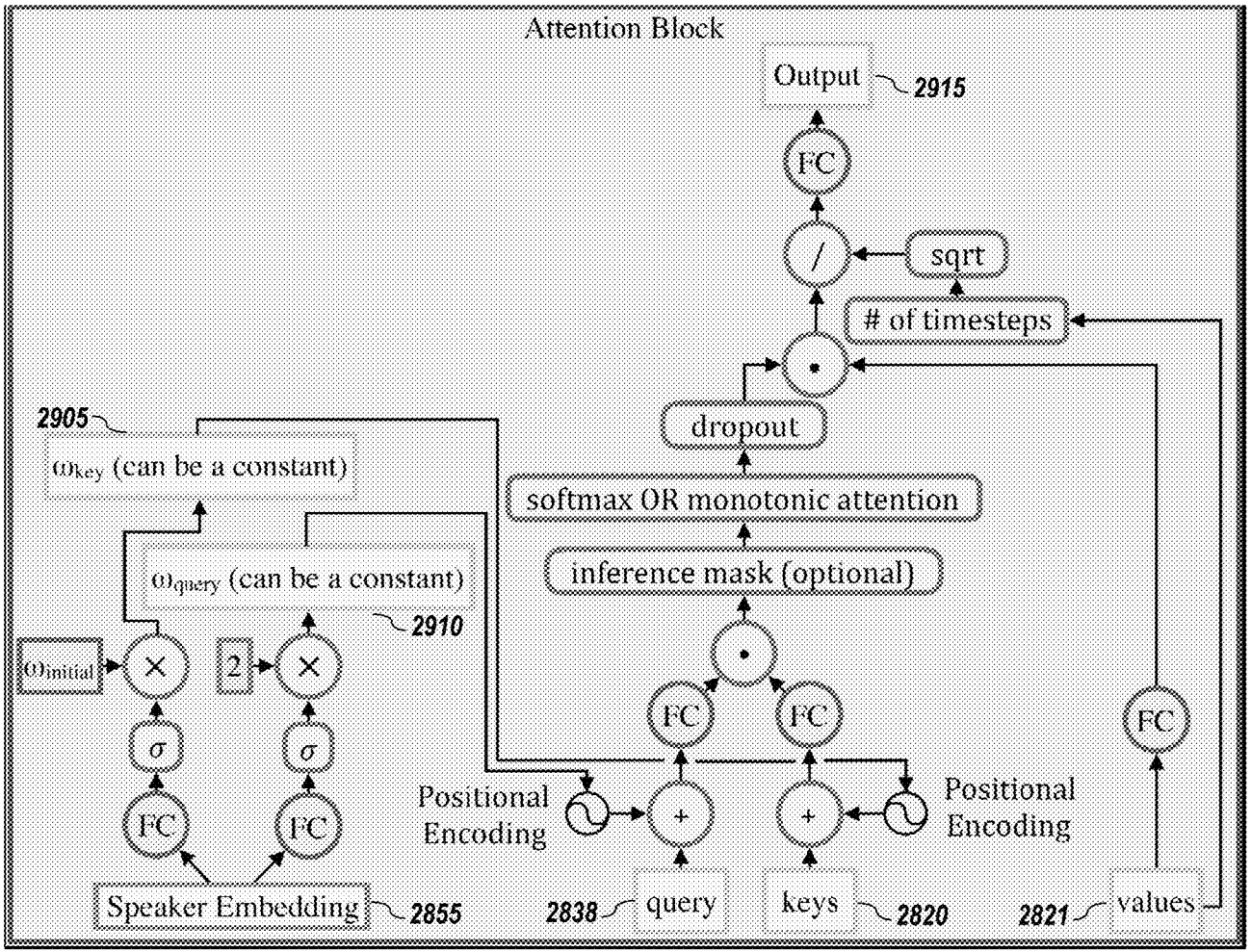
FIG. 29 graphically depicts an embodiment of an attention block, according to embodiments of the present disclosure.

FIG. 29 graphically depicts an embodiment of an attention block, according to embodiments of the present disclosure. As shown in FIG. 29, in one or more embodiments, positional encodings 2905, 2910 may be added to both keys 2920 and query 2938 vectors, with rates of $\omega_{key}$ 2905 and $\omega_{query}$ 2910, respectively. Forced monotonocity may be applied at inference by adding a mask of large negative values to the logits. One of two possible attention schemes may be used: softmax or monotonic attention (such as, for example, from Raffel et al. (2017)). In one or more embodiments, during training, attention weights are dropped out.

In one or more embodiments, a dot-product attention mechanism (depicted in FIG. 29) is used. In one or more embodiments, the attention mechanism uses a query vector 2938 (the hidden states of the decoder) and the per-timestep key vectors 2920 from the encoder to compute attention weights, and then outputs a context vector 2915 computed as the weighted average of the value vectors 2921.

Empirical benefits were observed from introducing an inductive bias where the attention follows a monotonic progression in time. Thus, in one or more embodiments, a positional encoding was added to both the key and the query vectors. These positional encodings $h_p$ may be chosen as $h_p(i)=\sin(\omega_s i/10000^{k/d})$ (for even i) or $\cos(\omega_s i/10000^{k/d})$ (for odd i), where i is the timestep index, k is the channel index in the positional encoding, d is the total number of channels in the positional encoding, and $\omega_s$ is the position rate of the encoding. In one or more embodiments, the position rate dictates the average slope of the line in the attention distribution, roughly corresponding to speed of speech. For a single speaker, $\omega_s$ may be set to one for the query and may be fixed for the key to the ratio of output timesteps to input timesteps (computed across the entire dataset). For multi-speaker datasets, $\omega_s$ may be computed for both the key and the query from the speaker embedding for each speaker (e.g., depicted in FIG. 29). As sine and cosine functions form an orthonormal basis, this initialization yields an attention distribution in the form of a diagonal line. In one or more embodiments, the fully-connected layer weights used to compute hidden attention vectors are initialized to the same values for the query projection and the key projection. Positional encodings may be used in all attention blocks. In one or more embodiments, a context normalization (such as, for example, in Gehring et al. (2017)) was used. In one or more embodiments, a fully-connected layer is applied to the context vector to generate the output of the attention block. Overall, positional encodings improve the convolutional attention mechanism.

Production-quality TTS systems have very low tolerance for attention errors. Hence, besides positional encodings, additional strategies were considered to eliminate the cases of repeating or skipping words. One approach which may be used is to substitute the canonical attention mechanism with the monotonic attention mechanism introduced in Raffel et al. (2017), which approximates hard-monotonic stochastic decoding with soft-monotonic attention by training in expectation. Raffel et al. (2017) also proposes hard monotonic attention process by sampling. It aims was to improve the inference speed by only attending over states that are selected via sampling, and thus avoiding compute over future states. Embodiments herein do not benefit from such speedup, and poor attention behavior in some cases, e.g., being stuck on the first or last character, were observed. Despite the improved monotonicity, this strategy may yield a more diffused attention distribution. In some cases, several characters are attended at the same time and high-quality speech could not be obtained. This may be attributed to the unnormalized attention coefficients of the soft alignment, potentially resulting in weak signal from the encoder. Thus, in one or more embodiments, an alternative strategy of constraining attention weights only at inference to be monotonic, preserving the training procedure without any constraints, was used. Instead of computing the softmax over the entire input, the softmax may be computed over a fixed window starting at the last attended-to position and going forward several timesteps. In experiments herein, a window size of three was used, although other window sizes may be used. In one or more embodiments, the initial position is set to zero and is later computed as the index of the highest attention weight within the current window. This strategy also enforces monotonic attention at inference and yields superior speech quality.

g) Converter

In one or more embodiments, the converter network (e.g., 2650/3150) takes as inputs the activations from the last hidden layer of the decoder, applies several non-causal convolution blocks, and then predicts parameters for downstream vocoders. In one or more embodiments, unlike the decoder, the converter is non-causal and non-autoregressive, so it can use future context from the decoder to predict its outputs.

In embodiments, the loss function of the converter network depends on the type of downstream vocoders:

1. Griffin-Lim vocoder: In one or more embodiments, the Griffin-Lim algorithm converts spectrograms to time-domain audio waveforms by iteratively estimating the unknown phases. It was found that raising the spectrogram to a power parametrized by a sharpening factor before waveform synthesis is helpful for improved audio quality. L1 loss is used for prediction of linear-scale log-magnitude spectrograms.

Figure 30:
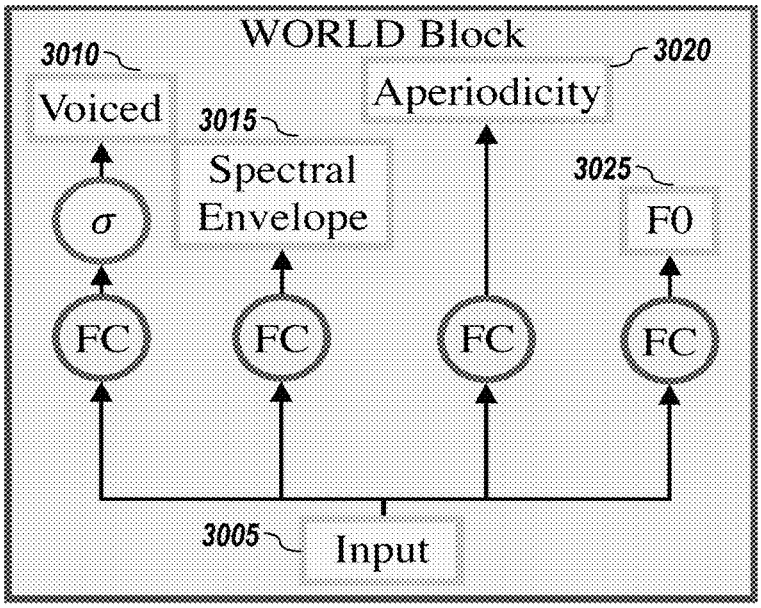
FIG. 30 graphically depicts an example generated WORLD vocoder parameters with fully connected (FC) layers, according to embodiments of the present disclosure.

2. WORLD vocoder: In one or more embodiments, the WORLD vocoder is based on Morise et al., 2016. FIG. 30 graphically depicts an example generated WORLD vocoder parameters with fully connected (FC) layers, according to embodiments of the present disclosure. In one or more embodiments, as vocoder parameters, a boolean value 3010 (whether the current frame is voiced or unvoiced), an F0 value 3025 (if the frame is voiced), the spectral envelope 3015, and the aperiodicity parameters 3020 are predicted. In one or embodiments, a cross-entropy loss was used for the voiced-unvoiced prediction, and L1 losses for all other predictions. In embodiments, the "σ" is the sigmoid function, which is used to obtain a bounded variable for binary cross entropy prediction. In one or more embodiments, the input 3005 is the output hidden states in the converter.

3. WaveNet vocoder: In one or more embodiments, a WaveNet was separately trained to be used as a vocoder treating mel-scale log-magnitude spectrograms as vocoder parameters. These vocoder parameters are input as external conditioners to the network. The WaveNet may be trained using ground-truth mel-spectrograms and audio waveforms. Good performance was observed with mel-scale spectrograms, which corresponds to a more compact representation of audio. In addition to L1 loss on mel-scale spectrograms at decode, L1 loss on linear-scale spectrogram may also be applied as Griffin-Lim vocoder.

It should be noted that other vocoders and other output types may be used.

2. Detailed Model Architecture Embodiments of Deep Voice 3

FIG. 31 graphically depicts an example detailed Deep Voice 3 model architecture, according to embodiments of the present disclosure. In one or more embodiments, the model 3100 uses a deep residual convolutional network to encode text and/or phonemes into per-timestep key 3120 and value 3122 vectors for an attentional decoder 3130. In one or more embodiments, the decoder 3130 uses these to predict the mel-band log magnitude spectrograms 3142 that correspond to the output audio. The dotted arrows 3146 depict the autoregressive synthesis process during inference. In one or more embodiments, the hidden state of the decoder is fed to a converter network 3150 to output linear spectrograms for Griffin-Lim 3152A or parameters for WORLD 3152B, which can be used to synthesize the final waveform. In one or more embodiments, weight normalization is applied to all convolution filters and fully-connected layer weight matrices in the model. As illustrated in the embodiment depicted in FIG. 31, WaveNet 3152 does not require a separate converter as it takes as input mel-band log magnitude spectrograms.

a) Optimizing Deep Voice 3 Embodiments for Deployment

Running inference with a TensorFlow graph turns out to be prohibitively expensive, averaging approximately 1 QPS. The poor TensorFlow performance may be due to the overhead of running the graph evaluator over hundreds of nodes and hundreds of timesteps. Using a technology such as XLA with TensorFlow could speed up evaluation but is unlikely to match the performance of a hand-written kernel. Instead, custom GPU kernels were implemented for Deep Voice 3 embodiment inference. Due to the complexity of the model and the large number of output timesteps, launching individual kernels for different operations in the graph (e.g., convolutions, matrix multiplications, unary and binary operations, etc.) may be impractical; the overhead of launch a CUDA kernel is approximately 50 μs, which, when aggregated across all operations in the model and all output timesteps, limits throughput to approximately 10 QPS. Thus, a single kernel was implemented for the entire model, which avoids the overhead of launching many CUDA kernels. Finally, instead of batching computation in the kernel, the kernel embodiment herein operates on a single utterance and as many concurrent streams as there are Streaming Multiprocessors (SMs) on the GPU are launched. Every kernel may be launched with one block, so the GPU is expected to schedule one block per SM, allowing the ability to scale inference speed linearly with the number of SMs.

On a single Nvidia Tesla P100 GPU by Nvidia Corporation based in Santa Clara, Calif. with 56 SMs, an inference speed of 115 QPS was achieved, which corresponds to a target ten million queries per day. In embodiments, WORLD synthesis was parallelized across all 20 CPUs on the server, permanently pinning threads to CPUs in order to maximize cache performance. In this setup, GPU inference is the bottleneck, as WORLD synthesis on 20 cores is faster than 115 QPS. Inference may be made faster through more optimized kernels, smaller models, and fixed-precision arithmetic.

b) Model Hyperparameters

All hyperparameters of the models used in this patent document are provided in Table 7, below.

TABLE 7

Hyperparameters used for best models for the three datasets used in the patent document.

| Parameter | Single-Speaker | VCTK | LibriSpeech |
|---|---|---|---|
| FFT Size | 4096 | 4096 | 4096 |
| FFT Window Size/Shift | 2400/600 | 2400/600 | 1600/400 |
| Audio Sample Rate | 48000 | 48000 | 16000 |
| Reduction Factor r | 4 | 4 | 4 |
| Mel Bands | 80 | 80 | 80 |
| Sharpening Factor | 1.4 | 1.4 | 1.4 |

TABLE 7-continued

Hyperparameters used for best models for the three datasets used in the patent document.

| Parameter | Single-Speaker | VCTK | LibriSpeech |
|---|---|---|---|
| Character Embedding Dim. | 256 | 256 | 256 |
| Encoder Layers/Conv. Width/Channels | 7/5/64 | 7/5/128 | 7/5/256 |
| Decoder Affine Size | 128, 256 | 128, 256 | 128, 256 |
| Decoder Layers/Conv. Width | 4/5 | 6/5 | 8/5 |
| Attention Hidden Size | 128 | 256 | 256 |
| Position Weight/Initial Rate | 1.0/6.3 | 0.1/7.6 | 0.1/2.6 |
| Converter Layers/Conv. Width/Channels | 5/5/256 | 6/5/256 | 8/5/256 |
| Dropout Probability | 0.95 | 0.95 | 0.99 |
| Number of Speakers | 1 | 108 | 2484 |
| Speaker Embedding Dim. | — | 16 | 512 |
| ADAM Learning Rate | 0.001 | 0.0005 | 0.0005 |
| Anneal Rate/Anneal Interval | — | 0.98/30000 | 0.95/30000 |
| Batch Size | 16 | 16 | 16 |
| Max Gradient Norm | 100 | 100 | 50.0 |
| Gradient Clipping Max. Value | 5 | 5 | 5 |

3. Cited Documents

Each document listed below or referenced anywhere herein is incorporated by reference herein in its entirety.

Yannis Agiomyrgiannakis. Vocaine the Vocoder and Applications in Speech Synthesis. In *ICASSP,* 2015.

Jonas Gehring, Michael Auli, David Grangier, Denis Yarats, and Yann Dauphin. Convolutional Sequence to Sequence Learning. In *ICML,* 2017.

Daniel Griffin and Jae Lim. Signal Estimation From Modified Short-Time Fourier Transform. *IEEE Transactions on Acoustics, Speech, and Signal Processing,* 1984.

Soroush Mehri, Kundan Kumar, Ishaan Gulrajani, Rithesh Kumar, Shubham Jain, Jose Sotelo, Aaron Courville, and Yoshua Bengio. Sample RNN: An Unconditional End-To-End Neural Audio Generation Model. In *ICLR,* 2017.

Masanori Morise, Fumiya Yokomori, and Kenji Ozawa. WORLD: A vocoder-based high-quality speech synthesis system for real-time applications. *IEICE Transactions on Information and Systems,* 2016.

Robert Ochshorn and Max Hawkins. Gentle. https://github.com/lowerquality/gentle, 2017.

Aaron van den Oord, Sander Dieleman, Heiga Zen, Karen Simonyan, Oriol Vinyals, Alex Graves, Nal Kalchbrenner, Andrew Senior, and Koray Kavukcuoglu. WaveNet: A generative model for raw audio. *arXiv:*1609.03499, 2016.

Vassil Panayotov, Guoguo Chen, Daniel Povey, and Sanjeev Khudanpur. LibriSpeech: An ASR corpus based on public domain audio books. In *Acoustics, Speech and Signal Processing* (*ICASSP*), 2015 *IEEE International Conference on*, pp. 5206-5210. IEEE, 2015. The LibriSpeech dataset is available at http://www.openslr.org/12/.

Colin Raffel, Thang Luong, Peter J Liu, Ron J Weiss, and Douglas Eck. Online and Linear-Time Attention by Enforcing Monotonic Alignments. In *ICML,* 2017.

Jose Sotelo, Soroush Mehri, Kundan Kumar, Joao Felipe Santos, Kyle Kastner, Aaron Courville, and Yoshua Bengio. Char2Wav: End-to-End Speech Synthesis. In *ICLR workshop,* 2017.

G. Additional Embodiment Implementations

Aspects of the present disclosure may be encoded upon one or more non-transitory computer-readable media with instructions for one or more processors or processing units to cause steps to be performed. It shall be noted that the one or more non-transitory computer-readable media shall include volatile and non-volatile memory. It shall be noted that alternative implementations are possible, including a hardware implementation or a software/hardware implementation. Hardware-implemented functions may be realized using ASIC(s), programmable arrays, digital signal processing circuitry, or the like. Accordingly, the "means" terms in any claims are intended to cover both software and hardware implementations. Similarly, the term "computer-readable medium or media" as used herein includes software and/or hardware having a program of instructions embodied thereon, or a combination thereof. With these implementation alternatives in mind, it is to be understood that the figures and accompanying description provide the functional information one skilled in the art would require to write program code (i.e., software) and/or to fabricate circuits (i.e., hardware) to perform the processing required.

It shall be noted that embodiments of the present disclosure may further relate to computer products with a non-transitory, tangible computer-readable medium that have computer code thereon for performing various computer-implemented operations. The media and computer code may be those specially designed and constructed for the purposes of the present disclosure, or they may be of the kind known or available to those having skill in the relevant arts. Examples of tangible computer-readable media include, but are not limited to: magnetic media such as hard disks, floppy disks, and magnetic tape; optical media such as CD-ROMs and holographic devices; magneto-optical media; and hardware devices that are specially configured to store or to store and execute program code, such as application specific integrated circuits (ASICs), programmable logic devices (PLDs), flash memory devices, and ROM and RAM devices. Examples of computer code include machine code, such as produced by a compiler, and files containing higher level code that are executed by a computer using an interpreter. Embodiments of the present disclosure may be implemented in whole or in part as machine-executable instructions that may be in program modules that are executed by a processing device. Examples of program modules include libraries, programs, routines, objects, components, and data structures. In distributed computing environments, program modules may be physically located in settings that are local, remote, or both.

One skilled in the art will recognize no computing system or programming language is critical to the practice of the present disclosure. One skilled in the art will also recognize that a number of the elements described above may be physically and/or functionally separated into sub-modules or combined together.

It will be appreciated to those skilled in the art that the preceding examples and embodiments are exemplary and not limiting to the scope of the present disclosure. It is intended that all permutations, enhancements, equivalents, combinations, and improvements thereto that are apparent to those skilled in the art upon a reading of the specification and a study of the drawings are included within the true spirit and scope of the present disclosure. It shall also be noted that elements of any claims may be arranged differently including having multiple dependencies, configurations, and combinations.

What is claimed is:

1. A computer-implemented method for synthesizing audio from an input text, comprising:

given a limited set of one or more audios of a new speaker that was not part of training data used to train a neural multi-speaker generative model, using a neural speaker encoder model comprising a first set of trained model parameters to obtain a speaker embedding for the new speaker given the limited set of one or more audios as an input to the neural speaker encoder model; and using the neural multi-speaker generative model comprising a second set of trained model parameters, the input text, and the speaker embedding for the new speaker generated by the neural speaker encoder model comprising the first set of trained model parameters to generate a synthesized audio representation for the input text in which the synthesized audio includes speech characteristics of the new speaker, wherein the neural multi-speaker generative model comprising the second set of trained parameters was trained using as inputs, for a speaker, (1) a training set of text-audio pairs, in which a text-audio pair comprises a text and a corresponding audio of that text by the speaker, and (2) a speaker embedding corresponding to a speaker identifier for that speaker.

2. The computer-implemented method of claim 1 wherein the first set of trained model parameters for the neural speaker encoder model and the second sets of trained model parameters for the neural multi-speaker generative model were obtain by performing the steps comprising:

training the neural multi-speaker generative model, using as inputs, for a speaker, the training set of text-audio pairs and a speaker embedding corresponding to the speaker identifier for that speaker, to obtain the second set of trained model parameters for the neural multi-speaker generative model and to obtain a set of speaker embeddings corresponding to the speaker identifiers; and training the neural speaker encoder model, using a set of audios selected from the training set of text-audio pairs and corresponding speaker embeddings for the speakers of the set of audios from the set of speaker embeddings, to obtain the first set of trained model parameters for the neural speaker encoder model.

3. The computer-implemented method of claim 1 wherein the first set of trained model parameters for the neural speaker encoder model and the second set of trained model parameters for the neural multi-speaker generative model were obtain by performing the steps comprising:

training the neural multi-speaker generative model, using as inputs, for a speaker, the training set of text-audio pairs and a speaker embedding corresponding to the speaker identifier for that speaker, to obtain a third set of trained model parameters for the neural multi-speaker generative model and to obtain a set of speaker embeddings corresponding to the speaker identifiers;

training the neural speaker encoder model, using a set of audios selected from the training set of text-audio pairs and corresponding speaker embeddings for the speakers of the set of audios from the first set of speaker embeddings, to obtain a fourth set of trained model parameters for the neural speaker encoder model; and performing joint training the neural multi-speaker generative model comprising the third set of trained model parameters and the neural speaker encoder model comprising the fourth set of trained model parameters to adjust at least some of the third and fourth trained model parameters to obtain the first set of trained model parameters for the neural speaker encoder model and the second set of trained model parameters for the neural multi-speaker generative model by comparing synthesized audios generated by the neural multi-speaker generative model using speaker embeddings from the neural speaker encoder model to ground truth audios corresponding to the synthesized audios.

4. The computer-implemented method of claim 3 further comprising, as part of the joint training, adjusting at least some of parameters of the set of speaker embeddings.

5. The computer-implemented method of claim 1 wherein the first set of trained model parameters for the neural speaker encoder model and the second sets of trained model parameters for the neural multi-speaker generative model were obtain by performing the steps comprising:

performing joint training of the neural multi-speaker generative model and the neural speaker encoder model to obtain the first set of trained model parameters for the neural speaker encoder model and the second set of trained model parameters for the neural multi-speaker generative model by comparing synthesized audios generated by the neural multi-speaker generative model using speaker embeddings from the neural speaker encoder model to ground truth audios corresponding to the synthesized audios.

6. The computer-implemented method of claim 1 wherein the neural speaker encoder model comprises a neural network architecture comprising:

a spectral processing network component that computes a spectral audio representation for input audio and passes the spectral audio representation to a prenet component comprising one or more fully-connected layers with one or more non-linearity units for feature transformation;

a temporal processing network component in which temporal contexts are incorporated using a plurality of convolutional layers with gated linear unit and residual connections; and a cloning sample attention network component comprising a multi-head self-attention mechanism that determines weights for different audios and obtains aggregated speaker embeddings.

7. A generative text-to-speech system comprising:

one or more processors; and a non-transitory computer-readable medium or media comprising one or more sequences of instructions which, when executed by at least one of the one or more processors, causes steps to be performed comprising:

given a limited set of one or more audios of a new speaker that was not part of training data used to train a neural multi-speaker generative model, using a speaker encoder model comprising a first set of trained model parameters to obtain a speaker embedding for the new speaker given the limited set of one or more audios as an input to the speaker encoder model; and using the neural multi-speaker generative model comprising a second set of trained model parameters, an input text, and the speaker embedding for the new speaker generated by the speaker encoder model comprising the first set of trained model parameters to generate a synthesized audio representation for the input text in which the synthesized audio includes speech characteristics of the new speaker, wherein the neural multi-speaker generative model comprising the second set of trained parameters was trained using as inputs, for a speaker, (1) a training set of text-audio pairs, in which a text-audio pair comprises a text and a corresponding audio of that text by the speaker, and (2) a speaker embedding corresponding to a speaker identifier for that speaker.

8. The generative text-to-speech system of claim 7 wherein the first set of trained model parameters for the speaker encoder model and the second sets of trained model parameters for the neural multi-speaker generative model were obtain by performing the steps comprising:

training the neural multi-speaker generative model, using as inputs, for a speaker, the training set of text-audio pairs and a speaker embedding corresponding to the speaker identifier for that speaker, to obtain the second set of trained model parameters for the neural multi-speaker generative model and to obtain a set of speaker embeddings corresponding to the speaker identifiers; and training the speaker encoder model, using a set of audios selected from the training set of text-audio pairs and corresponding speaker embeddings for the speakers of the set of audios from the set of speaker embeddings, to obtain the first set of trained model parameters for the speaker encoder model.

9. The generative text-to-speech system of claim 7 wherein the first set of trained model parameters for the speaker encoder model and the second set of trained model parameters for the neural multi-speaker generative model were obtain by performing the steps comprising:

training the neural multi-speaker generative model, using as inputs, for a speaker, the training set of text-audio pairs and a speaker embedding corresponding to the speaker identifier for that speaker, to obtain a third set of trained model parameters for the neural multi-speaker generative model and to obtain a set of speaker embeddings corresponding to the speaker identifiers;

training the speaker encoder model, using a set of audios selected from the training set of text-audio pairs and corresponding speaker embeddings for the speakers of the set of audios from the first set of speaker embeddings, to obtain a fourth set of trained model parameters for the speaker encoder model; and performing joint training the neural multi-speaker generative model comprising the third set of trained model parameters and the speaker encoder model comprising the fourth set of trained model parameters to adjust at least some of the third and fourth trained model parameters to obtain the first set of trained model parameters for the speaker encoder model and the second set of trained model parameters for the neural multi-speaker generative model by comparing synthesized audios generated by the neural multi-speaker generative model using speaker embeddings from the speaker encoder model to ground truth audios corresponding to the synthesized audios.

10. The generative text-to-speech system of claim 9 further comprising, as part of the joint training, adjusting at least some of parameters of the set of speaker embeddings.

11. The generative text-to-speech system of claim 7 wherein the first set of trained model parameters for the speaker encoder model and the second sets of trained model parameters for the neural multi-speaker generative model were obtain by performing the steps comprising:

performing joint training of the neural multi-speaker generative model and the speaker encoder model to obtain the first set of trained model parameters for the speaker encoder model and the second set of trained model parameters for the neural multi-speaker generative model by comparing synthesized audios generated by the neural multi-speaker generative model using speaker embeddings from the speaker encoder model to ground truth audios corresponding to the synthesized audios.

12. The generative text-to-speech system of claim 7 wherein the speaker encoder model comprises a neural network architecture comprising:

a spectral processing network component that computes a spectral audio representation for input audio and passes the spectral audio representation to a prenet component comprising one or more fully-connected layers with one or more non-linearity units for feature transformation;

a temporal processing network component in which temporal contexts are incorporated using a plurality of convolutional layers with gated linear unit and residual connections; and a cloning sample attention network component comprising a multi-head self-attention mechanism that determines weights for different audios and obtains aggregated speaker embeddings.

13. A computer-implemented method for synthesizing audio from an input text, comprising:

receiving a limited set of one or more texts and corresponding ground truth audios of a new speaker that was not part of training data used to train a neural multi-speaker generative model, which training results in speaker embedding parameters for a set of speaker embeddings;

inputting the limited set of one or more texts and corresponding ground truth audios for the new speaker and at least one or more of the speaker embeddings comprising speaker embedding parameters into the neural multi-speaker generative model comprising pre-trained model parameters or trained model parameters;

using a comparison of a synthesized audio generated by the neural multi-speaker generative model to its corresponding ground truth audio to adjust at least some of the speaker embedding parameters to obtain a speaker embedding that represents speaker characteristics of the new speaker; and using the neural multi-speaker generative model comprising trained model parameters, the input text, and the speaker embedding for the new speaker to generate a synthesized audio representation for the input text in which the synthesized audio includes speaker characteristics of the new speaker.

14. The computer-implemented method of claim 13 wherein:

the neural multi-speaker generative model was trained using as inputs, for a speaker:

(1) a training set of text-audio pairs, in which a text-audio pair comprises a text and a corresponding audio of that text spoken by the speaker, and (2) a speaker embedding corresponding to a speaker identifier for that speaker.

15. The computer-implemented method of claim 13 wherein the steps of using a comparison of a synthesized audio generated by the neural multi-speaker generative model to its corresponding ground truth audio to adjust at least some of the speaker embedding parameters to obtain a speaker embedding that represents speaker characteristics of the new speaker further comprises:

using a comparison of a synthesized audio generated by the neural multi-speaker generative model to its corresponding ground truth audio to adjust:

at least some of the speaker embedding parameters to obtain a speaker embedding that represents speaker characteristics of the new speaker; and at least some of the pre-trained model parameters of the neural multi-speaker generative model to obtain the trained model parameters.

16. The computer-implemented method of claim 13 wherein a speaker embedding is correlated to a speaker identity via a look-up table.

17. A generative text-to-speech system comprising:

one or more processors; and a non-transitory computer-readable medium or media comprising one or more sequences of instructions which, when executed by at least one of the one or more processors, causes steps to be performed comprising:

receiving a limited set of one or more texts and corresponding ground truth audios of a new speaker that was not part of training data used to train a neural multi-speaker generative model, which training results in speaker embedding parameters for a set of speaker embeddings;

inputting the limited set of one or more texts and corresponding ground truth audios for the new speaker and at least one or more of the speaker embeddings comprising speaker embedding parameters into the neural multi-speaker generative model comprising pre-trained model parameters or trained model parameters;

using a comparison of a synthesized audio generated by the neural multi-speaker generative model to its corresponding ground truth audio to adjust at least some of the speaker embedding parameters to obtain a speaker embedding that represents speaker characteristics of the new speaker; and using the neural multi-speaker generative model comprising trained model parameters, the input text, and the speaker embedding for the new speaker to generate a synthesized audio representation for the input text in which the synthesized audio includes speaker characteristics of the new speaker.

18. The generative text-to-speech system of claim 17 wherein:

the neural multi-speaker generative model was trained using as inputs, for a speaker:

(1) a training set of text-audio pairs, in which a text-audio pair comprises a text and a corresponding audio of that text spoken by the speaker, and (2) a speaker embedding corresponding to a speaker identifier for that speaker.

19. The generative text-to-speech system of claim 17 wherein the steps of using a comparison of a synthesized audio generated by the neural multi-speaker generative model to its corresponding ground truth audio to adjust at least some of the speaker embedding parameters to obtain a speaker embedding that represents speaker characteristics of the new speaker further comprises:

using a comparison of a synthesized audio generated by the neural multi-speaker generative model to its corresponding ground truth audio to adjust:

at least some of the speaker embedding parameters to obtain a speaker embedding that represents speaker characteristics of the new speaker; and at least some of the pre-trained model parameters of the neural multi-speaker generative model to obtain the trained model parameters.

20. The generative text-to-speech system of claim 17 wherein the neural multi-speaker generative model comprises:

an encoder, which converts textual features of an input text into learned representations; and a decoder, which decodes the learned representations with a multi-hop convolutional attention mechanism into low-dimensional audio representation.

* * * * *